US010852049B2

(12) United States Patent
Yi et al.

(10) Patent No.: US 10,852,049 B2
(45) Date of Patent: Dec. 1, 2020

(54) REFRIGERATOR INCLUDING CRYOGENIC FREEZING COMPARTMENT

(71) Applicant: LG Electronics Inc., Seoul (KR)

(72) Inventors: Myeongha Yi, Seoul (KR); Yoomin Park, Seoul (KR); Hyoungkeun Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 219 days.

(21) Appl. No.: 15/943,062

(22) Filed: Apr. 2, 2018

(65) Prior Publication Data

US 2018/0283765 A1 Oct. 4, 2018

(30) Foreign Application Priority Data

Apr. 3, 2017 (KR) ..... 10-2017-0042938

(51) Int. Cl.
*F25D 17/06* (2006.01)
*F25B 21/02* (2006.01)
(Continued)

(52) U.S. Cl.
CPC ..... *F25D 17/065* (2013.01); *F25B 21/02* (2013.01); *F25D 11/02* (2013.01); *F25D 23/066* (2013.01);
(Continued)

(58) Field of Classification Search
CPC ..... F25B 21/02; F25B 2321/023; F25B 2321/0252; F25D 17/065; F25D 11/02; F25D 23/066; F25D 11/025
See application file for complete search history.

(56) References Cited

U.S. PATENT DOCUMENTS 7,278,270 B2 * 10/2007 Culp ..... F25B 21/02 136/203
7,815,315 B2 * 10/2010 Momose ..... G03B 21/16 353/52
(Continued)

FOREIGN PATENT DOCUMENTS

CN 203163332 8/2013
KR 10-2013-0049496 5/2013
(Continued)

OTHER PUBLICATIONS

Shin, KR20130049496—Translation (Year: 2013).*
European Search Report in European Application No. 18165136.5, dated Aug. 20, 2018, 9 pages.

*Primary Examiner* — Christopher R Zerphey
(74) *Attorney, Agent, or Firm* — Fish & Richardson P.C.

(57) ABSTRACT

A refrigerator includes a storage space, an evaporator located inside of the storage space, a grille panel assembly that partitions the storage space to separate an evaporator space, a cryogenic freezing compartment that defines an insulation space within the storage space that maintains a temperature of the insulation space less than a temperature of the storage space, and a thermoelectric module assembly located at the grille panel and configured to supply cold air to the cryogenic freezing compartment. The thermoelectric module assembly includes a thermoelectric module having a heat absorption surface and a heat generation surface, a cold sink configured to contact the heat absorption surface and located in the cryogenic freezing compartment, a heat sink configured to contact the heat generation surface and located in the evaporator space, and an insulation frame that receives the thermoelectric module and that thermally insulates the cold sink from the heat sink.

18 Claims, 37 Drawing Sheets

(51) Int. Cl.
*F25D 11/02* (2006.01)
*F25D 23/06* (2006.01)
*F25D 25/02* (2006.01)

(52) U.S. Cl.
CPC . *F25B 2321/023* (2013.01); *F25B 2321/0252* (2013.01); *F25D 11/025* (2013.01); *F25D 25/025* (2013.01)

(56) References Cited

U.S. PATENT DOCUMENTS

2003/0115892 A1* 6/2003 Fu ..... F25D 17/042
62/187
2006/0185711 A1* 8/2006 Bang ..... F25D 11/00
136/230
2007/0119187 A1* 5/2007 Kitchens ..... F17C 13/00
62/3.6
2008/0053108 A1* 3/2008 Wen ..... F25B 21/02
62/3.7
2016/0030292 A1* 2/2016 Hyun ..... A61J 15/0076
604/516
2017/0276421 A1* 9/2017 Candeo ..... F04D 29/601
2018/0292119 A1* 10/2018 Sung ..... F25B 21/02

FOREIGN PATENT DOCUMENTS

KR 20130049496 A * 5/2013
WO 2016-129906 8/2016

* cited by examiner

REFRIGERATOR INCLUDING CRYOGENIC FREEZING COMPARTMENT

CROSS-REFERENCE TO RELATED APPLICATIONS

The present application claims priority under 35 U.S.C. 119 and 35 U.S.C. 365 to Korean Patent Application No. 10-2017-0042938, filed on Apr. 3, 2017, which is hereby incorporated by reference in its entirety.

FIELD

The present disclosure relates to a refrigerator including cryogenic freezing compartment.

BACKGROUND

Generally, refrigerators are household appliances that store foods at a low temperature. An inner space of such as a refrigerator may be divided into a refrigerating compartment and a freezing compartment according to temperatures for foods stored in the refrigerator. The refrigerating compartment generally maintains a temperature of about 3 degrees Celsius to about 4 degrees Celsius, and the freezing compartment generally maintains a temperature of about −20 degrees Celsius.

The freezing compartment having a temperature of about −20 degrees Celsius is a space in which foods are kept in a frozen state and is often used by consumers to store the foods for a long time. However, in the existing freezing compartment, which maintains a temperature of about −20 degrees Celsius, when water within cells is frozen while freezing meat or seafood, a phenomenon in which water is exuded out of the cells may occur, and thus, the cells are destroyed. As a result, when cooking the foods after thawing, their original taste may be lost, or the texture may change.

On the other hand, when meat or seafood is frozen, the temperature rapidly passes through the freezing point temperature zone in which intracellular ice is formed to minimize the cell destruction. Thus, even after thawing, meatiness and texture may be renewed or reproduced freshly to make it possible to enjoy delicious dishes.

As the case stands, fancy restaurants use a cryogenic freezer that is capable of rapidly freezing meat, fish, and seafood. However, unlike restaurants that need to preserve large quantities of foods, since it is not always necessary to use the cryogenic freezer in ordinary homes, it is not easy to separately purchase the cryogenic freezer that is used in restaurants.

However, as the quality of life has improved, consumers' desire to eat more delicious foods has become stronger to lead to an increase in consumers who want to use the cryogenic freezer.

In order to meet the needs of such consumers, there has been developed a household refrigerator in which a cryogenic freezing compartment is installed in a portion of the freezing compartment. It is preferable that the cryogenic freezing compartment satisfies a temperature of about −50 degrees Celsius, such an extremely low temperature is a temperature that is not attained only by a refrigeration cycle using a general refrigerant.

Accordingly, there has been developed a household refrigerator in which a cryogenic freezing compartment is separately provided in the freezing compartment in a manner in which cooling is performed by using a refrigeration cycle up to a temperature of −20 degrees Celsius and by using a thermoelectric module (TEM) in case of cryogenic refrigeration.

However, since a temperature difference between the freezing compartment of about −20 degree Celsius and a cryogenic freezing compartment of about −50 degree Celsius is very large, it is not easy to realize a temperature of about −50 degrees Celsius by applying a structure for insulation, defrosting, cold air supply, and the like, which was applied to the design of the existing freezing compartment, to the cryogenic freezing compartment as it is.

Also, when a cryogenic freezing compartment, which occupies a space of the freezing compartment itself, is provided, since reduction in volume capacity of the freezing compartment has to be minimized, it is necessary to minimize a space occupied by the structure for cooling and circulating cold air in the cryogenic freezing compartment.

Particularly, when the cryogenic temperature is implemented using the TEM, heat exchange has to be smoothly performed both at a heat absorption side and a heat generation side of the TEM, cold air cooled by the heat exchange at the heat absorption side has to smoothly circulate, and heat exchange loss and flow loss should not occur while having a simple structure as much as possible.

Furthermore, due to the volume occupied by the TEM and related components, which are installed to achieve the cryogenic temperature, there is a possibility that a flow rate or pressure distribution in the existing grille panel assembly structure changes, and thus, the freezing in the freezing compartment is not smoothly performed.

SUMMARY

Embodiments provide a refrigerator in which an independent cryogenic freezing compartment is provided in a storage space, and the inside of the cryogenic freezing compartment is in an extremely low temperature state by a thermoelectric module.

Embodiments also provide a refrigerator in which a cryogenic freezing compartment is improved in cooling efficiency, and also, a volume loss is minimized.

Embodiments also provide a refrigerator in which a thermoelectric module for cooling a cryogenic freezing compartment is improved in assembling workability and productivity.

Embodiments also provide a refrigerator in which a thermoelectric module for cooling a cryogenic freezing compartment is improved in thermal efficiency.

In one embodiment, a refrigerator includes: a main body defining a storage space; an evaporator disposed inside the storage space to supply cold air into the storage space; a grille panel assembly partitioning a space in which the evaporator is accommodated from the storage space; a cryogenic freezing compartment having an independent insulation space within the storage space and having an opened rear surface mounted on a grille panel; and a thermoelectric module assembly mounted on the grille panel to supply the cold air into the cryogenic freezing compartment so that the inside of the cryogenic freezing compartment has a temperature less than that of the storage space, wherein the thermoelectric module assembly includes: a thermoelectric module; a cold sink coming into contact with a heat absorption surface of the thermoelectric module and disposed in the cryogenic freezing compartment; a heat sink coming into contact with a heat generation surface of the thermoelectric module and disposed in the space in which the evaporator is accommodated; and an insulation material in which the thermoelectric module is accommodated and which thermally insulates the cold sink and the heat sink from each other.

The thermoelectric module assembly may further include a module housing having an accommodation groove defining a space in which the heat sink, the insulation material, and the thermoelectric module are accommodated.

The insulation material may cover an opening of the accommodation groove and have a front surface disposed on the same plane as the opening.

A flange bent outward and closely attached to a rear surface of the grille panel assembly may be disposed in the opening of the accommodation groove.

A fixing boss passing through the heat sink and the insulation material to extend up to the cold sink may be disposed inside the accommodation groove, and in the cold sink, a fixing member passing through the cold sink may be coupled to the fixing boss so that the cold sink and the heat sink are coupled to be thermally insulated from each other.

The module housing may be disposed in the space in which the evaporator is disposed.

The module housing may include a spacer that extends to come into contact with an inner case defining the storage space and the space in which the evaporator is accommodated and is disposed in a space between the module housing and the inner case.

The spacer may have a hollow, and a coupling part inserted into the hollow of the spacer and coupled to the spacer may be further provided on the inner case.

A module fixing member may be mounted on a rear side of the inner case, which corresponds to the modeling housing, and a coupling part passing through the inner case and coupled to the spacer may be further disposed on the module fixing member.

A refrigerant inflow tube connected to a capillary tube and a refrigerant outflow tube connected to the evaporator may be provided in the heat sink, and a low-temperature refrigerant of the capillary tube may be supplied to the evaporator via the heat sink.

A hole through which the refrigerant inflow tube and the refrigerant outflow tube pass may be defined in one surface of the module housing.

One surface of the cold sink, which comes into contact with the insulation material, may be disposed on a reference line with respect to the grille panel assembly.

An accommodation part inserted through an opened rear surface of the cryogenic freezing compartment to seal a space between the rear surface of the cryogenic freezing compartment and the grille panel may be disposed on one side of the grille panel The accommodation part may protrude to be inserted into the opened rear surface of the cryogenic freezing compartment, and the thermoelectric module assembly may be accommodated inside the accommodation part.

A cooling fan for circulating the cold air between the cryogenic freezing compartment and the cold sink may be disposed in the accommodation part.

In another embodiment, a refrigerator includes: a main body; an evaporator provided in the main body; a grille panel assembly partitioning a heat-exchange space in which the evaporator is accommodated from the storage space in which foods are stored; a cryogenic freezing compartment having a space that is thermally insulated from the storage space inside the storage space; and a thermoelectric module assembly mounted on the grille panel to cool the cryogenic freezing compartment, wherein the thermoelectric module assembly includes: a cold sink disposed at a side of the storage space with respect to a boundary between the storage space and the heat-exchange space; and a heat sink disposed at a side of the heat-exchange space with respect to the boundary between the storage space and the heat-exchange space.

A thermoelectric module accommodation part which is inserted into the cryogenic freezing compartment and in which the thermoelectric module assembly may be disposed is disposed in the grille panel.

The heat sink may be connected to a refrigerant passage that connects an expansion device and the evaporator, which constitute a refrigeration cycle, to each other, and a refrigerant supplied to the evaporator may be introduced to perform cooling.

The thermoelectric module assembly may further include a module housing disposed inside the heat-exchange space and mounted on the grille panel in a state in which the heat sink and the cold sink are accommodated.

A spacer coming into contact with an inner surface of the heat-exchange space, which faces the grille panel assembly, to space the module housing from the inner surface of the heat-exchange space may be disposed on the module housing.

The details of one or more embodiments are set forth in the accompanying drawings and the description below. Other features will be apparent from the description and drawings, and from the claims.

DETAILED DESCRIPTION OF THE EMBODIMENTS

Hereinafter, preferred embodiments will be described in more detail with reference to the accompanying drawings.

The present invention may, however, be embodied in different forms and should not be construed as limited to the embodiments set forth herein. Rather, these embodiments are provided so that the present invention will be thorough and complete, and will fully convey the scope of the present invention to those skilled in the art.

In this specification, the term "cryogenic temperature" means a temperature that is lower than about 20 degrees Celsius, which is a typical freezing storage temperature of the freezing compartment, and the temperature range is not limited numerically. Also, even in the cryogenic freezing compartment, the storage temperature may be below about 20 degrees Celsius or more.

Figure 1:
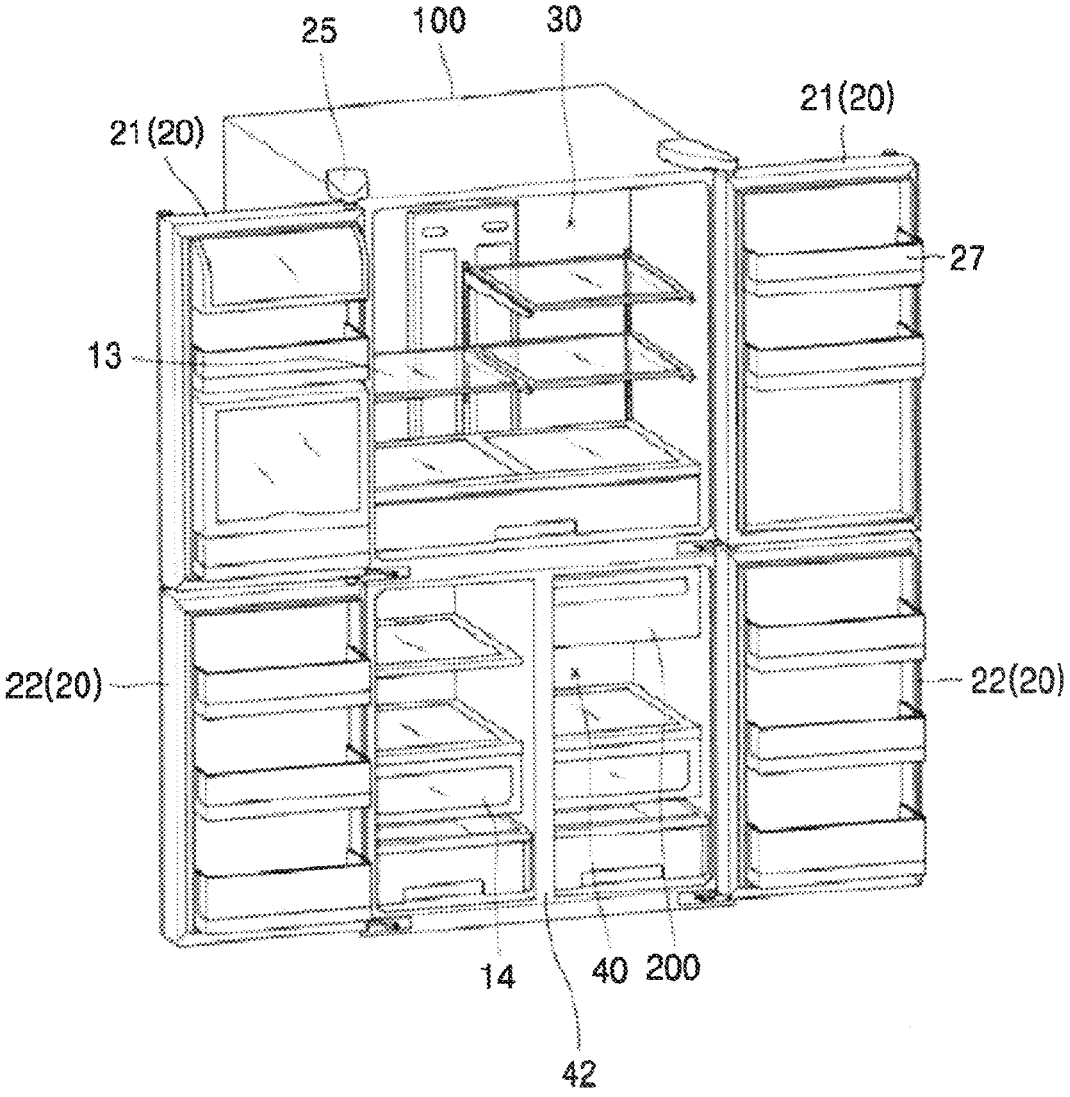
FIG. 1 is a perspective of a refrigerator with a door opened according to an embodiment.
Figure 2:
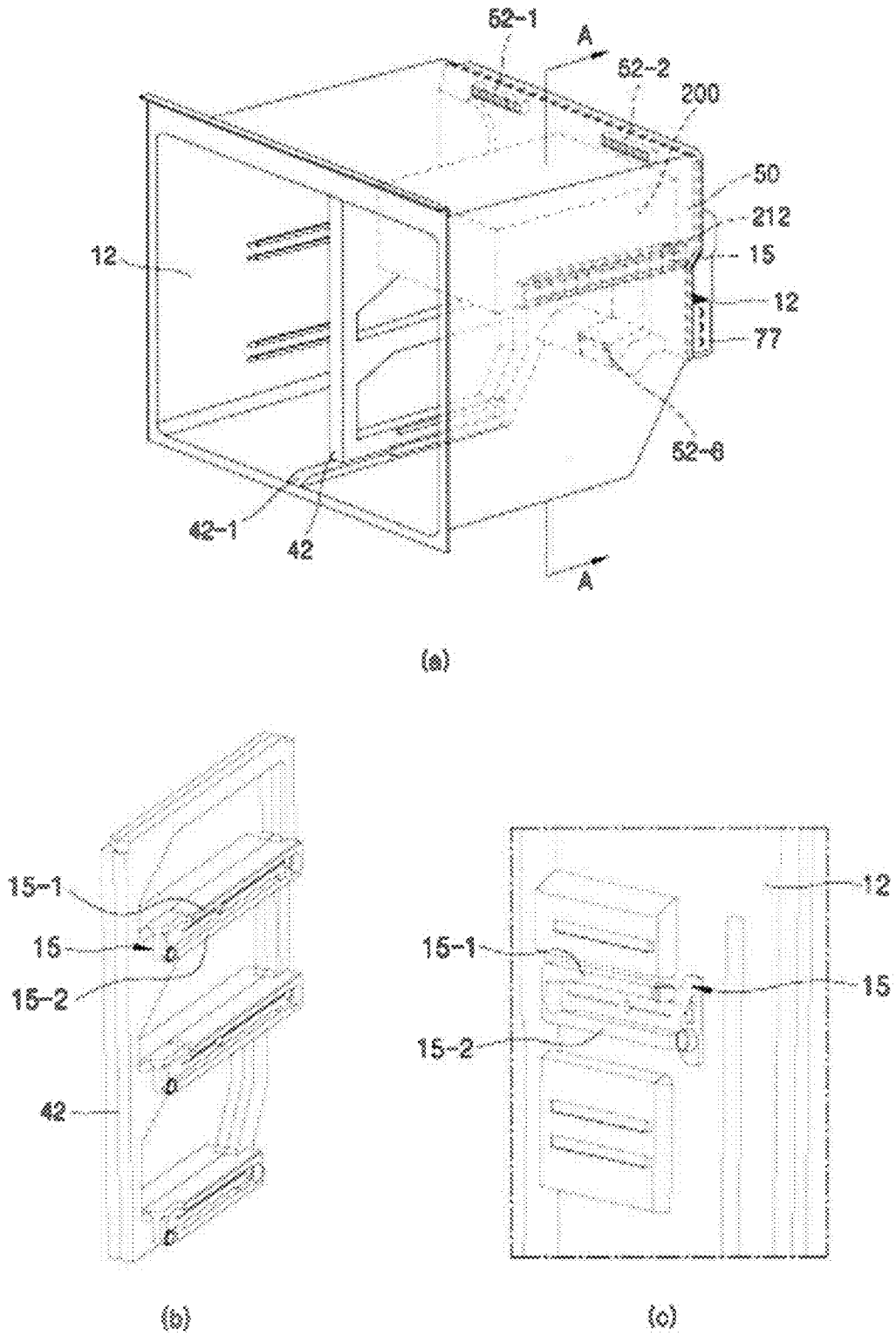
FIG. 2 is a perspective view illustrating a state in which a grille panel assembly and a cryogenic freezing compartment are installed in a freezing compartment-side inner case of a refrigerator body and illustrating a partition wall and a sidewall of the inner case.

FIG. 1 is a perspective of a refrigerator with a door opened according to an embodiment, and FIG. 2 is a perspective view illustrating a state in which a grille panel assembly and a cryogenic freezing compartment are installed in a freezing compartment-side inner case of a refrigerator body and illustrating a partition wall and a sidewall of the inner case.

A refrigerator according to an embodiment includes a refrigerator main body 10 and a refrigerator door 20 disposed on a front portion of the main body 10 to open and close each spaces of the main body 10. The refrigerator according to an embodiment has a bottom freezer type structure in which a refrigerating compartment 30 is disposed at an upper side, and a freezing compartment 40 is disposed at a lower side. The refrigerating compartment and the freezing compartment include side-by-side doors 21 and 22 that rotate with respect to hinges 25 disposed on both ends to open the refrigerating compartment and the freezing compartment. However, the embodiments are not limited to the refrigerator having the bottom freezer type structure. For example, the embodiments may be applied to a refrigerator having the side by side structure in which the refrigerating compartment and the freezing compartment are respectively disposed at left and right sides and a refrigerator having a top mount type structure in which the freezing compartment is disposed above the refrigerating compartment as lone as a cryogenic freezing compartment is capable of being installed in the freezing compartment.

The refrigerator main body 10 includes an outer case 11 defining an outer appearance of the refrigerator and an inner case 12 installed to be spaced a predetermined distance from the outer case 11 and defining an inner appearance of the refrigerator. An insulation material may be foamed and filled into a space between the outer case 11 and the inner case 12 to insulate the refrigerating compartment 30 and the freezing compartment 40 from an indoor space.

A shelf 13 and a drawer 14 are installed in the storage space of each of the refrigerating compartment 30 and the freezing compartment 40 to store foods while improving space utilization efficiency. The shelf 13 and the drawer 14 may be installed in the storage space so as to be guided along rails 15 disposed on left and right sides. A door basket 27 is installed inside the refrigerating compartment door 21 and the freezing compartment door 22 as illustrated in the drawings to store containers such as beverage bottles.

A cryogenic freezing compartment 200 according to an embodiment is provided in the freezing compartment 40. A space of the freezing compartment 40 is horizontally divided to be efficiently used. Here, the space of the freezing compartment 40 is partitioned by a partition wall 42 disposed at a center of the freezing compartment 40 and having a shape that vertically extends. Referring to FIG. 2, the partition wall 42 is installed to be fitted inward from the front portion of the main body and supported within the freezing compartment 40 through an installation guide 42-1 disposed on the bottom of the refrigerator. According to an embodiment, the cryogenic freezing compartment 200 may be disposed at a left upper portion of the freezing compartment 40 as one example. However, the position of the cryogenic freezing compartment 200, which is disposed in the freezing compartment 40, is not limited thereto. That is, the cryogenic freezing compartment 200 may be installed in the refrigerating compartment 30. However, when the cryogenic freezing compartment 200 is disposed in the freezing compartment 40, since a temperature difference between the inside and the outside (a freezing compartment atmosphere) of the cryogenic freezing compartment is more less, it is more advantageous that the cryogenic freezing compartment 200 is installed in the freezing compartment 40 in views of cold air leakage prevention.

A machine room isolated from the freezing compartment is disposed in a rear lower portion of the freezing compartment 40. A compressor 71 and a condenser 73 of a refrigeration cycle cooling device 70 using a refrigerant are disposed in the machine room. A grille panel assembly 50 including a grille panel 51 defining a rear wall of the freezing compartment 40 and a shroud 56 coupled to a rear portion of the grille panel 51 to distribute cold air within a cooling chamber is installed between a space defining the freezing compartment 40 and a rear wall of the inner case 12. Also, an evaporator 77 of the refrigeration cycle cooling device 70 is installed in a predetermined space between the grille panel assembly 50 and the rear wall of the inner case 12. When the refrigerant within the evaporator 77 is evaporated, the refrigerant is heat-exchanged with air flowing through the inner space of the freezing compartment 40. The air cooled by the heat exchange is distributed into a cold air distribution space defined by the grille panel 51 and the shroud 56 to flow through the freezing compartment 40, thereby performing the cooling in the freezing compartment 40.

Figure 3:
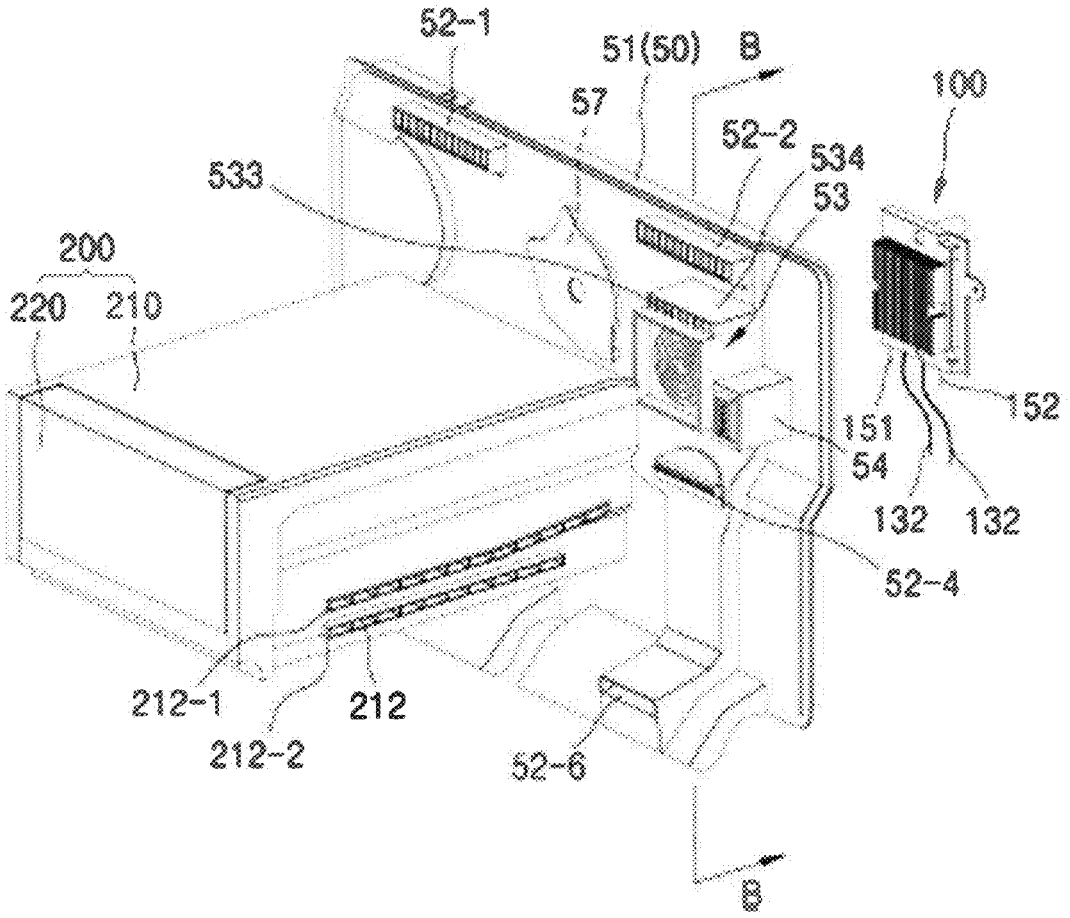
FIG. 3 is a front perspective view illustrating a state in which the grille panel assembly, the cryogenic freezing compartment, and a thermoelectric module assembly are disassembled.
Figure 4:
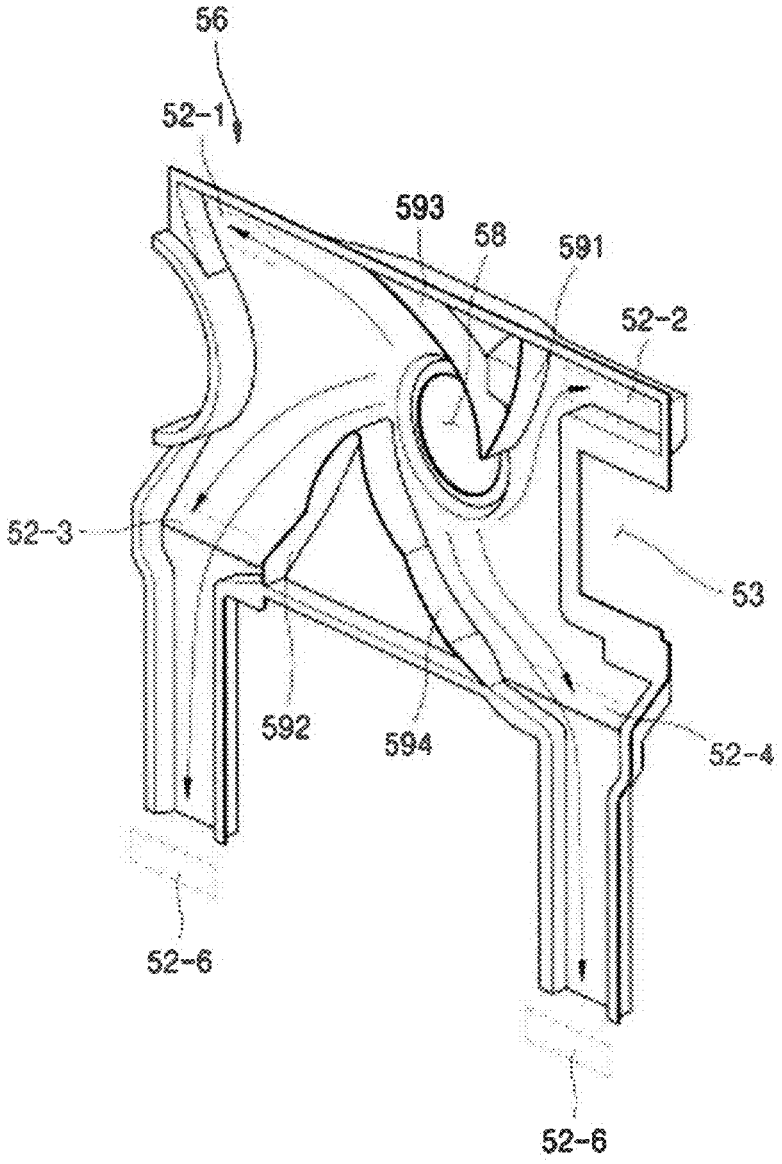
FIG. 4 is a perspective view illustrating a shroud of the grille panel assembly.
Figure 5:
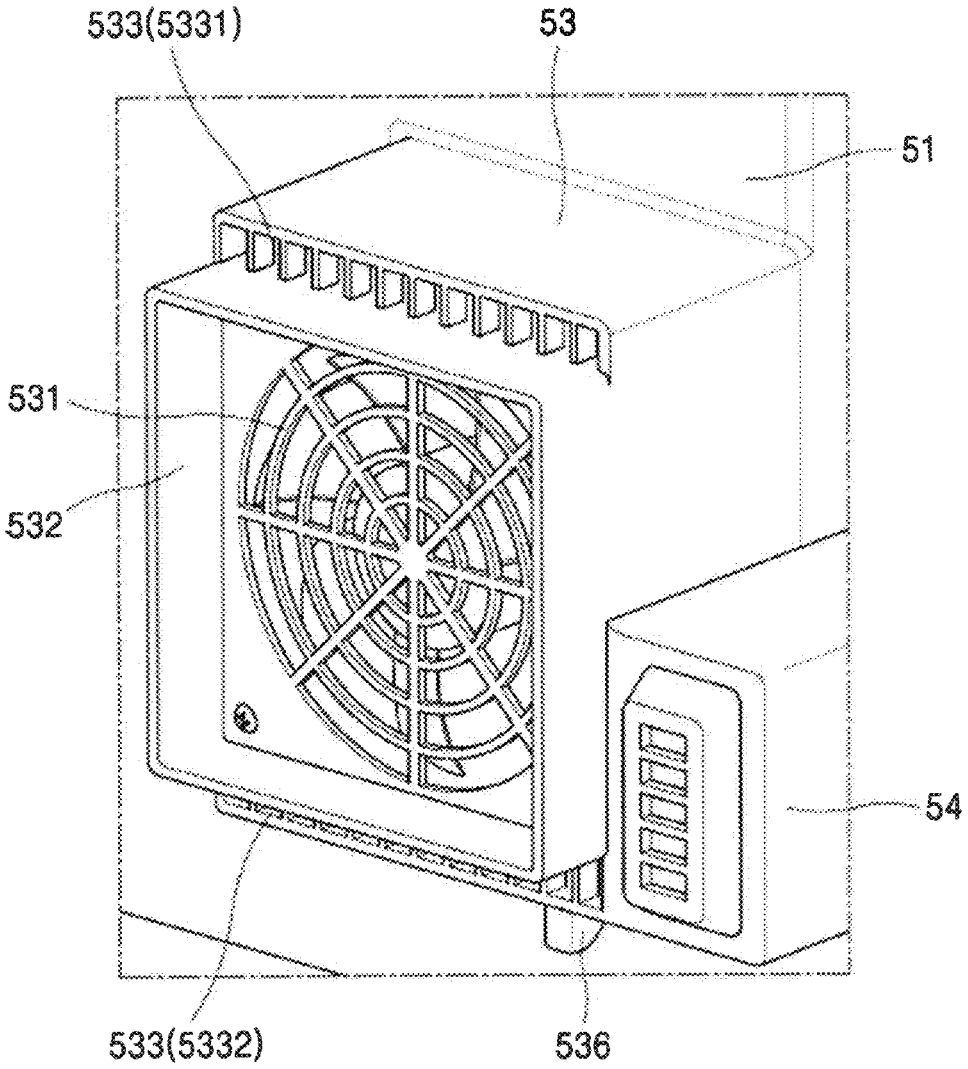
FIG. 5 is an enlarged perspective of a thermoelectric module accommodation part.
Figure 6:
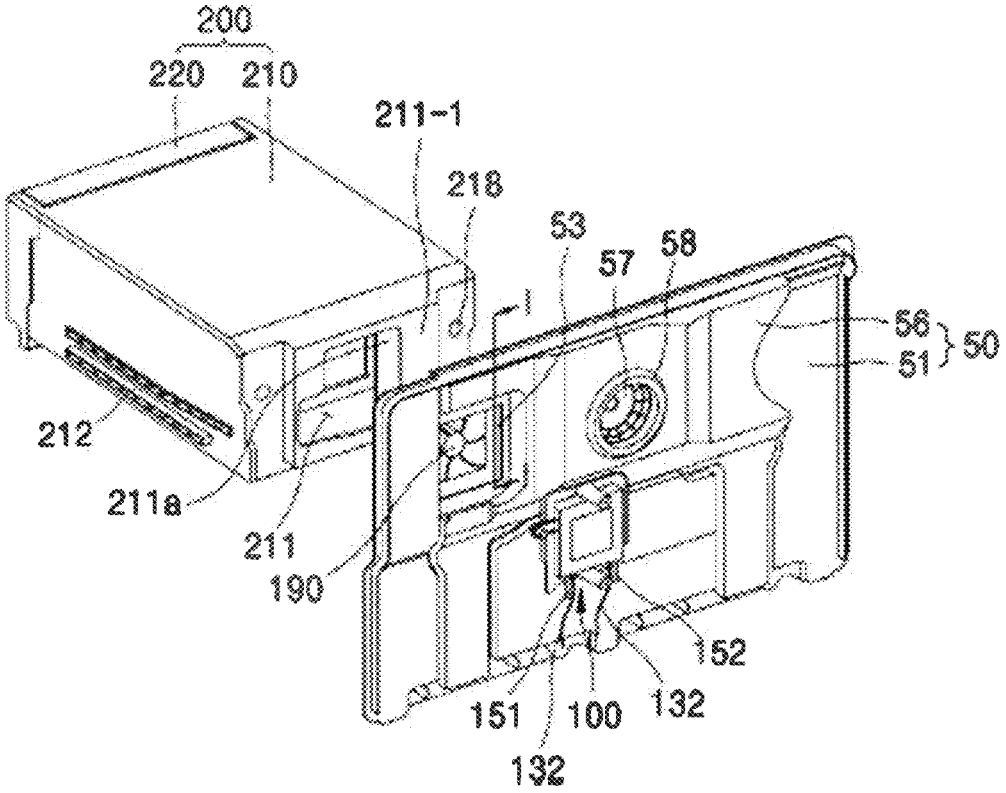
FIG. 6 is a rear perspective view of FIG. 3.
Figure 7:
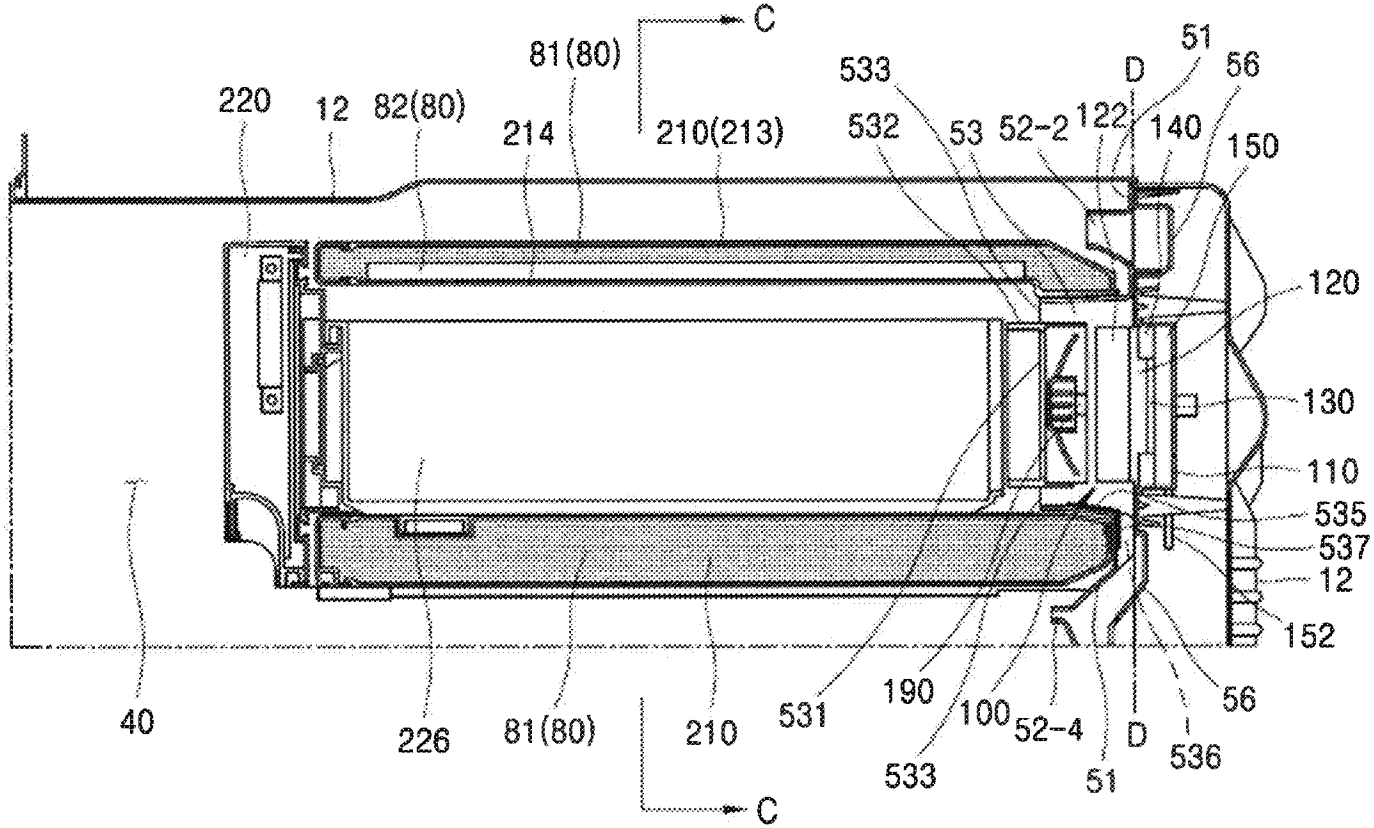
FIG. 7 is a cross-sectional view taken along line A-A of FIG. 2.
Figure 8:
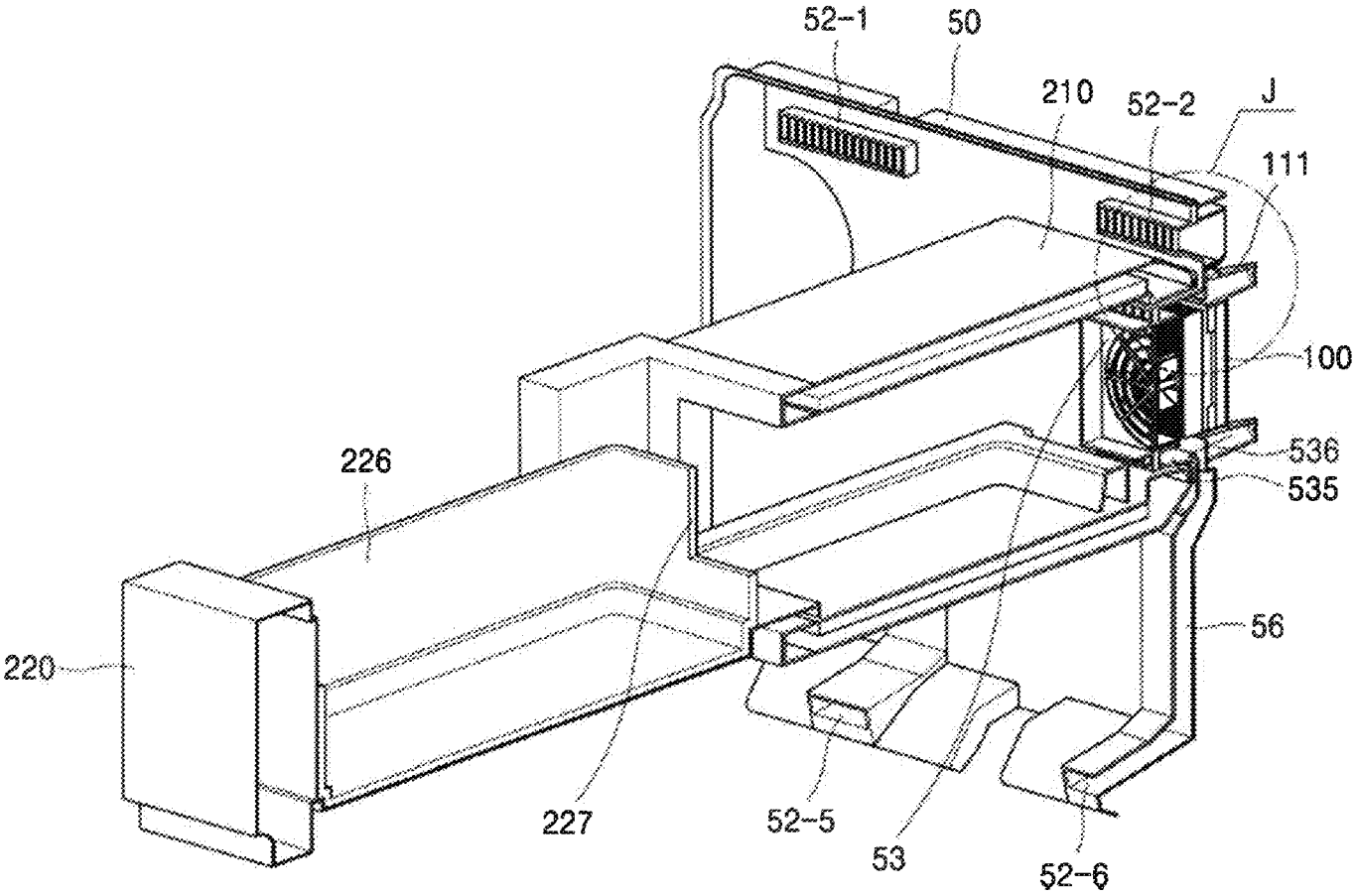
FIG. 8 is a cross-sectional view taken along line B-B of FIG. 3 (a heating wire is omitted).
Figure 9:
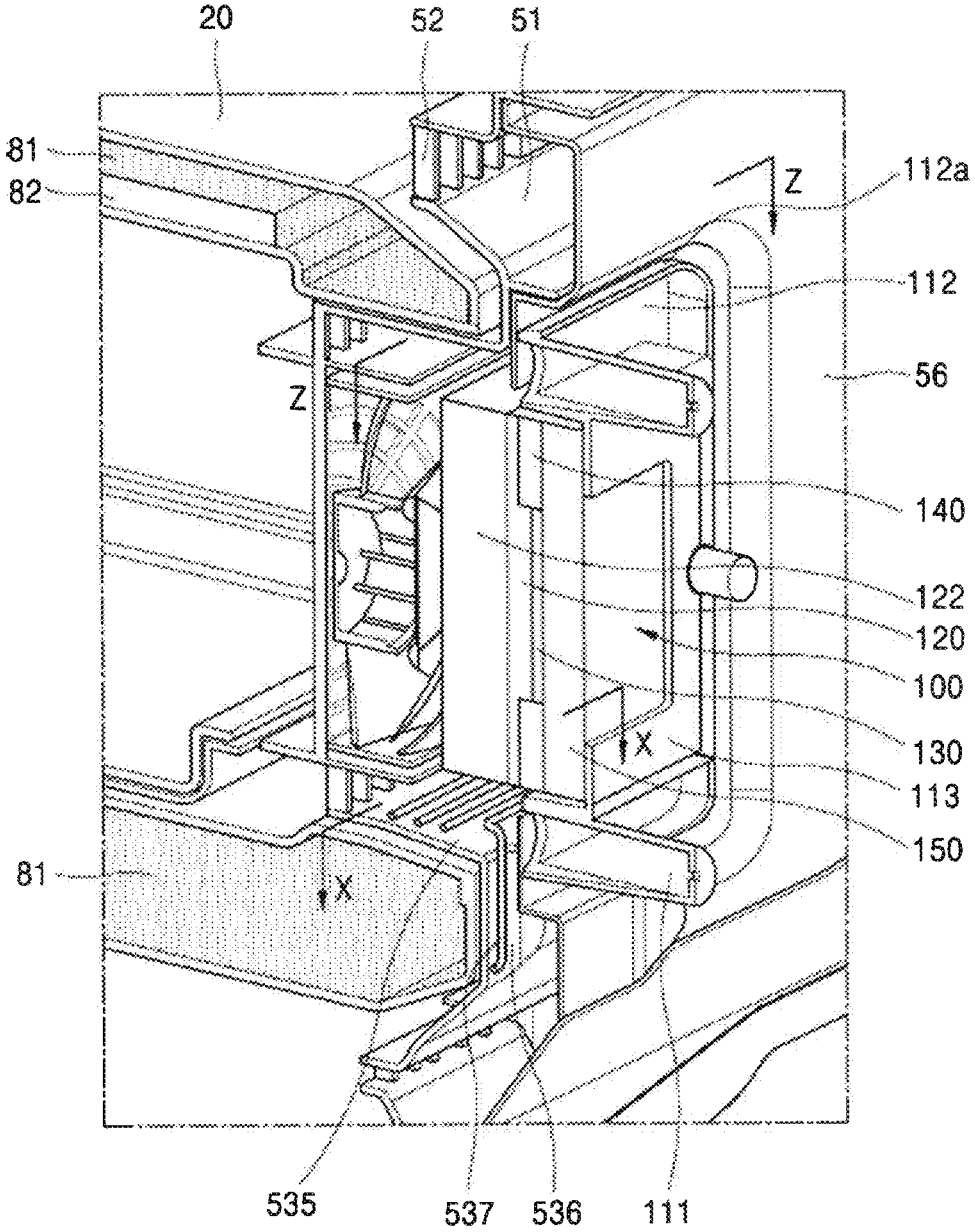
FIG. 9 is a perspective view of a lateral cross-section of the grille panel assembly on which the thermoelectric module assembly is installed when viewed from a rear side.
Figure 10:
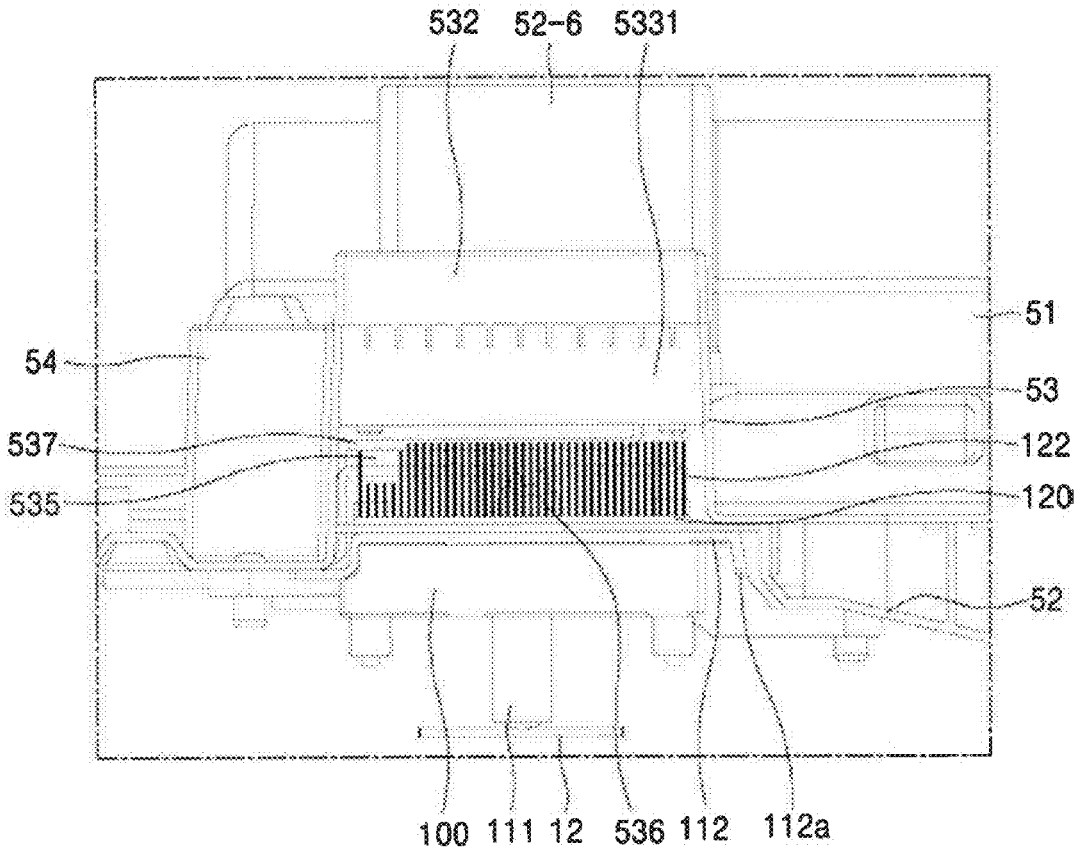
FIG. 10 is a cross-sectional view taken along line Z-Z of FIG. 9.
Figure 11:
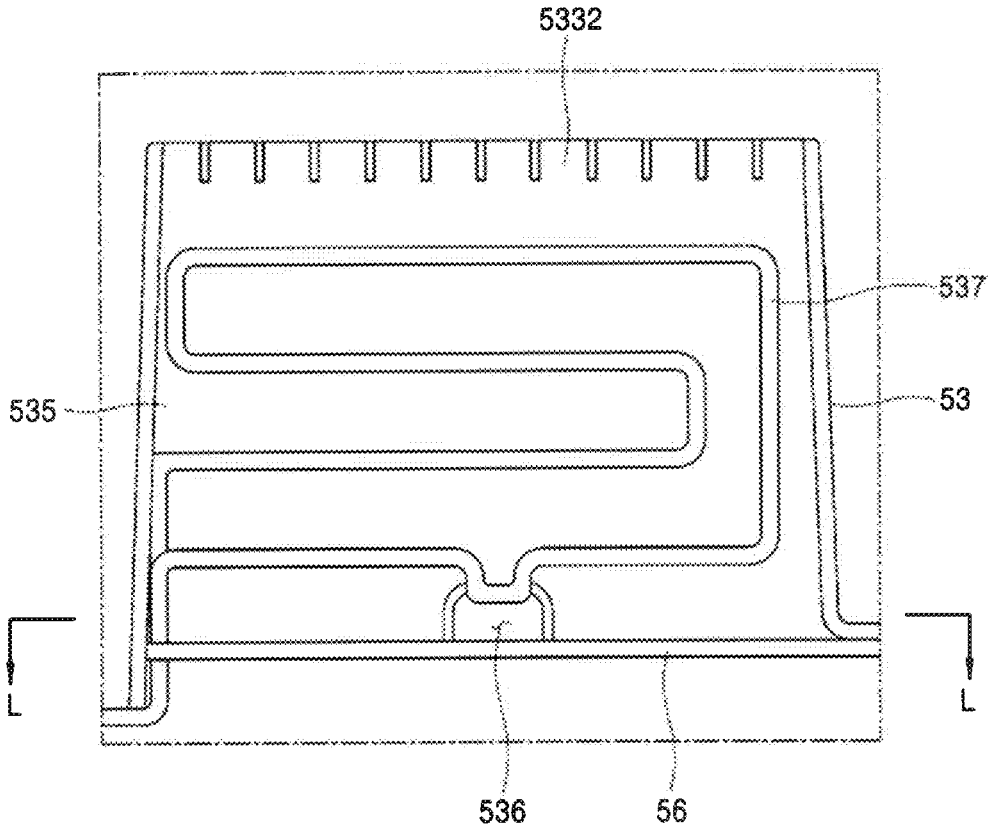
FIG. 11 is a cross-sectional view taken along line X-X of FIG. 9.
Figure 12:
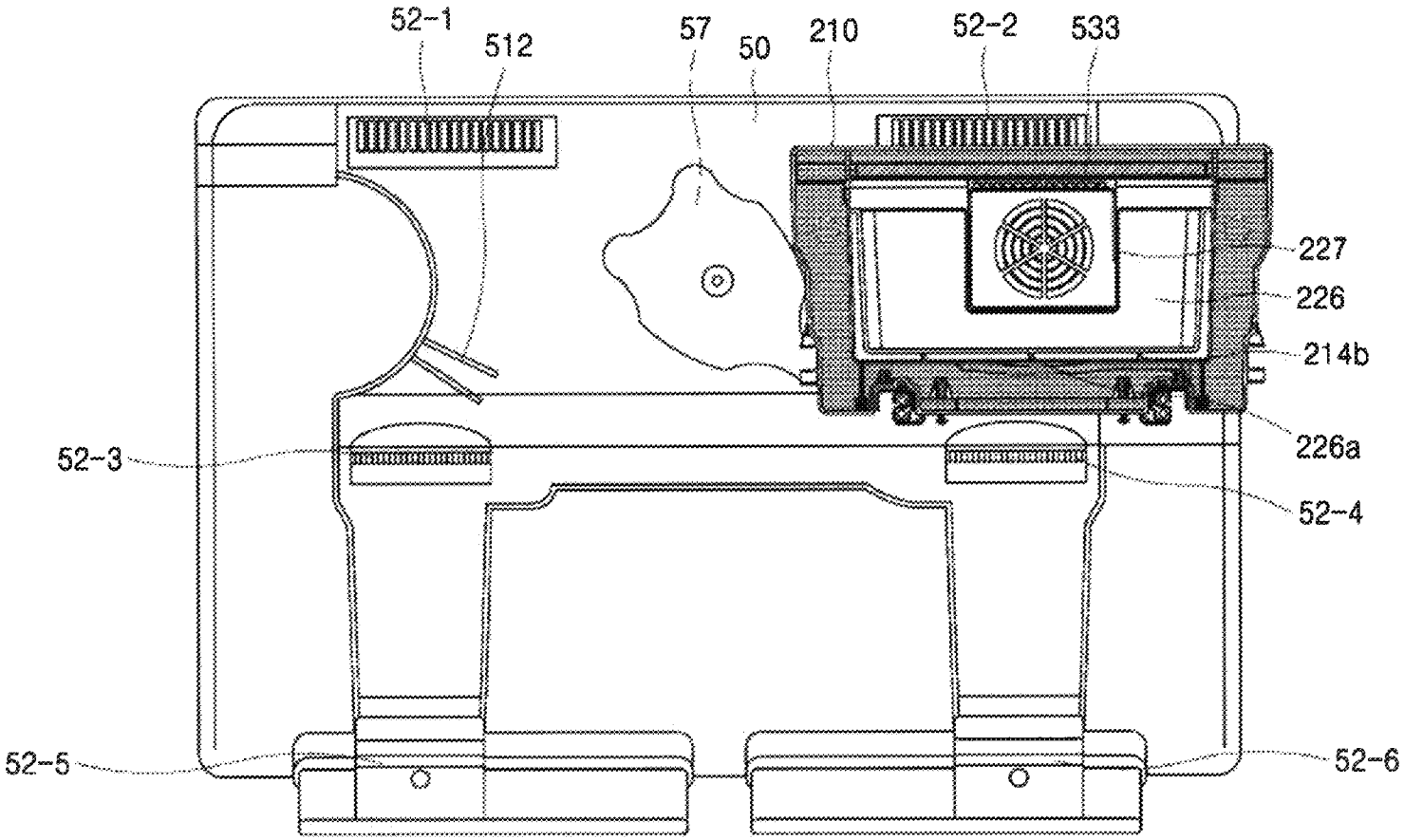
FIG. 12 is a cross-sectional view taken along line C-C of FIG. 7.

FIG. 3 is a front perspective view illustrating a state in which the grille panel assembly, the cryogenic freezing compartment, and the thermoelectric module assembly are disassembled, FIG. 4 is a perspective view illustrating a shroud of the grille panel assembly, FIG. 5 is an enlarged perspective of a thermoelectric module accommodation part, FIG. 6 is a rear perspective view of FIG. 3, FIG. 7 is a cross-sectional view taken along line A-A of FIG. 2, FIG. 8 is a cross-sectional view taken along line B-B of FIG. 3, FIG. 9 is a perspective view of a lateral cross-section of the grille panel assembly on which the thermoelectric module assembly is installed when viewed from a rear side, FIG. 10 is a cross-sectional view taken along line Z-Z of FIG. 9, FIG. 11 is a cross-sectional view taken along line X-X of FIG. 9, and FIG. 12 is a cross-sectional view taken along line C-C of FIG. 7.

First, referring to FIGS. 3, 4, and 6, according to an embodiment, the grille panel assembly 50 to which the cryogenic freezing compartment is applied includes the grille panel 51 defining the rear wall of the freezing compartment 40 and the shroud 56 for distributing the cold air, which is cooled by being heat-exchanged with the evaporator 77 on a rear surface of the grille panel 51, to supply the cold air into the freezing compartment 40.

As illustrated in the drawings, cold air discharge holes 52 provided as passages through which the cold air is discharged forward are defined in the grille panel 51. In this embodiment, the cold air discharge holes 52 are defined in upper end left/right sides 521 and 522, central left/right sides 523 and 524, and lower left/right sides 526 (in FIG. 3, the cold air discharge holes 52 defined in the central left side and the lower left side are covered by the cryogenic freezing compartment).

The shroud 56 is coupled to the rear portion of the grille panel 51 to define a predetermined space together with the grille panel 51. This space is a space in which the air cooled in the evaporator 77 provided in the rear surface of the grille panel assembly 50 or the shroud 56 is distributed. A cold air suction hole 58 communicating with a space defined at a rear side of the shroud 56 and a space between the grille panel 51 and the shroud 56 is defined in an approximately central upper portion of the shroud 56. Also, a fan 57 that suctions the cold air of the rear space of the shroud 56 through the cold air suction hole 58 to distribute and pressing the cold air into the space between the grille panel 51 and the shroud 56 is installed inside the cold air suction hole 58 in the space between the grille panel 51 and the shroud 56.

The cold air pressed by the fan 57 flows through the space between the grille panel 51 and the shroud 56 and then adequately distributed. Then, the cold air is discharged forward through the cold air discharge holes 52 that are opened forward. Referring to FIG. 4, a fan (see FIG. 6) installed at a front side of the cold air suction hole 58 may be, for example, a sirocco fan that rotates in a counterclockwise direction and suction cold air within the cooling chamber through the cold air suction hole 58 to discharge the cold air in a radial direction. Then, the cold air is guided by guide sidewalls 591, 592, 593, and 594, which reduce a flow loss of air and guide a flow direction of the air, and then is distributed to flow into cold air discharge holes 52 that are defined in both upper sides 52-1 and 52-2, both central sides 52-3 and 52-4, and both lower sides 52-5 and 52-6 of the grille panel. A protrusion portion disposed on an upper portion of the cold air discharge hole 52-3 of the grille panel 51 of FIG. 12 may be a water path groove 512 protruding forward in a slim form and be configured to prevent dew condensation formed on an inner wall of the grille panel 51 from flowing downward and overflowing to the outside through the cold air discharge holes 52-3 and 52-5. That is, the water path groove 512 of the grille panel 51 has a groove shape that is recessed in a back surface of the grille panel 51, i.e., a shape that is inclined downward from a left side to a central portion so that water droplets flowing down from an upper side flows downward along the water path groove 512. Thus, the water droplets do not flow to the cold air discharge hole.

The air discharged into the freezing compartment 40 through the cold air discharge holes 52 is uniformly spread in the freezing compartment 40 to flow up to the door basket 27 of the freezing compartment door 22. Thus, the air cooled by the evaporator 77 is uniformly supplied into the freezing compartment 40 to cool the inside of the freezing compartment 40.

Referring to FIGS. 3 and 5 to 12, a thermoelectric module accommodation part 53 in which a thermoelectric module assembly 100 for performing cryogenic cooling of the cryogenic freezing compartment 200 is installed is provided between the cold air discharge hole 52-2 defined in the right upper end and the cold air discharge hole 52-4 defined in the right central portion as the right upper portion of the grille panel 51.

Figure 21:
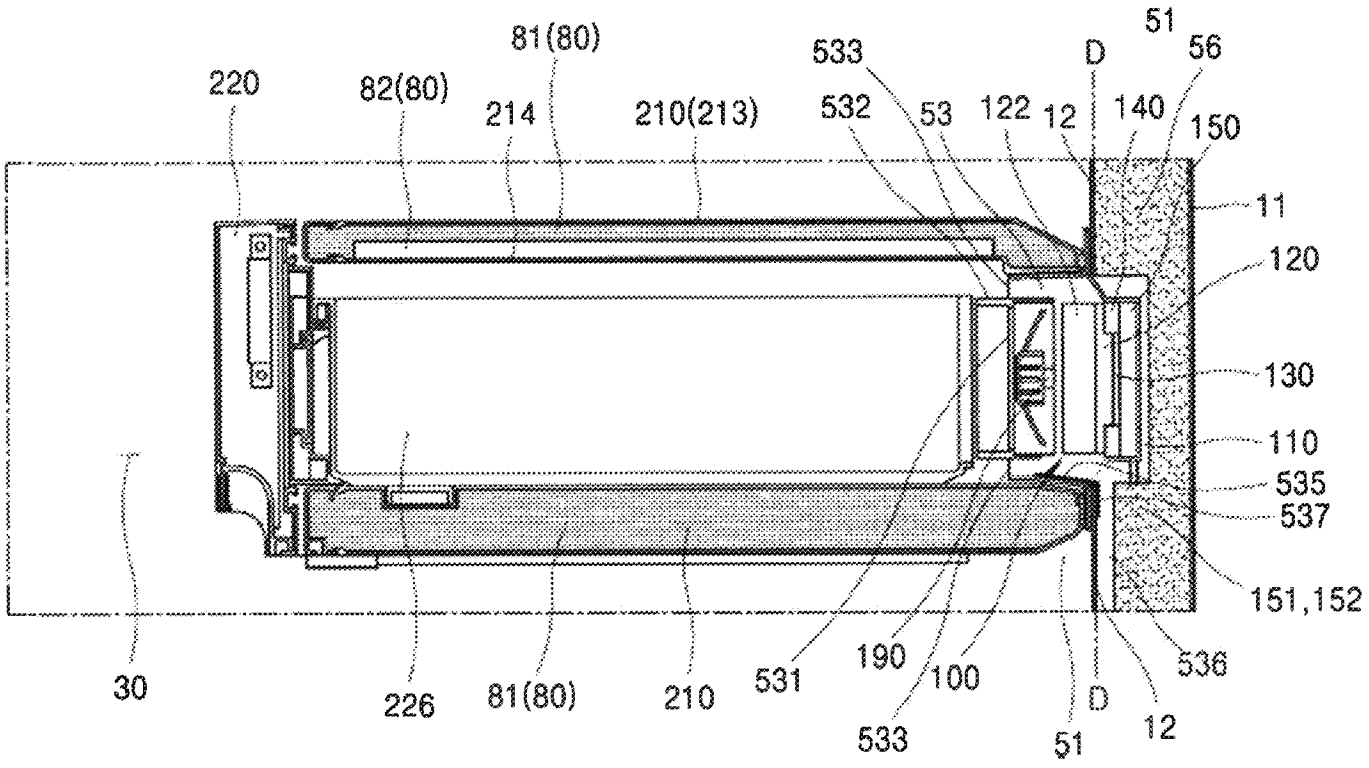
FIG. 21 is a lateral cross-sectional view illustrating an example in which the cryogenic freezing compartment is installed in a freezing compartment according to an embodiment.

First, referring to FIGS. 3 and 5, the thermoelectric module accommodation part 53 is disposed on a front surface of the grille panel 51, which corresponds to a position at which the cryogenic freezing compartment 200 is installed, in the freezing compartment 40. The thermoelectric module accommodation part 53 may be installed in a manner in which the thermoelectric module accommodation part 53 is integrally molded with a wall defining a rear boundary of the freezing compartment 40 that is one of the storage space in which the cooling is performed by the refrigeration cycle cooling device 70, i.e., the grille panel 51 or separately manufactured with respect to the wall and then assembled with the wall. For example, the grille panel 51 may be manufactured through injection molding. Here, the grille panel 51 may be molded together with a portion corresponding to the thermoelectric module accommodation part 53. On the other hand, even when the rear boundary of the storage space may be defined by the inner case 12, and it is difficult to mold the thermoelectric module accommodation part 53 together while the inner case 12 is molded, as illustrated in FIG. 21, the thermoelectric module accommodation part 53 may be separately manufactured and then fixed to and assembled with the wall.

The thermoelectric module accommodation part 53 has an approximately rectangular parallelepiped shape (a rear side thereof is opened to the cooling chamber in which the evaporator is provided) extending to protrude forward from the front surface of the grille panel 51. When viewed from at a front side, this shape may have an approximately rectangular shape that is vertically long. When viewed from the front side, a grill part 531 through which the air cooled by the thermoelectric module assembly 100 is discharged is disposed at a central portion of the rectangular shape, and a suction part 533 that is opened forward is disposed on each of upper and lower portions of the rectangular shape. The suction part 533 may serve as a passage through which air outside the suction part 533 is suctioned into an inner space (that is a space defined at a rear side of the grill part 531 and an inner space of an outer circumferential wall of the rectangular shape defining an outer appearance of the thermoelectric module accommodation part 53) of the thermoelectric module accommodation part 53. The inner space of the thermoelectric module accommodation part 53 may communicate with a space defined at a front side rather than the thermoelectric module accommodation part 53 through the grill part 531 and the suction part 533 and be isolated from a space defined at a front side of the grille panel 51.

A discharge guide 532 having a partition wall shape extending forward between the grill part 531 and the suction part 533 is provided between the grill part 531 and the suction part 533 to prevent the cold air discharged from the grill part 531 from being immediately reintroduced into the suction part 533 that is adjacent thereto. To prevent the air discharged from the grill part 531 from being immediately reintroduced into the suction part 533, the discharge guide 532 may be disposed within only a range in which the grill part 531 and the suction part 533 are adjacent to each other.

However, when it is desired to further enhance an effect of the cold air discharged from the grill part 531 to flow forward, i.e., an effect of improving straightness, the discharge guide 532 may entirely surround the grill part 531 as illustrated in the drawings. Although the discharge guide 532 has a flow cross-section with a square shape as illustrated in the drawings, the discharge guide may have a flow cross-section with a circular shape like a shape of the grill part 531 or a blade of the fan disposed at the rear side of the grill part 531. The flow cross-sectional shape does not necessarily have a rectangular or circular flow cross-section, but may be modified into various shapes as long as it may improve the straightness of the cold air while preventing the cold air discharged from the grill part from being reintroduced into the suction part.

Also, the formed position of the suction part 533 is not limited to the upper and lower positions of the cooling fan 190. That is, the suction part may also be disposed at right and right sides of the cooling fan 190. The installed position thereof may be provided at one or more selected positions of the upper, lower, left, and right sides of the cooling fan 190.

As illustrated in FIGS. 6 to 9, the thermoelectric module accommodation part 53 has an opened rear side. Also, the thermoelectric module assembly 100 is inserted forward from the rear side of the grille panel 51 and is accommodated in the thermoelectric module accommodation part 53.

A sensor installation part, in which a sensor for detecting a temperature and humidity of the cryogenic freezing compartment 200 is installed, continuously installed at a side of the thermoelectric module accommodation part 53 (see FIGS. 3, 5, and 10). A defrost sensor is installed on the sensor installation part 54 to detect a defrosting time of a cold sink that will be described later, thereby determining whether defrosting is required. The sensor installation part 54 may be disposed at a position that may represent a state of the cryogenic freezing space when the space of the cryogenic freezing space is measured.

According to an embodiment, since the suction part 533 is disposed at each of the upper and lower portions of the thermoelectric module accommodation part 53, it is advantageous for more accurate measurement that the sensor installation part 54 is installed to avoid the position. Thus, in this embodiment, the sensor installation part 54 may be installed on one side surface of the thermoelectric module accommodation part 53. Also, a through-hole is defined forward in the sensor installation part 54. Thus, an air atmosphere in the front of the sensor installation part may be transmitted to the inner space of the sensor installation part 54.

Referring to FIGS. 7 to 11, in the state in which the thermoelectric module assembly 100 is accommodated, a small space exists in a lower portion of the thermoelectric module accommodation part 53. This space may be an inner space of the thermoelectric module accommodation part 53, which is provided at a rear side of a suction part 5332 that is disposed at a front side of the space to serve as a flow path of the air introduced into the inner space of the accommodation part through the suction part 5332. That is, the air introduced through the suction part 5332 passes through the small space provided in the lower portion of the thermoelectric module accommodation part 53 to move upward and then is heat-exchanged the cold sink 120.

Referring to FIGS. 9 to 11, a slope 535 for drain, which is provided as a bottom surface of the thermoelectric module accommodation part 53 and has a shape inclined downward from the suction part 5332 to a main body of the grille panel 51 is disposed at the rear side at which the suction part 5332 is disposed. The slope 535 for the drain means a shape in which a bottom surface of the thermoelectric accommodation part 53 is inclined downward. Also, a drain hole 536 is provided in a center of a lower end of the slope 535 for the drain. The cold sink 120 is disposed at a just rear side of the drain hole 536 and the slope 434 for the drain.

According to this structure, as the defrosting of the dew condensation water in the cold sink 120 is performed, water dropping from the cold sink 120 drops onto the slope 535 for the drain. The water dropping onto the slope 535 for the drain flows along the downwardly inclined surface to move to the drain hole 536. Also, finally, the water is discharged to the outside along the drain hole 536.

A position at which the slope 535 of the drain and the drain hole 536 are provided may be a space that communicates with the cryogenic freezing space. Thus, the water dropping from the cold sink 120 and the heat exchange fin 122 to the slope 535 for the drain by the defrosting may be frozen again on the slope 535 for the drain and within the drain hole 536 under the atmosphere of the cryogenic freezing.

In consideration of this point, a heating wire 537 may be installed at the bottom surface and the portion of the drain hole to prevent the defrosting water from being frozen again. When the defrosting of the cold sink 120 disposed within the thermoelectric module accommodation part 53 is performed by the defrost sensor of the sensor installation part, the water dropping from the cold sink 120 to the slope 535 for the drain may flow to the drain hole 536 along the inclined surface of the slope 535 for the drain and then be guided to the drain hole 536 in a state in which the water is not frozen by heat generated from the heating wire 537. Also, since the heating wire is installed to extend up to the inside of the drain hole 536, the defrosting water dropping along the drain hole 536 may flow down without being frozen. The defrosting water dropping from the drain hole 536 is collected into a defrosting water drain tray for the evaporator 77 of the cooing chamber, which is disposed at a rear side of the shroud through a hole defined in the shroud disposed below the drain hole. The phenomenon in which the water is not drained but is frozen again on the slope for the drain and in the drain hole under the atmosphere of the cryogenic freezing may be prevented by the heat of the heating wire 537.

Hereinafter, an installation method of the cryogenic freezing compartment 200 will be described. As illustrated in FIGS. 3 and 6, a guide rail 212 that extends forward and backward is disposed on each of both sides of the cryogenic case 210 of the cryogenic freezing compartment 200. Particularly, the guide rail 212 has a shape in which an upper guide part 212-1 and a lower guide part 212-2, which are a pair of protrusions, disposed to be vertically spaced apart from each other lengthily extend forward and backward to laterally protrude. Thus, a groove having a shape that is recessed forward and backward is defined between the pair of protrusions. That is, the guide rail 212 protrudes with a cross-section that is similar to a "[" shape.

As illustrated in FIG. 2, a rail 15 having a shape corresponding to that of the recessed space of the guide rail 212 and lengthily extending forward and backward to laterally protrude is disposed on each of a side surface of the inner case 12 and a side surface of the partition wall 42 of the freezing compartment 40. The rail 15 may be installed to be coupled to the inner surface of the inner case 12 after being separately injection-molded with respect to the inner case 12 to secure the accuracy in shape and strength. The rail 15 may be used as a support structure when a shelf or a drawer is installed. Also, according to the present invention, the cryogenic freezing compartment may be installed by using the rail 15. The rail 15 may be attached to an inner wall of the side surface and a side surface of the partition wall of the freezing compartment. The rail 15 has a shape in which an upper rail 15-1 and a lower rail 15-2, which is a pair of protrusions, disposed to be spaced apart from each other lengthily extend forward and backward to laterally protrude and has a cross-section that is similar to a "]" shape. Also, rear ends of the upper rail 15-1 and the lower rail 15-2 are connected to each other to restrict an insertion depth of the guide rail 212 of the cryogenic case. The guide rail 212 and the rail 15 may be coupled to each other by placing the lower guide part 212-2 on the lower rail 14-2 and placing the upper guide part 212-1 on the upper rail 15-1. According to the above-described structure, since the guide rail 212 is supported by the rail 15 in vertical two stages, the guide rail 212 may be more firmly fixed.

As described above, when the rails 15 disposed on the side surface of the inner case 12 and the side surface of the partition wall 42 are inserted into the groove spaces of the guide rail 212, which are defined in both sides of the cryogenic case 210 to push the cryogenic case 210 backward and thereby to fix the cryogenic case 210, as illustrated in FIGS. 7 to 12, the inner space of the cryogenic freezing compartment 200 may face the thermoelectric module accommodation part 53 and the sensor installation part 54. Also, an opening hole 211 into which the thermoelectric module accommodation part 53 and the sensor installation part 54 are inserted is provided at a rear side of the cryogenic case 210 of the cryogenic freezing compartment 200, and an inner circumferential surface of the opening hole 211 is fitted into outer circumferential surfaces of the thermoelectric module accommodation part 53 and the sensor installation part 54.

To more facilitate the fitting process, each of an inner circumferential surface 534 of the thermoelectric module accommodation part 53, an outer circumferential surface of the sensor installation part 54, and an inner circumferential surface of the opening hole 211 of the cryogenic case 210 may be manufactured in a shape having a slightly inclined surface that is gradually narrowed forward and gradually expanded backward (see FIGS. 7 to 9). When the inclined surface shape is provided, since a cross-sectional area of a rear end of the opening hole of the cryogenic case is slightly greater than that of a front end of the thermoelectric module accommodation part 53 and the sensor installation part 54, the thermoelectric module accommodation part 53 and the sensor installation part 54 may be smoothly guided to be inserted into the opening hole of the cryogenic case 210 during the initial insertion, and when the insertion is completed, the thermoelectric module accommodation part 53 and the sensor installation part 54 may have the same cross-sectional area as the opening hole 211 of the cryogenic case so as to be firmly fitted.

The thermoelectric module assembly 100 is inserted forward from the rear side of the grille panel assembly 50 and is accommodated into and fixed to the thermoelectric module accommodation part 53. In detail with reference to FIGS. 6 to 10, an outer circumferential surface of the cooling fan 190 having a box fan shape is disposed to face an inner circumferential surface of the thermoelectric module accommodation part 53 at the front side of the thermoelectric module accommodation part 53, and in a state in which the position is restricted, the outer circumferential surface of the cooling fan 190 is fixed to a front surface of the thermoelectric module accommodation part 53 by using a fixing unit such as a screw. Also, the thermoelectric module assembly 100 is inserted forward from the rear side of the grille panel assembly 50 so as to be disposed at the rear side of the cooling fan 190 and then coupled and fixed to the grille panel assembly 50 by using the fixing unit such as the screw.

A portion of the grille panel assembly 50, to which the thermoelectric module assembly 100 is fixed, may be a shape that exists at only a portion of the grille panel 51, a shape that exists in a shape in which the grille panel 51 and the shroud 56 overlap each other, or a shape of which a portion exists as only the grille panel, and the remaining portion has a shape in which the grille panel and the shroud overlap each other. When the thermoelectric module assembly 100 is fixed to the overlapping portion of the grille panel and the shroud by using a fixing unit such as a screw, convenience in assembly that is capable of fixing the thermoelectric module assembly 100 at once when the grille panel and the shroud are fixed to each other may be realized. Furthermore, the grille panel and the shroud may be stacked to fix the thermoelectric module assembly 100 at the more firm position.

A spacer 111 extends backward is disposed on the thermoelectric module assembly 100, and the inner case 12 comes into contact with an end of the spacer 111. That is, the spacer 111 is supported by the inner case 12 and serves as a support for maintaining the position of the thermoelectric module assembly 100, which is spaced forward from the inner case 12. As described above, since the end of the spacer 111 is fixed to the inner case 12, the thermoelectric module assembly 100 may be maintained at the position firmly spaced apart from the inner case 12 to more improve the heat dissipation efficiency of the heat generation part of the thermoelectric module assembly 100.

Although described below, a passage through which the refrigerant passes is provided in the heat sink 150 of the thermoelectric module assembly 100, and an inflow tube 151 and a outflow tube 152 through which the cold air is introduced and discharged are provided in the heat sink 150. While the refrigerator is assembled, the inflow tube 152 and the outflow tube 152 provided in the heat sink 150 of the thermoelectric module assembly 100 have to be welded to refrigerant tubes, through which the refrigerant flows, in the refrigeration cycle cooling device 70 of the refrigerator. Particularly, the inflow tube 151 may be connected to a rear end of the condenser, i.e., a rear side of an expansion device such as a liquid receiver and a capillary tube, and the outflow tube 152 may be connected to a front side of the evaporator.

Figure 13:
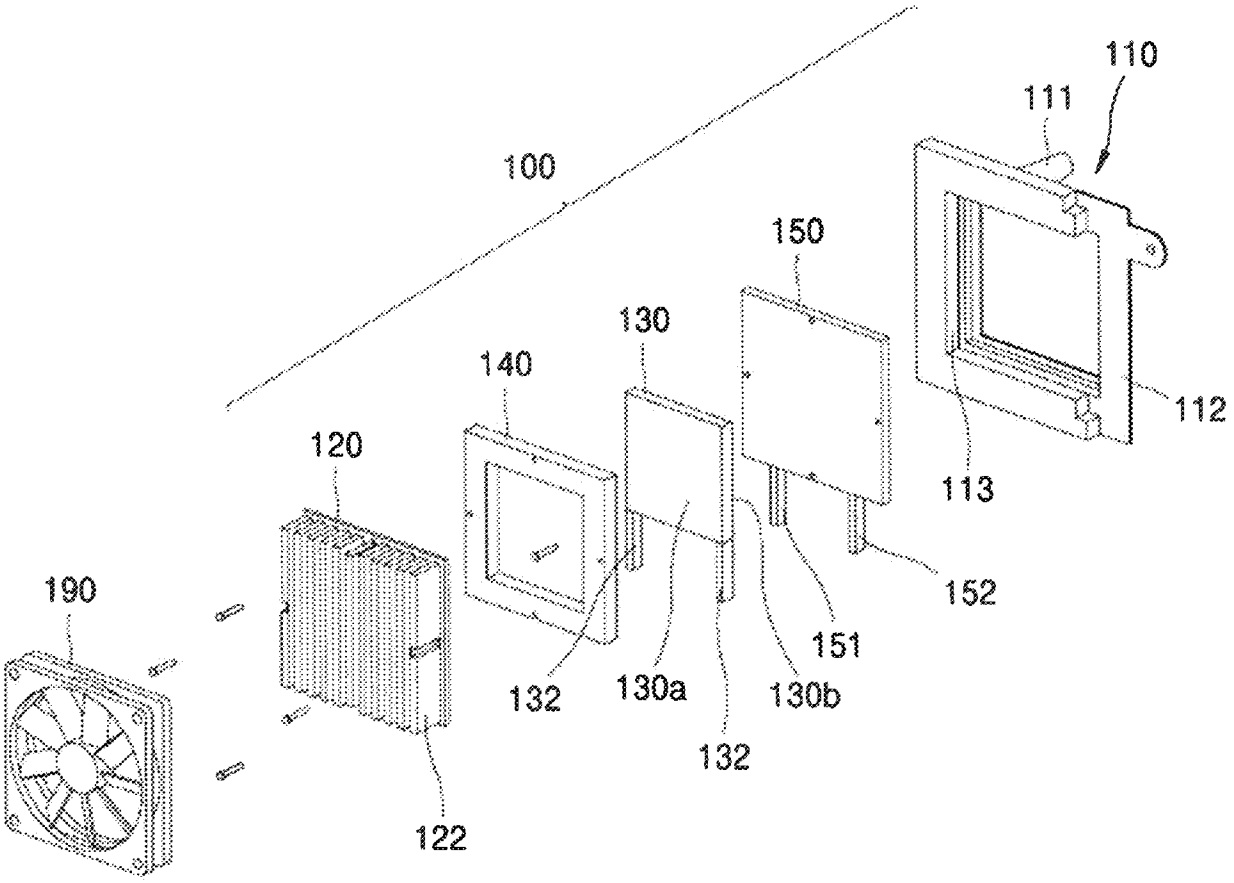
FIG. 13 is an exploded perspective view of the thermoelectric module assembly according to an embodiment.

As described above, the thermoelectric module assembly 100 is fixed to be spaced a predetermined distance from the inner case 12 through a spacer 111 in the form of a module in which components (the cold sink, the thermoelectric module, the heat sink, and a module housing) illustrated in FIG. 13 are assembled. Thus, a worker may more easily perform the welding operation in the space that is secured by the spacer 111, and after the welding of the refrigerant tube is finished, the gill fan assembly 50 is installed at a rear side of the freezing compartment to fix the grille panel assembly 50 to the thermoelectric module assembly 100. The spacer 111 is fixed to the inner case 12 through a screw or is fixed to the inner case 12 in a manner in which a protrusion protruding from the inner case 12 is fitted into a hole defined in a rear portion of the spacer 111.

As described above, a cryogenic case 210 has a box shape of which a front side is opened, in which an opening 211 is defined in a portion of a rear portion of the cryogenic case 210, and which has a box shape having an approximately parallelepiped shape. As a result, the cryogenic case 210 is provided with the guide rail 212 extending in a front and rear direction. Also, the cryogenic case 210 includes an outer case 213 facing the space of the freezing compartment 40 and an inside case 214 disposed inside the outer case 213 and coupled to the outer case 213 to define a predetermined space between the outer case 213 and the inside case 214. The insulation material 80 is disposed in the space between the outer case 213 and the inside case 214 to thermally insulate the inner space of the cryogenic freezing compartment and the freezing compartment 40. A foamed insulation material 81 such as polyurethane may be used as the insulation material. The foamed insulation material is configured to fix the outer case 213 to the inside case 214 in addition to the insulation function. The insulation material may be filled into a space between the outer case 213 and the inside case 214 through the foam injection hole 218 (see FIG. 6) provided at a rear case of the cryogenic case 210, and after the injection is completed, the foam injection hole 218 may be covered by a cover (not shown) and then finished. A vacuum insulated panel 82 having better insulation efficiency may be further applied to the wall of the cryogenic case 210 that has to have a thin thickness.

The opened front side of the cryogenic case 210 is opened and closed by a cryogenic compartment door 220. The cryogenic compartment door 220 has a predetermined space. Also, an insulation material is provided in the space to thermally insulate the inner space of the cryogenic freezing compartment 200 from the space of the freezing compartment 40. The cryogenic compartment door 220 may have a predetermined thickness for user's gripping feeling, and the foamed insulation material may be foamed into a hollow to securer rigidity.

A cryogenic tray 526 accommodated into the inner space of the cryogenic case 210 is fixedly installed at the rear side of the cryogenic compartment door 220. The cryogenic tray 226 may be integrally behaved with the cryogenic compartment door 220. When the cryogenic compartment door 220 is withdrawn forward, the cryogenic tray 226 is slidably withdrawn forward from the cryogenic case 210. The cryogenic compartment door 220 is guided by an external rail disposed on a lower or bottom surface of the cryogenic case 210 to slidably move forward and backward.

An opening groove 227 having an opened shape so that the cold air that is cryogenically cooled in the thermoelectric module assembly 100 is introduced into the cryogenic tray 226 when the cold air flows forward by the cooling fan 190 is provided in a portion of a rear wall of the cryogenic tray 226. As illustrated in FIGS. 8 and 12, the shape of the opening groove 227 may correspond to that of the thermoelectric module accommodation part 53. When the cryogenic freezing compartment 200 is installed in the freezing compartment 40, since the opening groove 227 faces the thermoelectric module accommodation part 53, the cryogenic cold air supplied to the front side by the cooling fan 190 from the thermoelectric module accommodation part may be smoothly introduced into the inner space of the cryogenic tray 226.

Referring to FIG. 7, the cryogenic case 210 has a top surface that is slightly spaced apart from a bottom surface of an upper member of the inner case 12, i.e., a ceiling surface. According to an embodiment, the top surface of the cryogenic case 210 and the bottom surface of the upper member of the inner case 12 may cooperate with each other to realize a duct-like structure. Thus, the air discharged from the cold air discharge hole 522 defined in the upper end of the grille panel 51 may be guided forward along the duct-like structure to smoothly flow. Thus, even though the cryogenic case 210 is installed, the cold air may smoothly reach the door basket 27 installed in the inner upper portion of the freezing compartment door 22.

To realize the above-described duct-like structure, an upper wall of the cryogenic case 210 has to have a thin thickness. That is, when the upper portion of the cryogenic case 210 has a thin thickness, the duct-like structure may be realized while securing an inner volume of the cryogenic case. In this respect, according to an embodiment, the foamed insulation material 81 may be foamed in a remaining space in state in which the vacuum insulated panel 82 is built in the upper member of the cryogenic case 210 so that the upper member of the cryogenic case 210 has the thin thickness. The foamed insulation material may be filled into the inner spaces of the outer case and the inside case, which are not filled by the vacuum insulated panel 82. Thus, coupling force between the outer case and the inner case may be improved in addition to the insulation performance.

Furthermore, since the cold air discharge hole 524 that is disposed in the vicinity of the middle height of the grille panel 51 is disposed in the lower portion of the cryogenic case 210, the discharged cold air may smoothly flow forward.

FIG. 13 is an exploded perspective view of the thermoelectric module assembly according to an embodiment.

The thermoelectric module assembly 100 is an assembly in which the cold sink 120, the thermoelectric module 130, the insulation material 140, and the heat sink 150 are stacked and installed in the module housing 110 to form a module shape.

The thermoelectric module 130 is a device using a Peltier effect. The Peltier effect refers to a phenomenon in which, when a DC voltage is applied to both ends of two different elements, heat is absorbed into one side, and heat is generated from the other side according to a direction of current.

The thermoelectric module has a structure in which an n-type semiconductor material, in which electrons are the main carriers, and a p-type semiconducting material, in which holes are carriers, are alternately connected in series. Here, an electrode portion for allowing current to flow from the p-type semiconductor material to the n-type semiconductor material is disposed on a first surface, and an electrode portion for allowing current to flow from the n-type semiconductor material to the p-type semiconductor material with reference to any one direction in which the current flows. Thus, when the current is supplied in a first direction, the first surface becomes the heat absorption surface, and the second surface becomes the heat generation surface. When the current is supplied in a second direction opposite to the first direction, the first surface becomes the heat generation surface, and the surface becomes a heat absorption surface.

According to an embodiment, the thermoelectric module assembly 100 is inserted and fixed forward from the rear side of the grille panel assembly 50, and the cryogenic freezing compartment 200 is provided at the front side of the thermoelement module assembly 100. Thus, the heat absorption occurs on a surface facing a surface defining a front side of the thermoelectric module, i.e., a surface facing the cryogenic freezing compartment 200, and the heat generation occurs on a surface defining a rear side of the thermoelectric module, i.e., a surface having a backdrop of the cryogenic freezing compartment 200 or in a direction facing the cryogenic freezing compartment 200. Also, when current is supplied in the first direction in which the heat absorption occurs on the surface facing the cryogenic freezing compartment in the thermoelectric module, and the heat generation occurs on the opposite surface, the freezing of the cryogenic freezing compartment may be enabled.

In an embodiment, the thermoelectric module 130 has a flat plate shape having a front surface and a rear surface. Here, the front surface may be a heat absorption surface 130*a*, and the rear surface may be a heat generation surface 130*b*. The DC power supplied to the thermoelectric module 130 generates the Peltier effect. Thus, heat of the heat absorption surface 130*a* of the thermoelectric module 130 moves to the heat generation surface 130*a*. Thus, the front surface of the thermoelectric module 130 becomes a cold surface, and the rear surface becomes a heat generation portion. That is, it may be said that the heat within the cryogenic freezing compartment 200 is discharged to the outside of the cryogenic freezing compartment 200. The power supplied to the thermoelectric module 130 is applied to the thermoelectric module through a leading wire 132 provided in the thermoelectric module 130.

The cold sink 120 may come into contact with and be stacked on the front surface of the thermoelectric module 130, i.e., the heat absorption surface 130*a* facing the cryogenic freezing compartment 200. The cold sink 120 may be made of a metal material or an alloy material such as aluminum having high terminal conductivity. A plurality of heat exchange fins 122, each of which has a shape extending vertically, are disposed to be horizontally spaced apart from each other on the front surface of the cold sink 120. The heat exchange fin 122 may have a shape that lengthily extends in a vertical direction and also continuously extends without being cut. This is for allowing the water that is melted from the cold sink during the defrosting of the cold sink 120 to flow down to smoothly flow along the continuous shape of the heat exchange fin that vertically extends in the direction of the gravity. A distance between the heat exchange fins 122 may be set so that the water formed between the two heat exchange fins 122 that are at least adjacent to each other flows down without interruption of the surface tension.

Air within the cryogenic freezing compartment flows to be heat-exchanged with the cold sink 120 attached to the heat absorption surface of the thermoelectric module. Here, moisture containing the air while cooling foods within the cryogenic freezing compartment may be frozen on the colder surface of the cold sink. To remove the frozen water, power is applied in the above-described supply direction of current, i.e., in the second direction that is opposite to the first direction. Thus, the heat absorption surface and the heat generation surface are exchanged with each other when compared with a case in which the power is applied in the first direction. Accordingly, a surface of the thermoelectric module coming into contact with the heat sink may act as the heat absorption surface, and a surface coming into contact with the cold sink may act as the heat generation surface. Thus, the frozen water that is frozen on the cold sink may be melted to flow in the direction of the gravity to perform the defrosting process. That is, according to an embodiment, when the defrosting is required due to the generation of the dew condensation on the cold sink 102, the current may be applied to the second direction that is opposite to the first direction in which the current is applied to perform the cryogenic cooling operation to perform the defrosting process.

The heat sink 150 may come into contact with and stacked on a rear surface of the thermoelectric module 130, i.e., the heat generation surface 130*b* facing the direction in which the cryogenic freezing compartment 200 is disposed. The heat sink 150 is configured to quickly dissipate or discharge the heat generated from the heat generation surface 130*b* by using the Pelitier effect. A portion corresponding to the evaporator 77 of the refrigeration cycle cooling device 70 used for the cooling of the refrigerator may be constituted by the heat sink 150. That is, when a process in which the low-temperature low-pressure liquid refrigerant passing through the expansion device 75 in the refrigeration cycle absorbs heat or a process in which the refrigerant absorbs heat and then is evaporated occurs in the heat sink 150, the refrigerant absorbs the heat generated from the heat generation surface 130*b* of the thermoelectric module 130, or the refrigerant absorbs the heat and then is evaporated to very immediately cool the heat of the heat generation surface 130*b*.

Since the cold sink 120 and the heat sink 150 are stacked on each other with the thermoelectric module 130 having a flat shape therebetween, it is necessary to isolate heat therebetween. Thus, the insulation material 140 surrounding the thermoelectric module 130 and filled into a gap between the cold sink 120 and the heat sink 150 is stacked on the thermoelectric module assembly 100. That is, the cold sink 120 has an area greater than that of the thermoelectric module 130 and also has substantially the same area as the thermoelectric module 130 and the insulation material 140. Similarly, the heat sink 150 has an area greater than that of the thermoelectric module 130 and also has substantially the same area as the thermoelectric module 130 and the insulation material 140.

It is not necessary that the cold sink 120 has the same size as the heat sink 150. That is, the heat sink 150 may have a size greater than that of the cold sink 120 to effectively discharge heat.

However, according to an embodiment, the refrigerant of the refrigeration cycle cooling device 70 flows through the heat sink so that the heat discharge efficiency of the heat sink 150 is instantly and reliably caused, and the refrigerant flow path is disposed over an entire area of the heat sink so that the refrigerant is evaporated in the heat sink to quickly absorb the heat from the heat generation surface of the thermoelectric module 130 as the heat of vaporization. That is, the heat sink 150 according to an embodiment is designed to have a size enough to immediately absorb and discharge the heat generated by the thermoelectric module 130, and the cold sink 120 has a size less than that of the heat sink 150. However, according to an embodiment, it should be noted that the size of the cold sink 120 increase by considering the fact that the heat sink 130 is heat-exchanged between liquid and solid, whereas the cold sink 120 is heat-exchanged between gas and solid, so that the heat exchange efficiency at the cold sink 120 further increases. As described, in a degree of the enlarged size of the cold sink 120, although the cold sink 120 is designed to have a size corresponding to the heat sink 130 in consideration of compactness of the thermoelectric module assembly 100 according to an embodiment, the cold sink 120 may have a size greater than that of the heat sink 130 to more improve the heat exchange efficiency at the cold sink 120.

The cold sink 120, the thermoelectric module 130, the insulation material 140, and the heat sink 150 are inserted into and fixed to an accommodation groove 113 of the module housing 110 in the state in which the cold sink 120, the thermoelectric module 130, the insulation material 140, and the heat sink 150 are closely attached and stacked by a closely attaching unit such as the screw. Also, a flange 112 having a shape that extends outward is disposed on an edge of the front end of the accommodation groove 113 of the module housing 110. The flange 112 may be a portion at which the thermoelectric module assembly 100 is closely attached and fixed to the grill assembly 50.

Figure 16A:
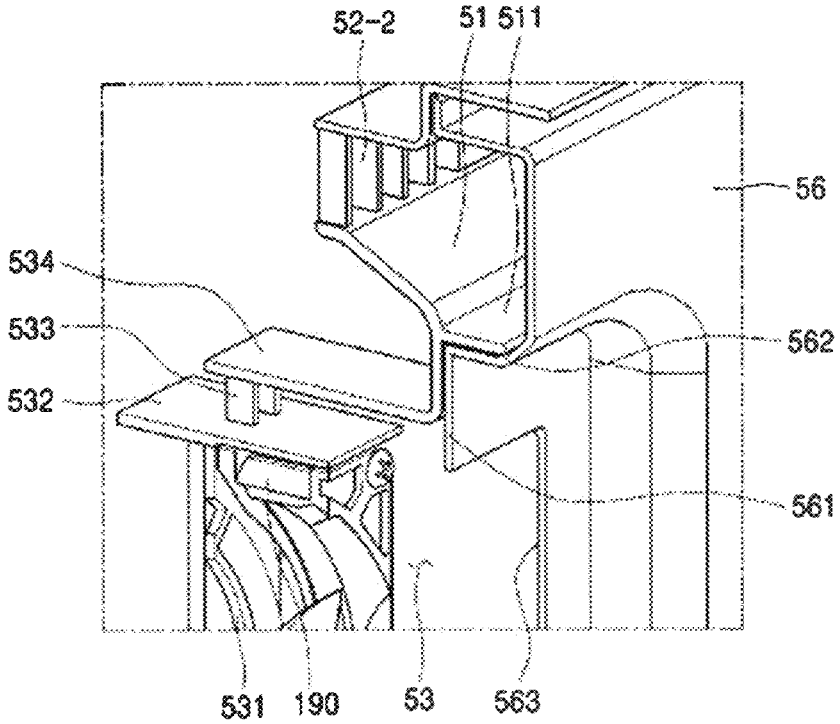
FIGS. 16A and 16B are cross-sectional views taken along line I-I of FIG. 6.
Figure 16B:
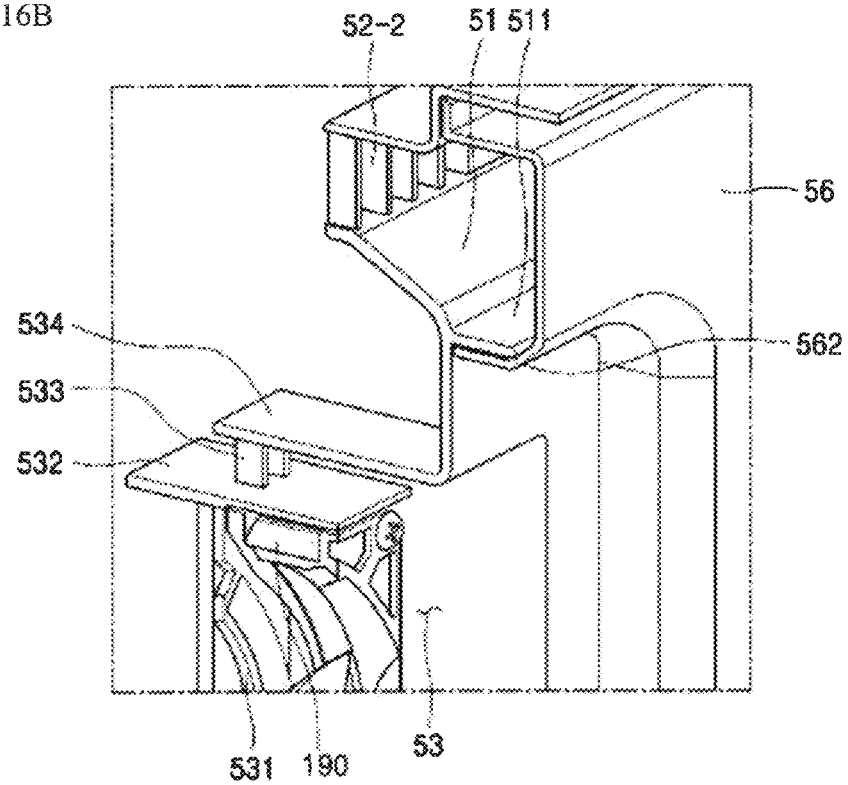

Hereinafter, an installation structure of the thermoelectric module assembly 100 will be described in more detail with reference to FIGS. 16A, 16B, 17A, and 17B. FIGS. 16A and 16B are cross-sectional views taken along line I-I of FIG. 6, and FIGS. 17A and 17B are enlarged perspective views of a portion J of FIG. 8 when viewed from a rear side.

As described above, the grille panel assembly 50 includes the thermoelectric module accommodation part 53 accommodating the thermoelectric module assembly 100. The thermoelectric module accommodation part 53 is provided in a shape that protrudes forward from the grille panel 51, and the thermoelectric module assembly 100 is fitted into the thermoelectric module accommodation part 53 from a rear side of the grille panel assembly.

Referring to FIG. 16A, a portion of the shroud is disposed to overlap a rear side of the thermoelectric module accommodation part 53 of the grille panel 51. More particularly, a butt surface 561 of the shroud comes into contact with and is fixed to the rear surface of the grille panel 51 surrounding the thermoelectric module accommodation part 53. A thermoelectric module insertion hole 563 is disposed around an inner edge of the butt surface 561 of the shroud, and a portion opened by the thermoelectric module insertion hole 563 may serve as a passage communicating with the inner space of the thermoelectric module accommodation part 53 from the rear side of the grille panel assembly 50.

Figure 17A:
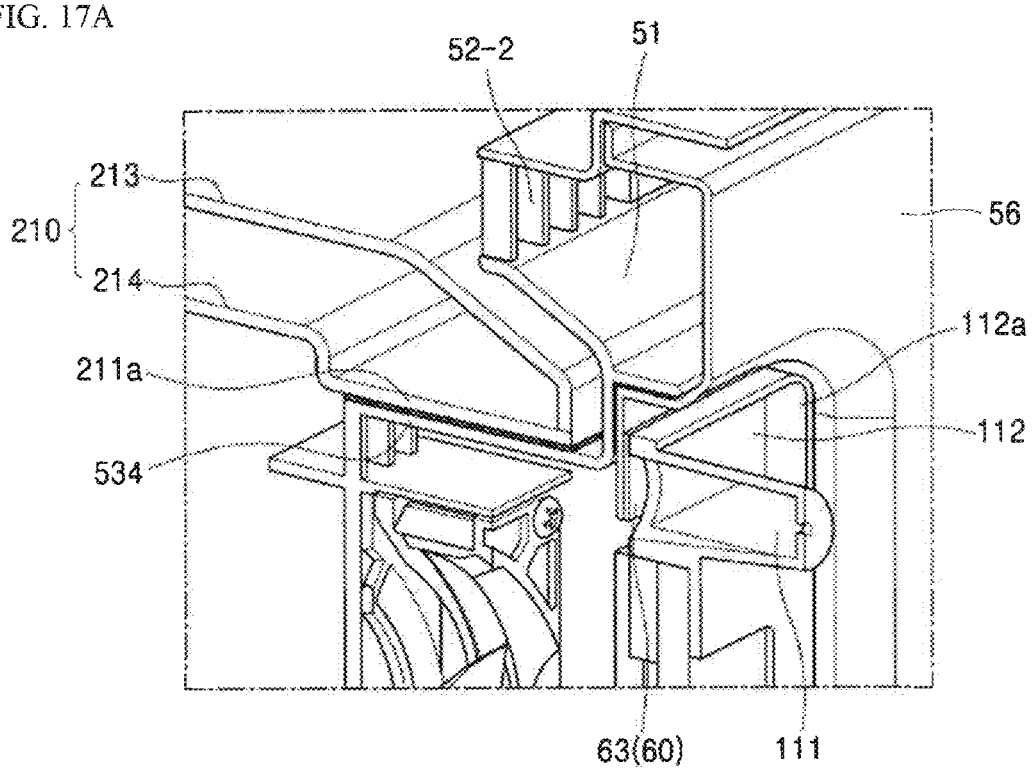
FIGS. 17A and 17B are enlarged perspective vies of a portion J of FIG. 8 when viewed from a rear side.
Figure 17B:
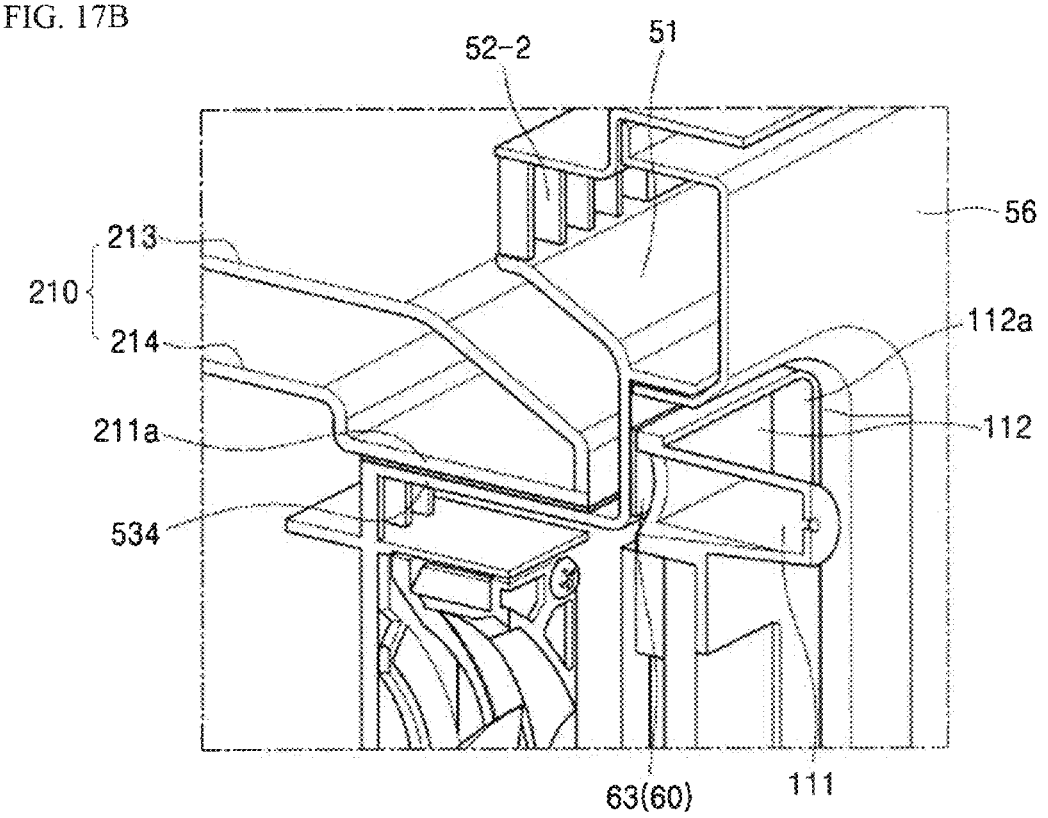

Also, referring to FIG. 17A, the above-described thermoelectric module assembly 100 is fixed to a position at which the rear surface of the grille panel 51 and the butt surface 561 of the shroud 56 overlap each other. Each of the grille panel 51 and the shroud 56 may be provided as an injection object made of a synthetic resin and manufactured in the form of a plate. The plate-shaped synthetic resin is sufficient as a structure for partitioning a space, but has rigidity that is insufficient to fix a specific configuration on the corresponding plate. However, according to the present invention, since the thermoelectric module assembly 100 is fixed to the position at which the rear surface of the grille panel 51 and the butt surface 561 of the shroud overlap each other, the rigidity for fixing and supporting the thermoelectric module assembly 100 may be sufficiently secured.

As a modified example, as illustrated in FIGS. 16B and 17B, the thermoelectric module assembly 100 may come into directly contact with and fixed to the rear surface of the grille panel. In the modified example, a structure in which the flange 112 of the thermoelectric module assembly 100 is directly fixed to the rear surface of the grille panel 51 is illustrated as an example.

Also, a rear rib 511 having a shape that extends backward is disposed on the rear surface of the grille panel 51. The rear rib 511 is disposed around the outside of the rear surface of the grille panel 51 so as to be spaced a small distance from the thermoelectric module accommodation part 53. In more detail, the rear rib 511 is disposed outside of the thermoelectric module accommodation part 53 rather than the position at which the rear surface of the grille panel and the butt surface 561 of the shroud overlap each other or the position at which the thermoelectric module assembly 100 is installed.

Furthermore, a rib butt surface 562 extending backward to come into contact with the inner surface of the rear rib 511 is disposed on an outer circumferential surface of the butt surface 561 of the shroud. That is, each of the butt surface 561 and the rib butt surface 562 has a bent shape and have a stepped portion. Thus, the shroud butt surface 561 and the rib butt surface 562 abut in a "L" shape with the rear surface of the grille panel 51 and the rear rib 511.

The rear rib 511 and the rib butt surface 562 may secure the rigidity due to the characteristics of the stepped shape, and also, more facilitate the assembly of the thermoelectric module assembly 100 fixed to the rear surface of the shroud butt surface 561. That is, if the outer edge of the flange 112 disposed in the module housing 110 of the thermoelectric module assembly 100 is manufactured to match a shape having a certain degree, i.e., a certain tolerance with respect to the inside of the rib but surface 562, when the thermoelectric module assembly 100 is fixed to the grille panel assembly 50, the outer circumferential surface of the flange 112 of the thermoelectric module assembly 100 is loosely fitted into the stepped part by the rib butt surface 562 to accurately regulate the position of the thermoelectric module assembly 100 and thereby to simply fix the thermoelectric module assembly 100 to the grille panel assembly 50. Also, as illustrated in FIGS. 10 and 17A or 17B, when the bent surface 112*a* having a shape that extends backward from the outer edge of the flange 112 is provided, the bent surface 112*a* may come into contact with the inner circumferential surface of the rib butt surface 562 to more firmly regulate the position, thereby reinforcing the rigidity of the flange 112.

Also, the above-described spacer 111 lengthily extends from the flange 112 to come into contact with the inner case 12 of the refrigerator body 10 and then is fixed to the inner case 12 by using a fixing unit such as a screw or in a groove-boss press-fit manner. Thus, the module housing 110 may firmly fix the thermoelectric module assembly 100 to both the grille panel assembly 50 and the inner case 12. Since the spacer 111 of the module housing 110 fixes the thermoelectric module assembly 100 in the state of being spaced apart from the inner case 12, the heat dissipation efficiency of the heat sink may be improved, and a sufficient working space for welding the inflow tube and the outflow tube of the refrigerant passing through the thermoelectric module to the refrigeration cycle cooling device 70 may be secured as described above.

The cooling fan 190 disposed at the frontmost portion of the thermoelectric module assembly 100 may be coupled and fixed to the portion of the thermoelectric module accommodation part 53 of the grille panel 51 as described in an embodiment illustrated in the drawings and thus be provided as a separate part with respect to the thermoelectric module assembly 100 or be integrated with the thermoelectric module assembly 100 in the shape that is spaced a predetermined distance from the cold sink 120 by using the coupling unit such as the screw and thus be provided as one part of the thermoelectric module assembly 100. When the cooling fan 190 rotates, the cooling fan 190 may press air forward, i.e., toward the cryogenic freezing compartment 200 to allow the air to flow. Thus, air existing in a rear side of the cooling fan 190 is discharged forward by the cooling fan 190, and thus, the air existing in the cryogenic freezing compartment 200 is filled again into the rear side of the cooling fan 190. The air filled again into the thermoelectric module accommodation part 53 is cooled by being heat-exchanged with the cold sink 120.

According to the refrigerator including the cryogenic freezing compartment according to an embodiment, the thermoelectric module 130 of the thermoelectric module assembly 100 and the heat sink 150 are disposed at a rear side rather than the surface defined by the grille panel 51 defining the rear wall of the freezing compartment 40 to fundamentally block introduction of heat generated in the thermoelectric module 130 into the freezing compartment 40.

Referring to FIGS. 7, 10, 16A, 16B, 17A, and 17B, a space of the freezing compartment 40 is defined as a front space of the grille panel 51, and the cryogenic freezing compartment 200 is defined as an inner space that is partitioned by the grille panel 51, the cryogenic case 210, and the cryogenic compartment door 220. The thermoelectric module assembly 100 according to an embodiment is disposed at the rear side of the cryogenic case 210, and particularly, the insulation material 140 and a portion of the heat sink 150, which is disposed at the rear side of the insulation material 140, in addition to the thermoelectric module 130 of the thermoelectric module assembly 100 are disposed at the rear side rather than the rear cross-section (taken along line D-D of FIGS. 7 and 10) of the freezing compartment 40, which is defined by the grille panel 51. That is, the portion of the heat sink 150, which is disposed at the rear side, in addition to the thermoelectric module 130 may be disposed between the rear side of the grille panel 51 and the inner case 12, and more particularly, be disposed in a heat-exchange space (a cooling chamber that is a space separately partitioned from the freezing compartment) in which the evaporator 77*a* is provided.

According to the disposed position of the thermoelectric module assembly 100, heat generated from the heat generation surface 130*b* and the heat sink 150 is fundamentally blocked from affecting a temperature of the freezing compartment 40 to prevent a heat loss of the inner space of the freezing compartment 40 from occurring by the thermoelectric module 130. That is, according to an embodiment, the thermoelectric module assembly 100 is installed at a rear side of the grille panel 51 that is a wall for partitioning the freezing compartment from the cooling chamber and thus installed in the space separated from the cryogenic freezing compartment installed at the rear side of the freezing compartment to prevent the heat loss of the freezing compartment from occurring while smoothly performing the cryogenic freezing.

The accommodation groove 113 of the module housing 110 extends backward with respect to the flange 112. The flange 112 is fixed to the grille panel 51 defining the rear surface of the freezing compartment with the shroud 56 therebetween. However, as described above, the thermoelectric module and the heat sink of the thermoelectric module assembly may be disposed in a space that is separated from the freezing compartment.

In an embodiment, the accommodation groove 113 extends backward with respect to the flange 112. Here, the heat sink, the thermoelectric module, and the cold sink are successively accommodated so that the heat sink and the thermoelectric module are disposed at a rear side rather than the space defined as the freezing compartment.

When compared with the arrangement of the thermoelectric module and the heat sink, the cryogenic freezing compartment 200 is disposed in the freezing compartment. Also, the cold sink 120 of the thermoelectric module assembly 100 may also be disposed at a front side rather than the rear cross-section (taken along line D-D; see FIGS. 7 and 10) of the freezing compartment 40. The cold sink may be cooler than the freezing compartment. Thus, the cold sink 120 may be disposed at the front side rather than the rear cross-section of the freezing compartment. Rather, the cold sink 120 may be preferably disposed at a position that is the closest to the cryogenic freezing compartment 200 in aspect of cooling of the cryogenic freezing compartment.

That is, according to the present invention, the cryogenic freezing compartment 200 and the cold sink 120 may be disposed at the front side rather than the freezing compartment defined by the grille panel, i.e., disposed at a side of the freezing compartment, and the thermoelectric module 130 and the heat sink 150 may be disposed at the rear side rather than the rear cross-section of the freezing compartment, i.e., disposed at a side of the cooling chamber.

Figure 14:
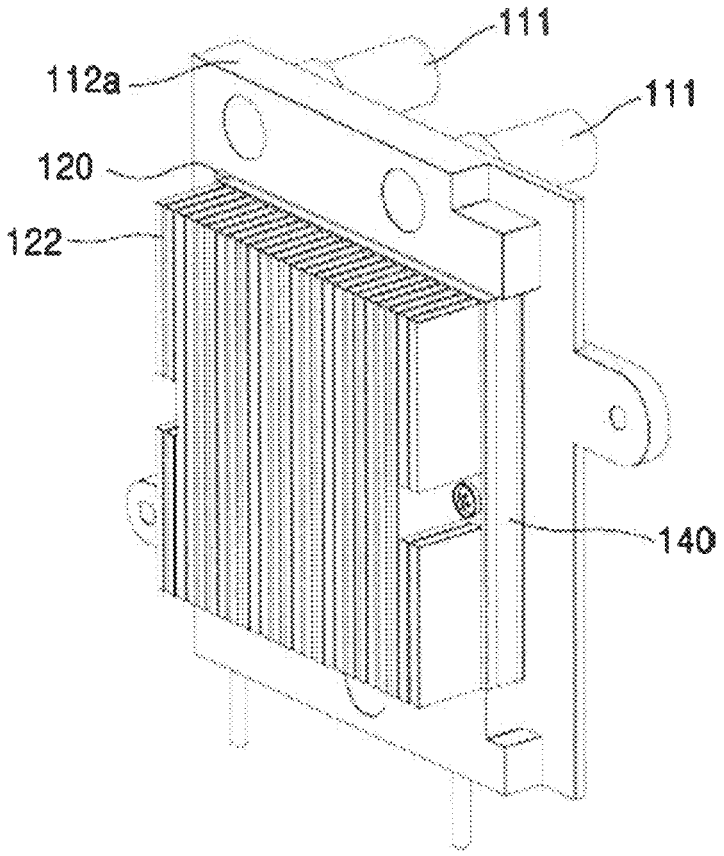
FIG. 14 is a front perspective view illustrating a modified example of the thermoelectric module assembly according to an embodiment.
Figure 15:
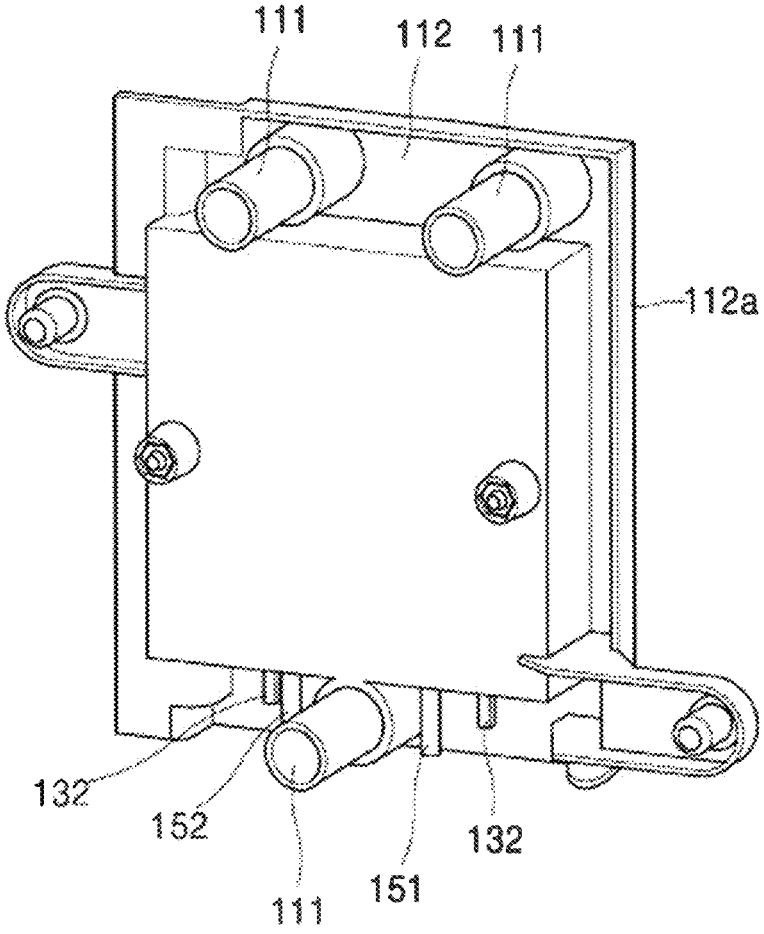
FIG. 15 is a rear perspective view illustrating a modified example of FIG. 14.

FIG. 14 is a front perspective view illustrating a modified example of the thermoelectric module assembly according to an embodiment, and FIG. 15 is a rear perspective view of the modified example of FIG. 14.

In the modified example of FIGS. 14 and 15, the thermoelectric module assembly is different from the thermoelectric module assembly of FIG. 13 in that two spacers 111 are provided at an upper side. That is, according to the modified example, three spacers that are not disposed in a straight line may be provided to more secure fixing of the spacers to the inner case 12 when compared to the thermoelectric module assembly including the two spacers that are vertically disposed.

Also, according to the modified example, a hole or a groove is provided in a rear side of the spacer, and a projection fitted into the hole or the groove is disposed on the inner case 12. Thus, the spacer 111 may be fixed to the inner case 12 in the groove-boss press-fit manner. This may be a more simple manner than the manner in which the spacer and the inner case are screw-coupled to each other through a screw hole of the spacer 111.

The cryogenic freezing compartment 200 may be installed in the refrigerating compartment 30. Referring to FIG. 21, a wall defining a rear boundary of the storage space of the refrigerating compartment 30 may be an inner case 12. Also, although not shown, a multi duct for uniformly distributing cold air into the refrigerating compartment may constitute at least a portion of the wall defining the rear boundary of the storage space of the refrigerating compartment.

A foamed insulation material may be filled into a space between the inner case 12 and the outer case 11. When the foamed insulation material is foamed, a space for disposing the thermoelectric module assembly 100 may be secured. Also, when the foamed insulation material is foamed, a drain hole 536 through which defrosting water is drained may be provided, and also, the foamed insulation material may be filled in a state in which the refrigerant tube connected to the heat sink 150 of the thermoelectric module assembly 100 is embedded. The embedded refrigerant tube may be connected to the refrigerant tubes 151 and 152 of the heat sink 150 through welding while the thermoelectric module assembly 100 is installed.

While the thermoelectric module assembly 100 is disposed in place, the flange 112 of the module housing 110 may be fixed to the front surface of the inner case 12. Also, the thermoelectric module accommodation part 53 that is manufactured as a separate part may be fixed to the front surface of the inner case 12. Here, the thermoelectric module accommodation part 53 and the flange 112 of the module housing 110 may overlap each other and be fixed to the inner case 12 as illustrated in the drawings. Although not shown, the thermoelectric module accommodation part 53 and the flange 112 may be fixed to the inner case 12 without overlapping each other. The thermoelectric module accommodation part 53 may be fixed to the inner case 12 and then integrated with the inner case 12.

A rear surface 211-1 (see FIG. 6) of the cryogenic case 210 of the cryogenic freezing compartment 200 may be closely attached to the inner case 12 that is the wall defining the rear surface of the storage space. The closely attached state to the front side of the inner case may include a case in which the rear surface of the cryogenic case comes into direct contact with the front surface of the inner case and a case in which the rear surface of the cryogenic case comes into contact with the surface of the thermoelectric module accommodation part 53 installed on the front surface of the inner case and thus comes into contact with the inner space.

Also, an inner circumferential surface 211*a* of an opening hole 211 provided in a rear side of the cryogenic case 210 may be closely attached to an outer circumferential surface 534 of the thermoelectric module accommodation part 53.

According to the above-described structure, the thermoelectric module 130 and the heat sink 150 of the thermoelectric module assembly 100 are disposed at the rear side rather than the wall (the inner case 12) defining the rear boundary (D-D) of the storage space (the refrigerating compartment 30) that is cooled by the refrigeration cycle cooling device to minimize the effect that have an influence on the refrigerating compartment 30 by the heat generated from the thermoelectric module assembly 100. In addition, the heat exchange fin 122 of the cold sink 120 may be disposed at the front side rather than the rear boundary (D-D) to maintain the high cooling efficiency of the cryogenic freezing compartment 200.

Figure 18:
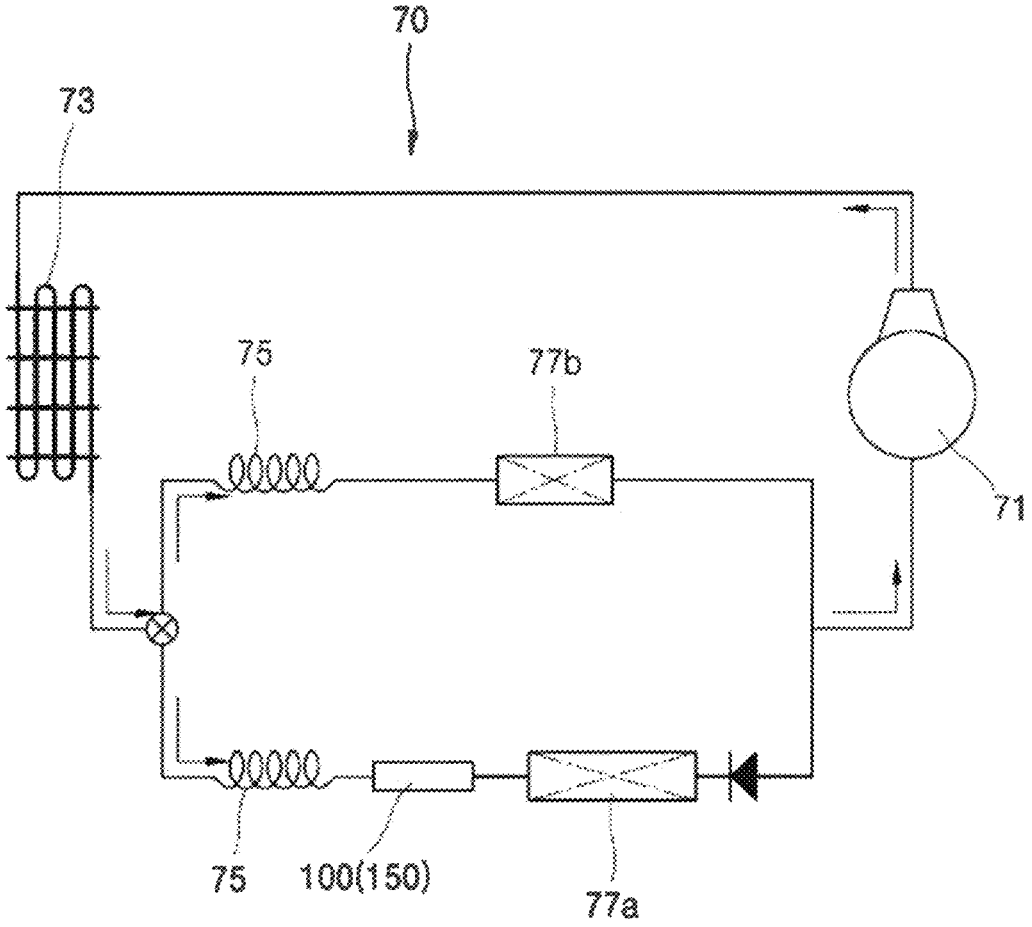
FIG. 18 is a view of a refrigeration cycle applied to the refrigerator according to an embodiment.
Figure 19:
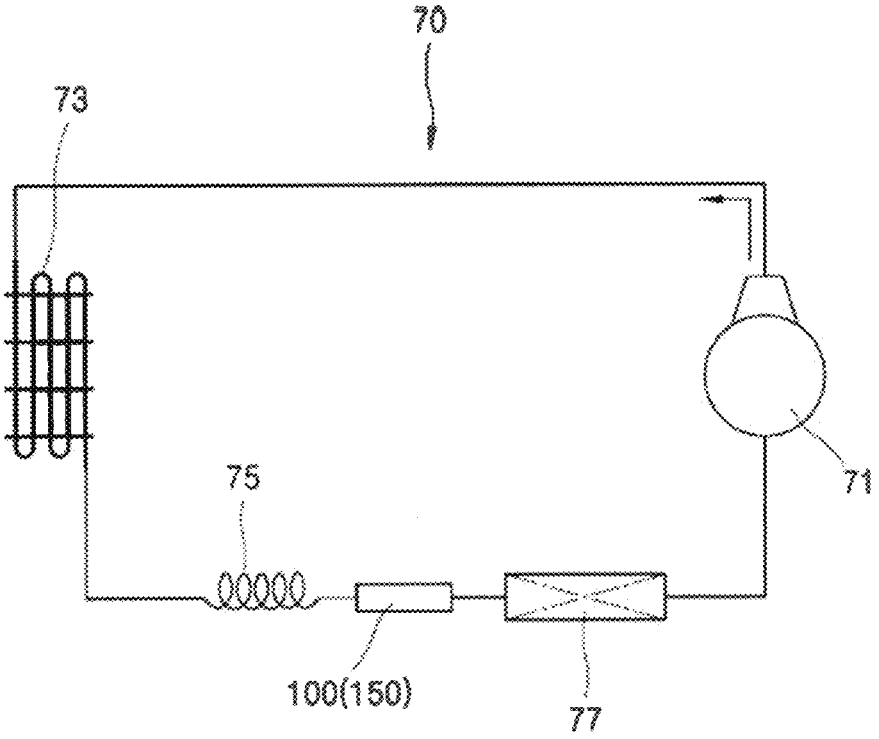
FIG. 19 is a view of a refrigeration cycle applied to a refrigerator according to another embodiment.

FIG. 18 is a view of a refrigeration cycle applied to the refrigerator according to an embodiment, and FIG. 19 is a view of a refrigeration cycle applied to the refrigerator according to another embodiment.

The refrigeration cycle cooling device 70 of the refrigerator according to an embodiment is a device for discharging heat inside the freezing compartment to the outside through the refrigerant passing through a thermodynamic cycle of evaporation, compression, condensation and expansion. The refrigeration cycle cooling device according to an embodiment includes an evaporator 77 in which a liquid refrigerant in a low-pressure atmosphere is evaporated by heat exchange with air in the cooling chamber (a space between the grille panel assembly and the inner housing), a compressor 71 for pressing a gas refrigerant vaporized in the evaporator and discharging a high-temperature high-pressure gas refrigerant, a condenser 73 for condensing the high-temperature high-pressure gas refrigerant discharged from the compressor 71 by heat exchange with air in the outside (machine room) of the refrigerator to discharge heat, and an expansion device 75 such as a capillary tube, which drops down a pressure of the refrigerant condensed in the condenser 73 to a low temperature atmosphere. The low-temperature low-pressure liquid refrigerant that decreases in pressure in the expansion device 75 is reintroduced into the evaporator 77.

According to an embodiment, since heat of the heat sink 150 of the thermoelectric module assembly 100 has to be quickly cooled, the low-temperature low-pressure liquid refrigerant that decreases in pressure and temperature after passing through the expansion device 75 has to pass through the heat sink 150 of the thermoelectric module assembly 100 before being introduced into the evaporator 77.

Figure 20:
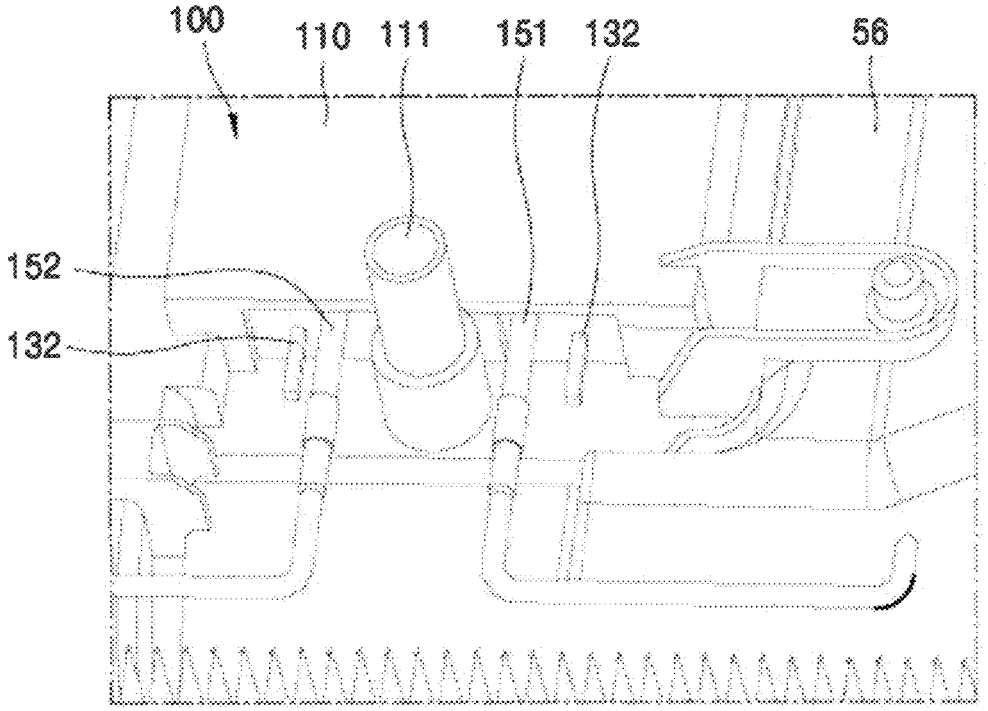
FIG. 20 is an enlarged perspective view illustrating a state in which a refrigerant tube, which are disposed at a rear side of a capillary tube, and the capillary tube, which is disposed at a front side of an evaporator, of the refrigeration cycle are respectivley connected to a refrigerant inflow tube 151 and a refrigerant outflow tube 152 of the thermoelectric module assembly fixed to the grille panel assembly.

FIG. 20 is an enlarged perspective view illustrating a state in which a refrigerant tube, which are disposed at a rear side of a capillary tube, and the capillary tube, which is disposed at a front side of an evaporator, of the refrigeration cycle are respectivley connected to a refrigerant inflow tube 151 and a refrigerant outflow tube 152 of the thermoelectric module assembly fixed to the grille panel assembly. As illustrated in FIG. 20, the refrigerant inflow tube 151 exposed to a rear side of the module housing through a lower portion of the module housing 110 of the thermoelectric module assembly 100, more particularly, the opening hole provided below the accommodation groove is connected to the refrigerant tube of the refrigeration cycle passing through the expansion device such as the capillary tube. Also, the refrigerant outflow tube 152 exposed to the rear side of the module housing is connected to the refrigerant tube introduced into the evaporator. Thus, the refrigerant discharged via the capillary tube is introduced into the heat sink 150 through the refrigerant inflow tube 151 to cool or absorb heat generated from a heat generation surface of the thermoelectric module 130 and then is discharged from the refrigerant discharge tube 152 and reintroduced into the evaporator 77.

Thus, the refrigerant discharged via the capillary tube is introduced into the heat sink 150 through the refrigerant inflow tube 151 to cool or absorb heat generated from a heat generation surface of the thermoelectric module 130 and then is discharged from the refrigerant outflow tube 152 and reintroduced into the evaporator 77.

Hereinafter, this will be described with reference to FIG. 18. The compressor 71 presses the low-temperature low-pressure gas refrigerant to discharge the high-temperature high-pressure gas refrigerant. Also, the refrigerant is condensed, i.e., liquefied while releasing the heat in the condenser 73. As described above, the compressor 71 and the condenser 73 are disposed in the machine room of the refrigerator.

The high-temperature high-pressure liquid refrigerant that is liquified by passing through the condenser 73 may be introduced into the evaporator 77 in the depressurized state by passing the expansion device 75 such as the capillary tube. In the evaporator 77, the refrigerant is evaporated while absorbing heat therearound. According to the embodiment of FIG. 6, the refrigerant passing through the condenser 73 is branched into a refrigerating compartment-side evaporator 77*b* or a freezing compartment-side evaporator 77*a*. Here, the heat sink 150 of the thermoelectric module assembly 100 is disposed at the front side of the freezing compartment-side evaporator 77*a* and disposed at the rear side of the expansion device 75 in the refrigerant flow path.

The cryogenic freezing compartment is a space in which a maximum freezing temperature of a temperature of about −50 degrees Celsius is to be maintained. Thus, when the heat generation surface 130*b* of the thermoelectric module 130 is maintained in a very cool state, the heat absorption surface 130*a* may be easily maintained in a colder state. Thus, a portion of the heat sink 150 through which the refrigerant flows may be disposed at the front side rather than the freezing compartment-side evaporator 77*a* in the refrigerant flow path and thus be maintained in the colder state. Particularly, since the heat sink 150 comes into direct contact with the thermoelectric module 130 to absorb heat from the thermoelectric module 130 in the conductive manner through a heat conductor such as metal, the heat generation surface 130*b* of the thermoelectric module 130 may be surely cooled.

Also, while the cooling of the cryogenic freezing compartment 200 is performed, i.e., the refrigerant within the heat sink 150 cools the heat generation surface 130*b* of the thermoelectric module 130, the compressor may operate at a maximum output or an output higher than a set output to prevent the cooling efficiency of the freezing compartment from being deteriorated.

When the cryogenic freezing compartment 200 is to be used at a temperature of about −20 degrees Celsius as in the normal freezing compartment without being cooled to a cryogenic temperature of about −50 degree Celsius, it is possible to be used as a general freezing compartment only by not supplying power to the thermoelectric module 130. In this case, if power is not applied to the thermoelectric module 130, the heat absorption and the heat generation do not occur in the heat sink of the thermoelectric module 130. Thus, the refrigerant passing through the heat sink 150 is introduced into the freezing compartment-side evaporator 77*a* in the liquid refrigerant state that is not evaporated because of not absorbing heat.

A hole, i.e., a drain hole 536 through which the defrosting water generated during the defrosting of the above-described cold sink 120 is discharged may be provided in the thermoelectric module accommodation part 53. The drain hole 536 communicates with a space between the grille panel 51 and the shroud 56 and/or a space between the grill assembly 50 and the inner case 12. Thus, when the cooling fan 190 operates in a state in which power is not supplied to the thermoelectric module 130, cold air in the space between the grille panel 51 and the shroud 56 and/or the space between the grille panel assembly 50 and the inner case 12 may inflow to the thermoelectric module accommodation part 53 and then be discharged into the cryogenic freezing compartment 200 by the cooling fan 190. Also, to promote the inflow of the cold air in the space between the grille panel 51 and the shroud 56 and/or the space between the grille panel assembly 50 and the inner case 12 toward the thermoelectric module accommodation part 53, an additional fan (not shown) may be further installed. Furthermore, when the cryogenic freezing compartment is used as the general freezing compartment, a damper structure may be added so that the air cooled by the refrigeration cycle cooling device 70 is selectively supplied.

That is, the cold air generated in the refrigerant cycle cooling device through the general compression manner may be supplied to the freezing compartment 40 and the refrigerating compartment 30 of the refrigerator. When the cryogenic freezing compartment operates, the refrigerant passing through the expansion device 75 may quickly absorb heat generated from the heat generation surface of the thermoelectric device 130 by passing through the heat sink 150 of the thermoelectric module assembly 100 so that the heat generated form the heat generation surface of the thermoelectric module 130 is quickly discharged and then is introduced into the evaporator 77*a*.

A refrigeration cycle cooling device 70 of FIG. 19 that is a modified example of FIG. 18 is different from the refrigeration cycle cooling device 70 of FIG. 18 in that cooling of the freezing compartment and the refrigerating compartment is performed by using one evaporator 77 without providing a separate evaporator 77*b* for the refrigerating compartment. That is, the structure of FIG. 18 is different from that of FIG. 19 in that a three-way valve or a check valve are not provided, and a refrigerating compartment-side expansion device 75 and a branch part of the evaporator 77*b* are not provided. That is, according to an embodiment, in case of the refrigeration cycle for performing the cooling by using one evaporator 77, the refrigerant may be disposed at the position corresponding to a front side of the evaporator 77 and a rear side of the expansion device 75 to pass while being heat-exchanged with the heat sink 150 of the thermoelectric module assembly 10, and the cooling of the heat generation surface 130*b* of the thermoelectric module 130 may be performed by priority.

The cryogenic freezing compartment 200 may store foods at a temperature less than −20 degrees Celsius, which is the temperature of the general freezing compartment, and be cooled down to −50 degrees Celsius. However, the extremely low temperature environment is intended to provide a quenching environment for preventing the water from being escaped or separated from the cells as described above. After the quenching is performed once, there is no problem that the storage temperature increases to a temperature of the quenching environment.

Thus, the storage of the food after quenching already in the quenching environment may result in higher energy consumption. Therefore, in an embodiment, it is possible to conserve power while maintaining the freshness of the stored product by keeping the food at a slightly higher temperature (for example, −45° C. to −40° C.) after quenching the food at −50° C. at the initial stage of cooling.

The operation condition may be variously changed. For example, in the early stage, the food is quenched to −50° C. and then maintained at a somewhat higher temperature (e.g., −35° C. to −30° C.) to ensure the freshness of the product through quenching and reduce the cooling time while more saving the power consumption.

Also, the cryogenic freezing compartment may operate as a concept of a fresh compartment in which the initial quenching temperature is set at about −35° C., and thereafter, the constant quenching temperature is maintained at about −35° C. or without implementing a temperature of −50° C.

This operation mode may be selected by the user. The selection of the cryogenic temperature may be attributed to the characteristics of the thermoelectric module. That is, it is difficult to change the operation mode suddenly, and it is difficult to control the temperature in detail. However, since the thermoelectric module adjusts the temperature of the cryogenic freezing compartment according to the current applied thereto, the above-described various operation modes may be possible.

Figure 22:
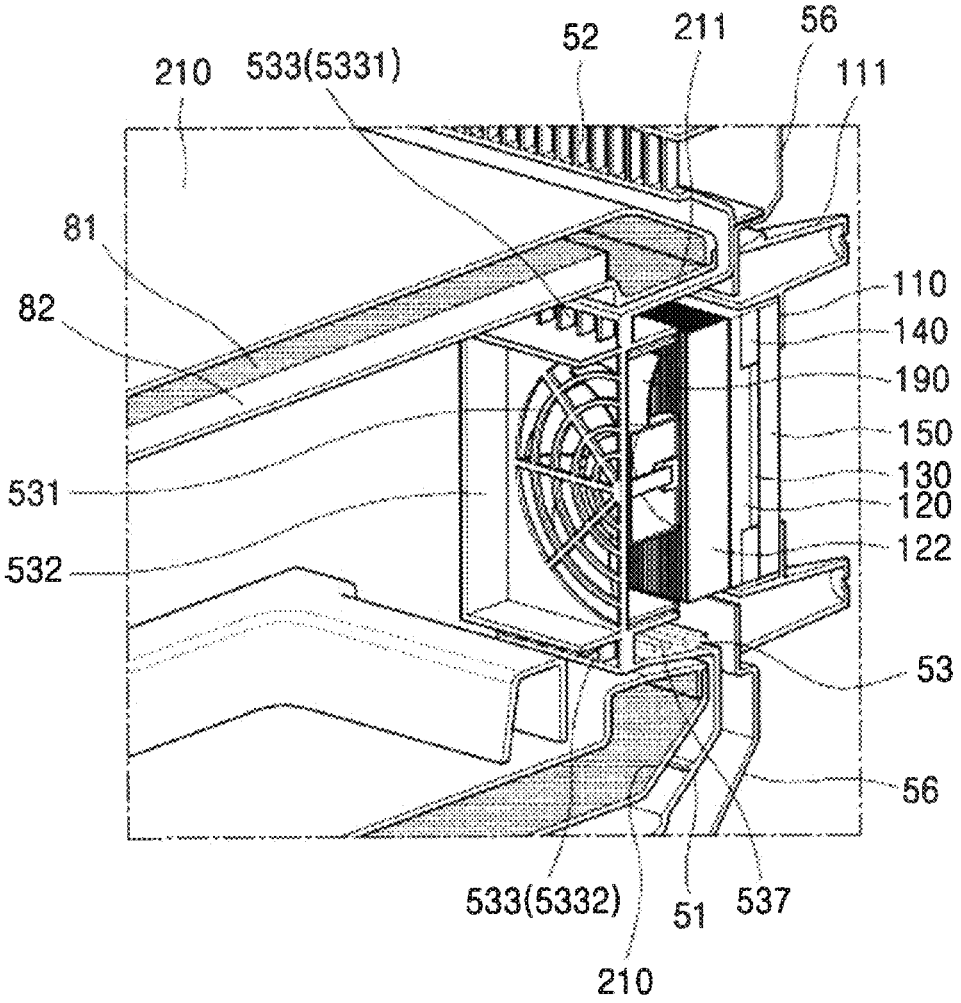
FIG. 22 is a lateral cross-sectional perspective view illustrating a state in which the thermoelectric module assembly is installed on the grille panel assembly on which a cryogenic case is mounted.
Figure 23:
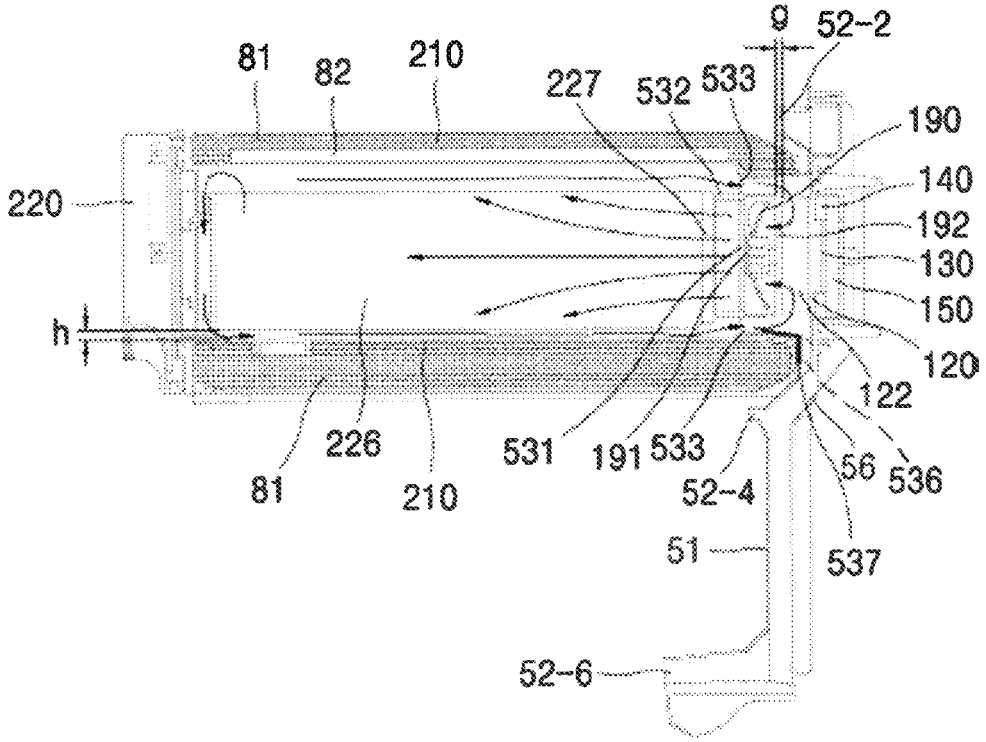
FIG. 23 is a lateral cross-sectional view illustrating a state in which the thermoelectric module assembly is installed in the grille panel assembly on which the cryogenic freezing compartment is mounted.
Figure 24:
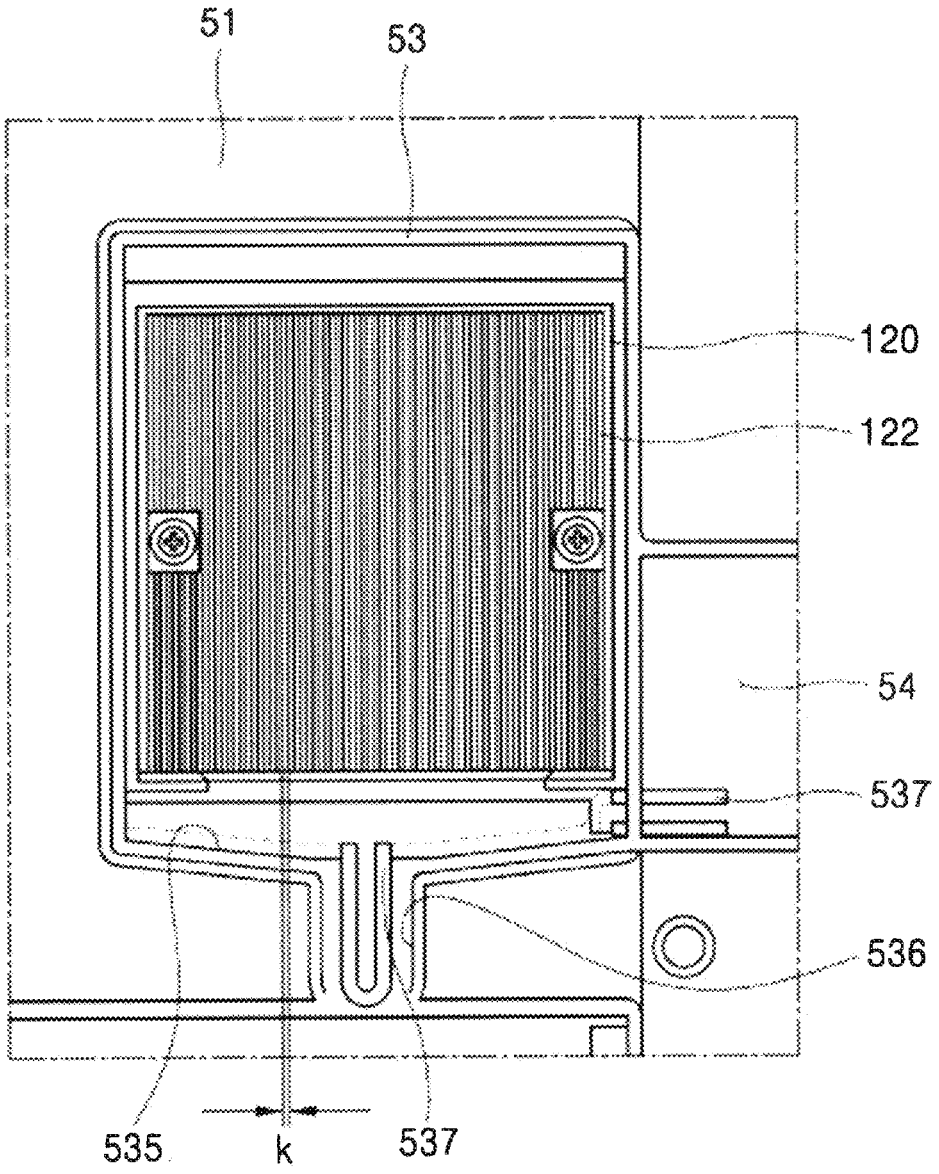
FIG. 24 is a front view of the thermoelectric module assembly mounted on the grille panel assembly when viewed along the L-L cross-section of FIG. 11.

FIG. 22 is a lateral cross-sectional perspective view illustrating a state in which the thermoelectric module assembly is installed on the grille panel assembly on which a cryogenic case is mounted, FIG. 23 is a lateral cross-sectional view illustrating a state in which the thermoelectric module assembly is installed in the grille panel assembly on which the cryogenic freezing compartment is mounted, and FIG. 24 is a front view of the thermoelectric module assembly mounted on the grille panel assembly when viewed along the L-L cross-section of FIG. 11.

The thermoelectric module assembly 100 is accommodated in the thermoelectric module accommodation part 53. Also, a cooling fan 190 is disposed at a front side of the thermoelectric module assembly 100 within the thermoelectric module accommodation part. A box fan may be used as the cooling fan 190. The box fan is superior in flow pressure to the size, and an air suction surface 192 and an air discharge surface 191 are arranged to face each other as a plane shape. The cooling fan 190 is closely fixed to the rear surface of the front portion of the thermoelectric module accommodation part 53. In an embodiment, the cooling fan 190 passes through the screw at the four corners of the front surface of the thermoelectric module accommodation part 53.

The cooling fan 190 in the form of the box fan provides a flat circular air discharge surface 191 at the front side, and a grill part 531 having a size corresponding to that of the air discharge surface 191 is disposed on the front surface of the thermoelectric module accommodation part 53 according to an embodiment. The grill part 531 protects the fan by preventing the air discharged from the cooling fan 190 from approaching the fan blade of the cooling fan 190 from the outside while smoothly discharging the air.

The cold sink 120 disposed at the front side of the thermoelectric module assembly 100 is disposed behind the box fan-shaped cooling fan 190. The air suction surface 192 of the cooling fan 190 and the heat exchange fin 122 of the cold sink 120 are arranged to face each other, and a predetermined gap g is provided therebetween.

A suction part 533 that provides a passage through which air is suctioned from the cryogenic freezing space into the inner space of the thermoelectric module accommodation part 53 is provided in each of upper and lower portions of the position at which the grill part 531 is disposed. The air suctioned from the suction part 533 comes into contact with the heat exchange fin 122 of the cold sink 120 and is heat-exchanged and cooled. Then, the air is discharged forward by the cooling fan 190 and is discharged into the storage space of the cryogenic freezing compartment 200.

The suction part 533 disposed above the grill part 531 may absorb heat from the cryogenic freezing compartment 200 to suction ascending air. The cold air, which increases in temperature, but does not maintain the inner temperature of the cryogenic freezing compartment, may be immediately suctioned through the suction part 533. The suction part 533 disposed at the lower portion of the grill part provides a passage so that the cold air supplied to the front side of the cryogenic tray 226 accommodated in the cryogenic freezing compartment 200 passes over the cryogenic tray 226 and is suctioned into the thermoelectric module accommodation part 53 through a space h between the bottom surface of the cryogenic tray and the bottom surface of the cryogenic case 210. That is, the suction part 533 is configured so that the cooling air discharged by the cooling fan 190 moves forward to cool the inner space of the cryogenic freezing compartment and immediately passes through the lower space of the cryogenic tray 226 to return to the thermoelectric module accommodation part 53, thereby allowing the cold air to circulate rapidly. This effect is an effect that may be enjoyed when the suction part is disposed above and below the grille part. However, according to an embodiment, the suction part is not limited to those disposed above and below the grill part, and may be separately or additionally disposed on the right and left sides of the grill part.

A distance h between the bottom surface of the cryogenic tray and the bottom surface of the cryogenic case is preferably greater than 4 mm and less than 7 mm. If the distance between the bottom surfaces is less than 4 mm, the cold air flows to increase in resistance, and the circulating flow of the cold air is deteriorated. On the other hand, if the distance is greater than 7 mm, only the storage capacity of the cryogenic tray 226 is reduced with little improvement in circulating flow of the cold air.

To maintain the distance between the bottom surface of the cryogenic tray and the bottom surface of the cryogenic case, the cryogenic tray and the bottom surface are provided with ribs that function as spacers. Referring to FIG. 12, a lower end of the rib 226*a* protruding downward from a center of the bottom surface of the cryogenic tray 226 comes into contact with the bottom of the inside case 214. Also, a rib 214*b* protruding upward from the bottom surface of the inside case to come into contact with the bottom surface of the cryogenic tray is further provided on each of both sides with the rib 226*a* therebetween. The rib 226*a* of the cryogenic tray 226 may be elongated forward and backward, and the ribs 214*b* of the inside case may be spaced forward and backward from each other.

To allow the cold air to smoothly flow into the space between the bottom surface of the cryogenic tray 226 and the bottom surface of the cryogenic case 210, since the side surface of the cryogenic tray is slightly spaced apart from the inner surface of the cryogenic case, and/or, the front surface of the cryogenic tray is slightly spaced apart from the rear surface of the cryogenic compartment door 220, the cold air discharged forward by the cooling fan may pass over the front wall or the sidewall of the cryogenic tray to flow between the bottom surface of the cryogenic tray 226 and the bottom surface of the cryogenic case 210.

The suction parts 5331 and 5332 are disposed in the upper and lower portions of the grill part 531 on which the cooling fan 190 to provide passages through which air is suctioned. The air suctioned into the inner space of the thermoelectric module accommodation part 53 from the upper and lower portions flows toward a negative pressure portion generated on the air suction surface 192, which is the rear side of the cooling fan 190 in the middle and comes into contact with the heat exchange fin 122 so as to be heat-exchanged. That is, since the suction part is provided on the upper and lower sides, the flow of the cold air occurs in the vertical direction even in the thermoelectric module accommodation part. In consideration of this point, according to an embodiment, the heat exchange fin 122 has a shape that lengthily extends in a vertical direction. Therefore, the air flowing in the thermoelectric module accommodation part flows into the space between the heat exchange fins extending in the vertical direction and comes into contact with the cold sink 120 at a large surface area to perform the heat exchange.

The shape in which the heat exchange fin lengthily extends in the vertical direction does not consider only the flow of the air. Since the extremely low temperature is maintained in the cryogenic freezing compartment 200, as described above, the cold air circulating in the cryogenic freezing compartment 200 partially contains moisture of the food and is heat-exchanged with the cold sink 120, and thus the freezing occurs in the cold sink 120 so that the frozen water gradually grows.

The defrost sensor provided in the sensor installation part 54 detects a change in temperature or humidity that changes as the frozen water grows and determines whether defrosting is performed according to the detected result. When the defrosting is performed, the frozen water adhering to the heat exchange fin 122 has to flow downward along the direction of gravity. In view of the above, the structure in which the heat exchange fin 122 of the cold sink 120 vertically extends may be adopted. That is, the heat exchange fin 122 extends vertically to coincide with the flow direction of the air and also to allow the defrosting water to smoothly flow. Also, as illustrated in the drawings, the heat exchange fin 122 vertically extends without being cut so that the defrosting water smoothly flow except for the broken portion of the heat exchange fin, i.e., the portion at which the screw is fixed to assemble the thermoelectric module assembly.

A distance k between the heat exchange fins 122 is preferably greater than 2 mm and less than 5 mm. When the distance is less than 2 mm, the defrosting water is entangled by the tension and does not flow well. When the distance is greater than 5 mm, the cross-sectional area is excessively reduced to deteriorate the heat exchange efficiency.

Also, in a similar manner, the air suction surface 192 of the cooling fan and the front end of the heat exchange fin 122 is spaced a distance g from each other within a range of 4 mm to 7 mm. When the distance is less than 4 mm, the frozen water of the heat exchange fin may adhere to the fan. This significantly deteriorates reliability in operation of the cooling fan. Also, when the distance is greater than 7 mm, the air introduced into the thermoelectric module accommodation part through the suction part 533 does not come into contact with the heat exchange fins, and the specific gravity that returns by the cooling fan increases to significantly deteriorate cooling efficiency.

Also, according to an embodiment, a discharge guide 532 having a duct shape that protrudes forward from the grill part 531 is disposed on an edge of the grill part 531 coming into contact with the air discharge surface 191 of the cooling fan 190. The discharge guide 532 is manufactured in a square flow cross-section corresponding to that of the cooling fan 190 having a square box fan shape. However, the discharge guide 532 may have a shape having a circular flow cross-section corresponding to the circular shape of the grill part 531.

The discharge guide 533 that is opened forward is disposed on the substantially same plane as the air discharge surface, and the discharge guide 532 is disposed between the air discharge surface 191 of the cooling fan and the suction part 533. Also, the discharge guide 532 protrudes forward from the air discharge surface 191 of the cooling fan by a length of about 15 mm to about 30 mm.

When the suction part is disposed further forward than the air discharge surface, the phenomenon that the air discharged from the air discharge surface is immediately suctioned again into the suction part may increase. On the other hand, when the suction part is disposed further backward than the air discharge surface, suction force of the suction part is weakened, and circulation force of the cold air circulating in the space inside the cryogenic freezing compartment is weakened.

Also, when the protrusion length of the discharge guide 532 is less than 15 mm, the phenomenon in which the air discharged from the air discharge surface is immediately suctioned again into the suction part may increase so that a large flow loss occurs, which leads to a heat exchange loss in the cold sink. When the protrusion length of the discharge guide is within the range of about 15 mm to about 30 mm, the phenomenon in which the air discharged from the air discharge surface is suctioned again into the suction part is remarkably reduced, and thus, there is an advantage that the linear fluidity of the air discharged from the air discharge surface is further enhanced. On the other hand, when the protrusion length of the discharge guide is greater than 30 mm, the linear fluidity of the air improves no longer, but occupies only the inner volume of the cryogenic freezing compartment 200.

As illustrated in FIG. 23, an end of the discharge guide 532 may face the opening groove 227 defined at the rear side of the cryogenic tray 226. Thus, the cold air discharged through the discharge guide 532 flows not only into the cryogenic tray 226 but also flows strongly forward, thereby uniformly cooling the cryogenic freezing space.

Although the discharge guide in the embodiment is configured to entirely surround the grill part 531, it is possible to apply the form in which the discharge guide 532 is provided only on the area on which the suction part is provided around the grill part 531 as long as the cold air is prevented from being suctioned again to the suction part. For example, in the structure in which the suction parts are arranged at the upper and lower sides, the discharge guide 532 may be provided on the upper and lower sides of the cooling fan. Also, if the suction part is provided on the left and right sides relative to the cooling fan, the discharge guide may be provided on the left and right.

Furthermore, the shape of the discharge guide is not limited to having the square flow cross-section, and it is possible to have a circular cross-section corresponding to the shape of the fan or various other cross-sections.

Figure 25:
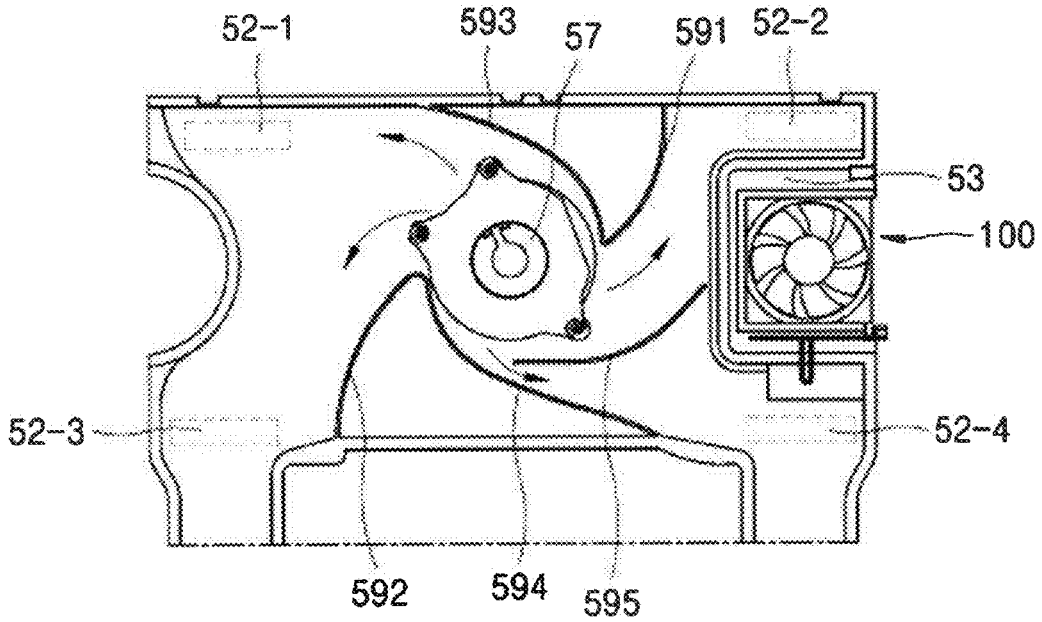
FIG. 25 is a front view illustrating a state in which a fan and the thermoelectric module assembly are assembled with the shroud.
Figure 26:
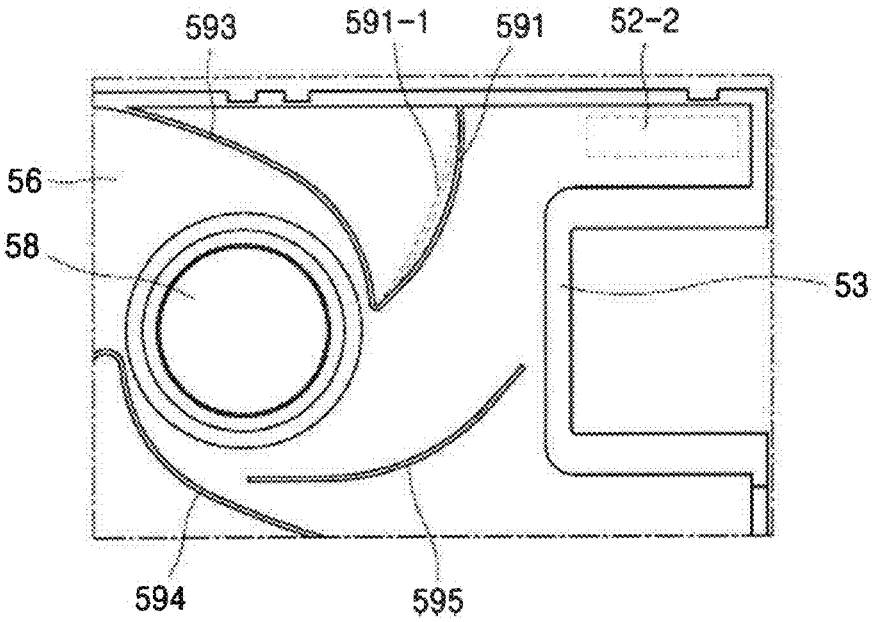
FIG. 26 is a front enlarged view illustrating shapes before and after a guide partition wall is changed in the shroud that is changed in a cold air distribution structure due to the installation of the thermoelectric module assembly.
Figure 27A:
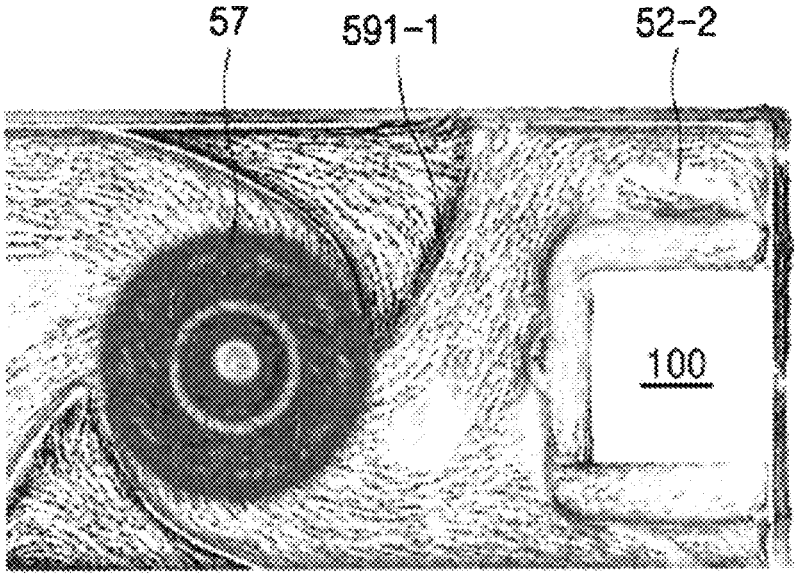
FIGS. 27A and 27B are views illustrating results obtained by analyzing an air flow before and after the guide partition wall is changed according to an embodiment.
Figure 27B:
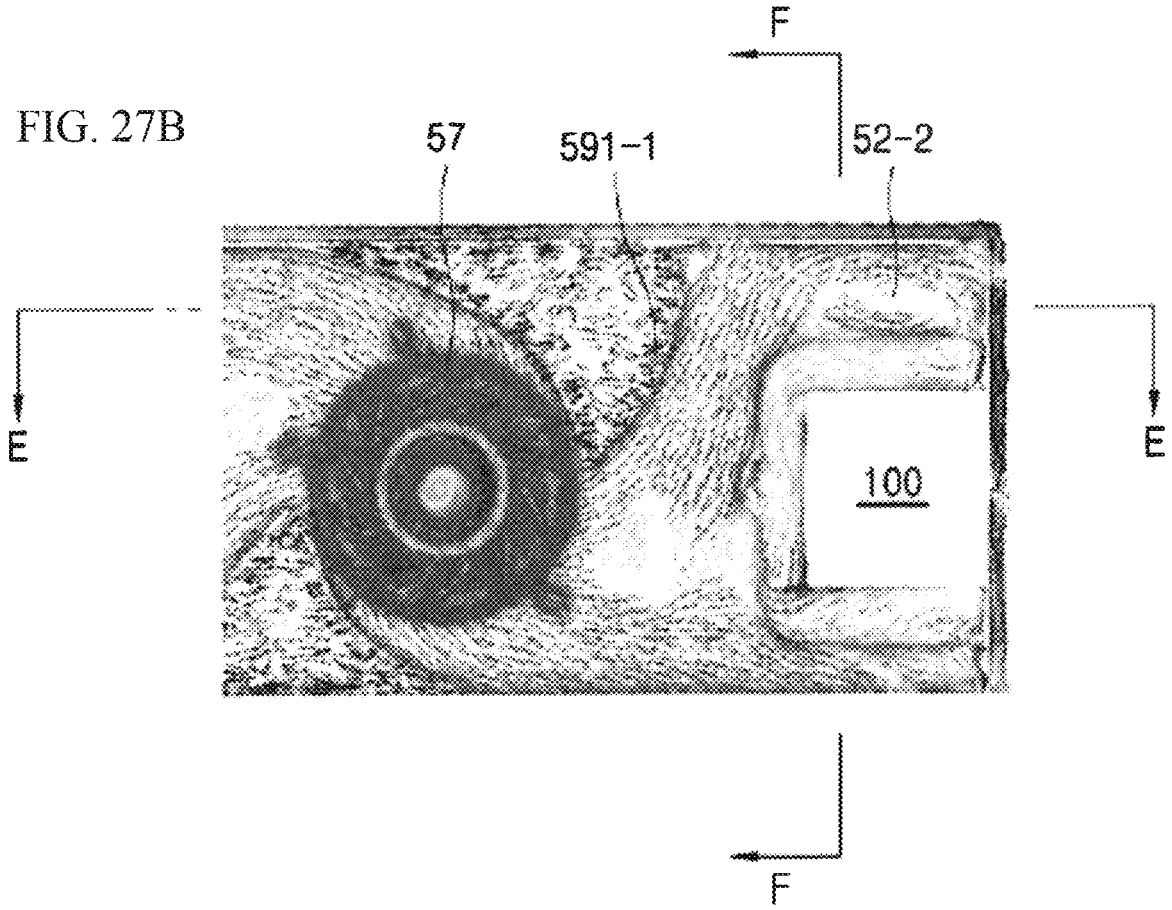
Figure 28:
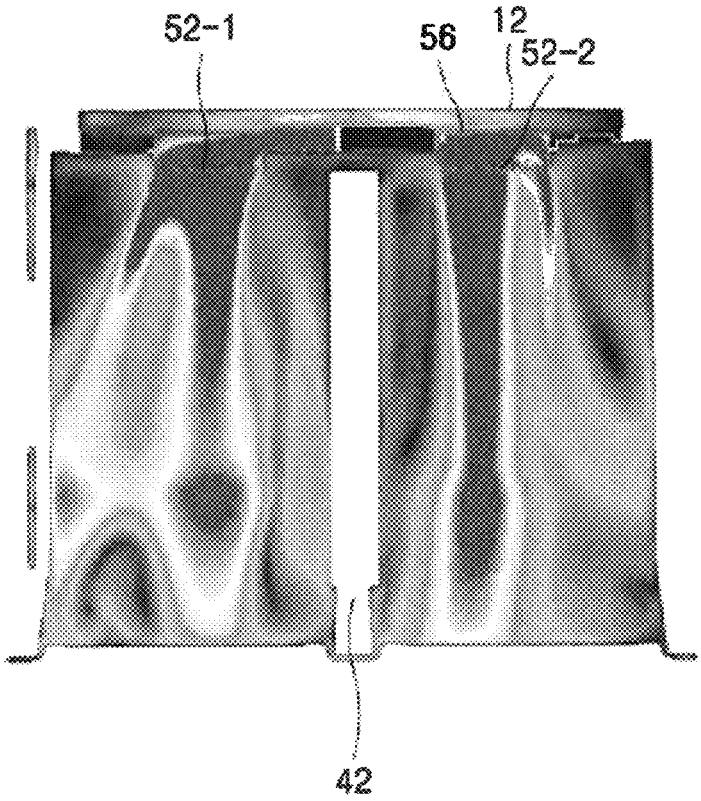
FIG. 28 is a cross-sectional view taken along line E-E of FIG. 27B.
Figure 29:
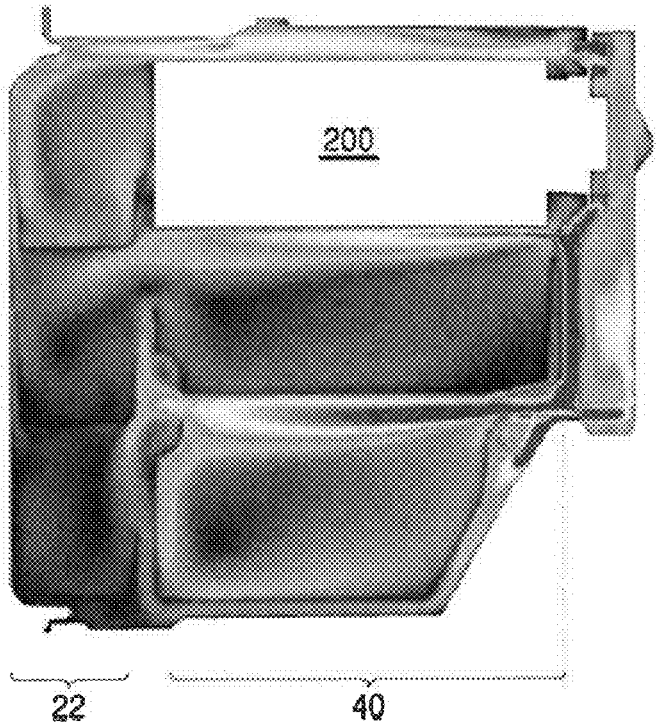
FIG. 29 is a cross-sectional view taken along line F-F of FIG. 27B.

FIG. 25 is a front view illustrating a state in which a fan and the thermoelectric module assembly are assembled with the shroud, FIG. 26 is a front enlarged view illustrating shapes before and after a guide partition wall is changed in the shroud that is changed in a cold air distribution structure due to the installation of the thermoelectric module assembly, FIGS. 27A and 27B are views illustrating results obtained by analyzing an air flow before and after the guide partition wall is changed according to an embodiment, FIG. 28 is a cross-sectional view taken along line E-E of FIG. 27B, and FIG. 29 is a cross-sectional view taken along line F-F of FIG. 27B.

When compared with the structure in which the cryogenic freezing compartment 200 is not installed, since the cryogenic freezing compartment 200 is installed in the embodiment, the thermoelectric module accommodation part 53 may be disposed in the distribution flow space of the cold air, which is defined between the grille panel 51 and the shroud 56 of the grille panel assembly 50. The thermoelectric module assembly 100 accommodated in the thermoelectric module accommodation part 53 is disposed to be isolated from the distribution flow space of the cold air, which is defined between the grille panel 51 and the shroud 56. Therefore, the space occupied by the thermoelectric module accommodation part 53 may not be utilized as a space for distributing the cold air. However, as described above, the cold air discharge holes 52-2 and 52-4 for discharging the air cooled by the refrigeration cycle cooling device 70 to the freezing chamber are still provided at the upper and lower portions of the thermoelectric module accommodation part, and in order to uniformly supply the cold air to all the spaces of the freezing compartment 40 including the freezing compartment door 22, the cold air discharge holes 52-2 and 52-4 have to be disposed both above and below the cryogenic freezing compartment 200. A fan 57 for allowing air within the cold air distribution flow space defined by the shroud 56 and the grille panel 51 to flow is disposed at an approximately central portion of the shroud 56. A cold air suction hole 58 is defined at a portion facing a suction surface of the fan 57 as a central portion of the shroud 56. The cooling air suction holes 58 provides a passage through which the cold air cooled by the evaporator in the space between the grille panel assembly 50 and the inner case 12, in which the evaporators 77*a* and 77 are disposed, is introduced into the cold air distribution flow space defined by the shroud 56 and the grille panel 51. The fan 57 is a sirocco fan and discharges the air suctioned in the cold air suction hole 58 in the radial direction of the fan as illustrated in FIG. 25.

As illustrated in the drawings, the cool air discharge holes 52 provided in the grille panel 51 are defined in an upper left side 52-1, an upper right side 52-2, a lower left side 52-3, and a lower right side 52-4 with respect to the shroud 56, and the thermoelectric module accommodation part 53 is disposed at a right side of the grille panel 51. To smoothly supply the cold air to the cold air discharge holes provided in the upper right side and the lower right side due to the thermoelectric module accommodation part 53, a structure in which the cold air supplied to the upper right side and the lower right side, particularly, the upper right side having the narrow passage is smoothly supplied is required.

The fan 57 installed on the shroud 56 illustrated in FIG. 25 rotates in a counterclockwise direction, and thus, the cold air is discharged in a direction of an arrow illustrated in FIG. 25. Accordingly, in an embodiment, a thermoelectric module-side upper guide wall 591 having a streamlined shape that is convex to the right side is installed at the upper right portion of the fan in the drawing to guide the cold air flowing to the cold air discharge hole 52-2 defined in the upper right side, and the other side upper guide wall 593 having a streamlined shape that is concave from the guide partition wall 591 to the left side is provided to guide the cold air flowing to the cold air discharge hole 52-1 defined in the upper left side.

Similarly, the other-side lower guide wall 592 having a streamlined shape that is convex to the left side is installed at the upper left portion of the fan to guide the cold air flowing to the cold air discharge hole 52-3 defined in the lower left side, and a thermoelectric module-side lower guide wall 594 having a streamlined shape that is concave from the guide partition wall 592 to the right side is provided to guide the cold air flowing to the cold air discharge hole 52-4 defined in the lower right side.

Referring to FIG. 25, the flow cross-sectional area from the fan 57 to the cold air discharge hole in the other upper and lower sides is sufficient to secure the flow rate of the cold air discharged to the cold air discharge hole. Also, since the fan 57 rotates in the counterclockwise direction, the flow cross-sectional area from the fan to the cold air discharge hole in the lower side of the thermoelectric module is insufficient to secure the flow rate of the cold air discharged to the cold air discharge hole. On the other hand, the flow cross-sectional area from the fan to the cold air discharge hole in the upper side of the thermoelectric module is greatly reduced.

In an embodiment, as illustrated in FIG. 26, the thermoelectric module-side upper guide partition wall 591 is formed to be more convex than the other lower side guide partition wall 592. Referring to the reference numeral 591-1 of FIG. 26 illustrating a profile to which a radius of curvature of the other lower guide partition wall 592 is applied, it is confirmed that the upper guide partition wall 591 on the side of the thermoelectric module has a smaller radius of curvature and is more convex on the right side.

Referring to FIGS. 27A and 27B, when compared to FIG. 27A illustrating a case in which the upper right guide partition wall follows the profile of the reference numeral 591-1, in FIG. 27B illustrating a case following the profile in which the upper right guide partition wall is more convex, it may be confirmed that the cold air flowing to the cold air discharge hole 52-2 in the upper right side accelerates more quickly. As a result, as illustrated in FIG. 28, it may be seen that the cold air discharged through the cold air discharge hole 52-2 is also rapidly discharged to the right side, at which the cryogenic freezing compartment 200 is provided, to well reach the front side. Also, as illustrated in FIG. 29, it is confirmed that the cold air discharged from the upper and lower cold air discharge holes 52-2 and 52-4 of the cryogenic freezing compartment 200 is discharged at a high speed to well reach the freezing compartment door 22.

Also, in an embodiment, in addition to the profile of the thermoelectric module-side upper guide partition wall 591, as illustrated in FIG. 25, a structure in which the sub guide partition wall 595 is further provided below the thermoelectric module-side upper guide partition wall 591 is provided.

The sub guide partition wall 595 extends from the lower portion of the fan to the thermoelectric module accommodation part and has a streamlined profile that is gradually curved upward as it moves away from the fan. The streamlined profile is convex downward and is terminated in a form that is naturally connected to the sidewall of the thermoelectric module accommodation part 53.

According to the sub guide partition wall 595, since an amount of cold air that flows and collides with the sidewall of the flat thermoelectric module accommodation part is remarkably reduced, it is possible to further accelerate the cold air flowing into the cold air discharge hole defined in the upper portion of the thermoelectric module accommodation part 53.

In the embodiment, the thermoelectric module assembly 100 is disposed at the rear side of the freezing compartment 40 and at the rear side the cryogenic freezing compartment 200. However, the thermoelectric module assembly 100 is not necessarily limited to such a position. For example, the thermoelectric module assembly 100 may be embedded in the upper portion of the inner case 12 of the freezing compartment so as to be positioned above the cryogenic freezing compartment 200. The heat sink 150 of the thermoelectric module assembly 100 does not necessarily need to come into contact with air in that the refrigerant of the refrigeration cycle cooling device 70 of the refrigerator flows into the heat sink to perform the cooling through the heat conduction. Accordingly, the thermoelectric module assembly 100 may be embedded in the upper portion of the inner case 12 of the freezing compartment.

Although the embodiments are exemplified with respect to the accompanying drawings, those having ordinary skill in the art to which the present invention pertains will be understood that the present invention can be carried out in other specific forms without changing the technical idea or essential features. In addition, although explaining the embodiments of the present invention and explaining the operation and effect according to the constitution of the present invention have not been explicitly described, it is needless to say that a predictable effect is also recognized by the constitution.

Hereinafter, a refrigerator and a cryogenic freezing compartment installed in the refrigerator and according to another embodiment will be described with reference to the drawings.

Another embodiment is the same as the above-described embodiment except for a configuration of the thermoelectric module assembly, and a coupling structure of the thermoelectric module assembly and a grille panel assembly. Also, to avoid the duplicated description, the same constituent as those of the abovementioned embodiments will be denoted by the same reference numeral, and its detailed description will be omitted.

Figure 30:
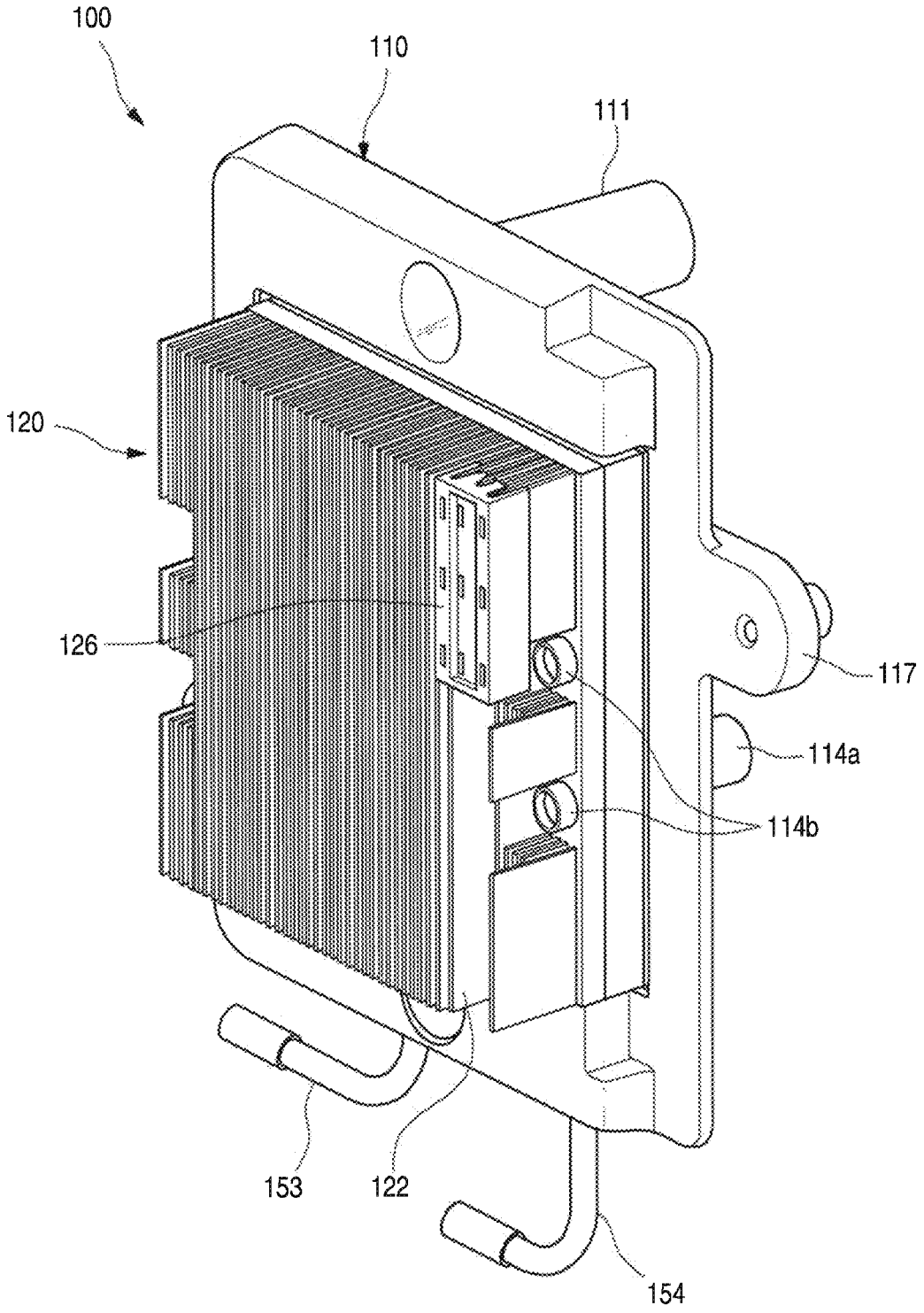
FIG. 30 is a front perspective view of a thermoelectric module assembly according to another embodiment.
Figure 31:
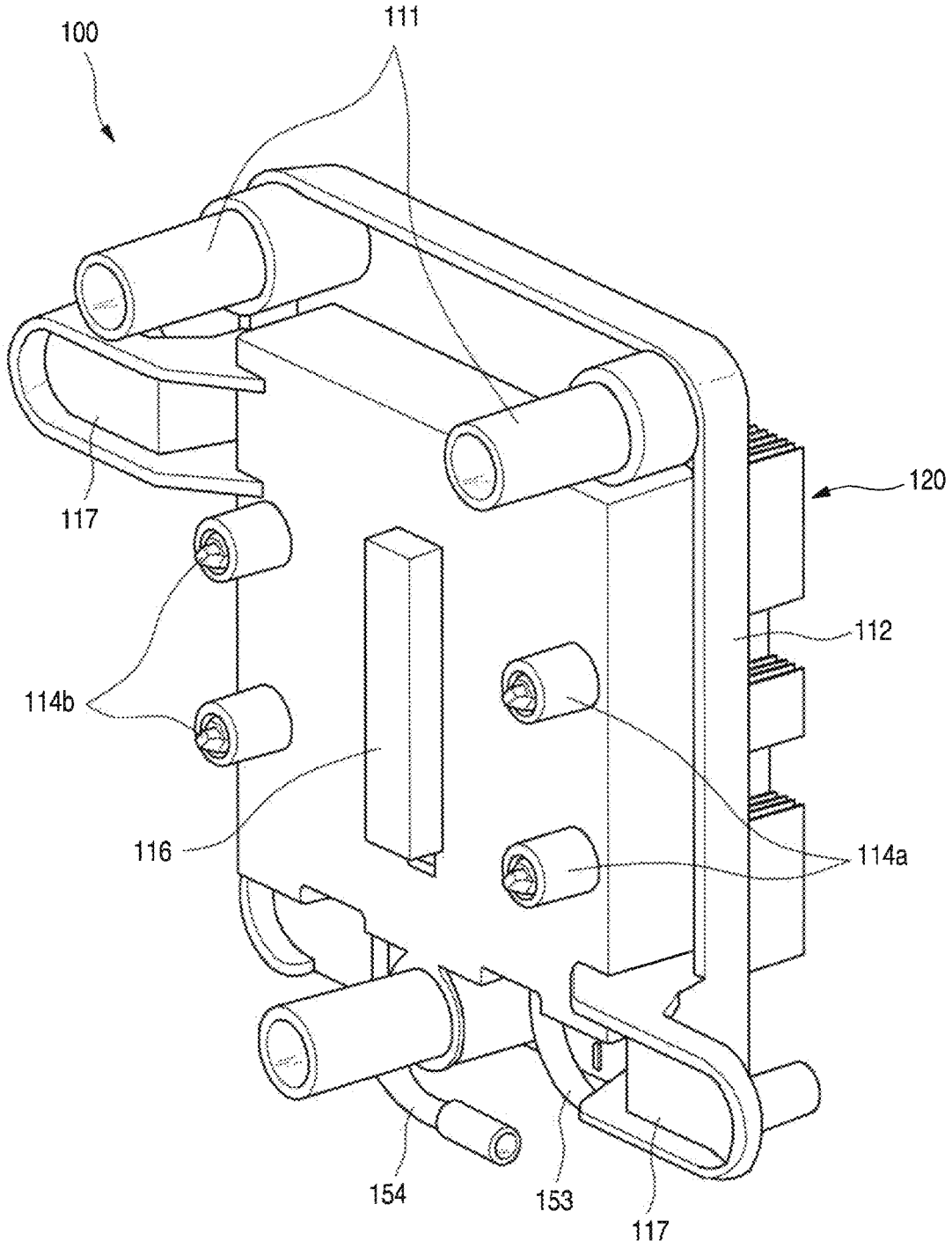
FIG. 31 is a rear perspective view of the thermoelectric module assembly.
Figure 32:
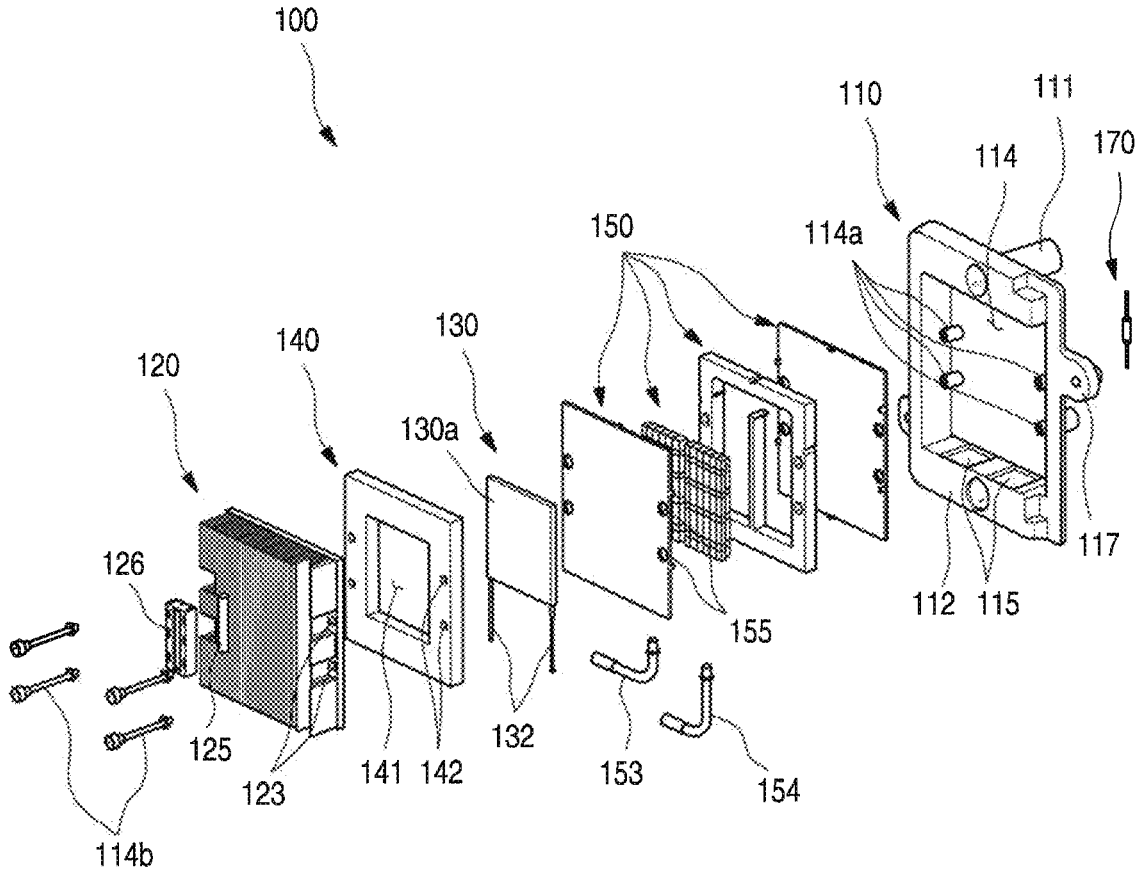
FIG. 32 is an exploded front perspective view illustrating a coupling structure of the thermoelectric module assembly.
Figure 33:
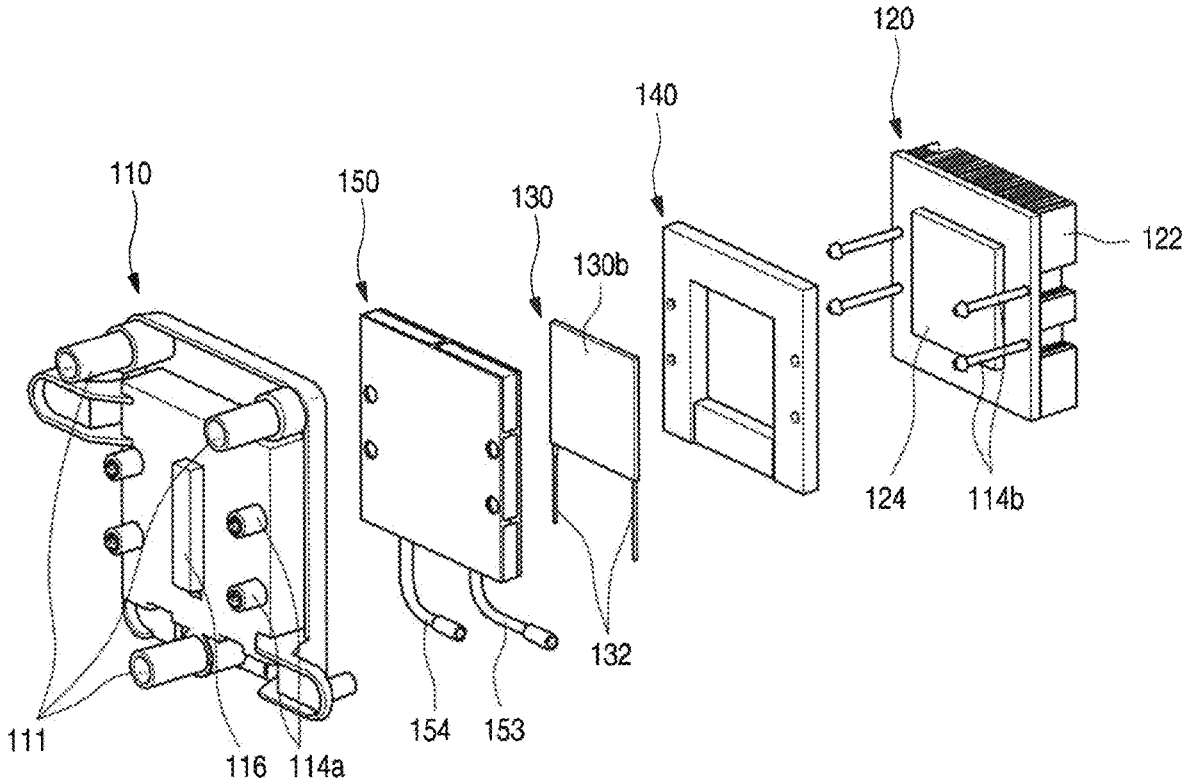
FIG. 33 is an exploded rear perspective view illustrating the coupling structure of the thermoelectric module assembly.

FIG. 30 is a front perspective view of a thermoelectric module assembly according to another embodiment, FIG. 31 is a rear perspective view of the thermoelectric module assembly, FIG. 32 is an exploded front perspective view illustrating a coupling structure of the thermoelectric module assembly, and FIG. 33 is an exploded rear perspective view illustrating the coupling structure of the thermoelectric module assembly.

As illustrated in the drawings, a thermoelectric module assembly 100 according to another embodiment may include a thermoelectric module 130, a cold sink 120, a heat sink 150, an insulation material 140, and a module housing 110. The functions of the respective constituent elements of the thermoelectric element module assembly 100 are the same as those of the above-described embodiment, and differ only in their coupling structure and arrangement.

In detail, the module housing 110 is configured to accommodate the thermoelectric module assembly 100 and is fixedly mounted on the grille panel assembly 50 so that the thermoelement module assembly 100 is fixedly mounted and effectively supplies the cold air to the cryogenic freezing compartment.

The module housing 110 has an accommodation groove 114. The accommodation groove 114 may provide a space for accommodating the components constituting the thermoelectric module assembly 100. The accommodation groove 114 may be opened to the cryogenic freezing compartment 200 and have a front surface that is sealed by mounting the thermoelectric module assembly 100 on the grille panel assembly 50. Thus, the cold air generated in the cold sink 120 may be effectively supplied into the cryogenic freezing compartment, and the heat sink 150 may be heat-exchanged by the evaporator 77 without having an influence on temperature of the inside of the refrigerator and the cryogenic freezing compartment 200. Here, there is a difference in heat transfer efficiency and cooling performance according to a depth of the accommodation groove 114 and an arrangement of the heat sink 150, the cold sink 120, and the thermoelectric module 130, which are disposed in the accommodation groove 114.

Also, a fixing boss 114*a* may be disposed inside the accommodation groove 114. The fixing boss 114*a* may be disposed on the bottom surface of the accommodation groove 114, i.e., on a surface opposite to the opened surface of the accommodation groove 114 and also protrude perpendicular to the bottom surface of the accommodation groove 114. The fixing boss 114*a* may extend to pass through the heat sink 150, the insulation material 140, and the cold sink 120. An opening is defined in an extending end of the fixing boss 114*a*, and the fixing boss 114*a* has a hollow therein so that the fixing member 114*b* passing through the cold sink 120 is coupled to the opening of the fixing boss 114*a*. Here, the fixing member 114*b* may include a screw, a bolt, or a corresponding constituent, which is coupled to the fixing boss 114*a*.

A plurality of constituents are fixedly mounted inside the accommodation groove 114. Here, it is necessary that the constituents are coupled by using the fixing member 114*b* to maintain the contact state and thereby to smoothly perform the heat exchange. The fixing member 114*b* has a structure that is coupled to the fixing boss 114*a*. The fixing member 114*b* may substantially come into contact with only the cold sink 120 and the fixing boss 114*a*. That is, the fixing member 114*b* may be electrically insulated from the heat sink 150 to prevent cooling performance from being deteriorated by heat transfer between the heat sink 150 and the cold sink 120.

The fixing boss 114*a* may extend to pass through through-holes 155 and 142 defined in both left and right sides of the heat sink 150 and the insulation material 140, i.e., extend up to a position coming into contact with coupling holes 123 defined in both sides of the cold sink 120. Thus, the heat sink 150, the insulation material 140, and the cold sink 120, which are mounted inside the module housing 110 may be accurately mounted in position. Also, the thermoelectric module 130, the heat sink 150, and the cold sink 120 may be maintained in the closely attached state through the coupling of the fixing member 114*b*.

The fixing boss 114*a* may pass through the module housing 110 to extend backward from the module housing 110. Also, the fixing member 114*b* may be coupled to pass through the module housing 110. Here, the fixing boss 114*a* may have a height less than that of a spacer 111 disposed on the module housing 110 to prevent the spacer 111 and the inner case 12 from interfering with each other when the spacer 111 and the inner case 12 are coupled to each other.

Also, an edge hole 115 through which the refrigerant inflow tube 153 and the refrigerant outflow tube 154 pass may be further defined in an edge of the accommodation groove 114. The edge hole 115 may be provided in a pair so that the leading wire 132 of the thermoelectric module 130 is accessible together with the refrigerant inflow tube 153 and the refrigerant outflow tube 154. Also, the edge hole 115 may be provided so that at least a portion of a bottom surface of a circumference of the accommodation groove 114 is opened. Here, the at least a portion may be opened to the evaporator 77. Thus, the refrigerant inflow tube 153 and the refrigerant outflow tube 154 may be easily connected to each other at a position that is adjacent to the evaporator 77.

A fuse mounting part 116 that is further recessed may be disposed on a center of the accommodation groove 114. A fuse 170 for detecting overheat of the heat sink 150 may be accommodated in the fuse mounting part 116. The fuse 170 is disconnected in an overheated state of the heat sink 150 to prevent the thermoelectric module 130 from being damaged or abnormally operated.

An opening may be defined in a bottom surface of the fuse mounting part 116, and the fuse 170 may be mounted and separated through the opening of the fuse mounting part 116. That is, the replacement operation may be performed through the fuse mounting part 116 without removing the entire thermoelectric module assembly 100 when the fuse 170 needs to be replaced. Also, a wire connected to the fuse 170 may also be accessible through the fuse mounting part 116.

A flange 112 is disposed on a circumference of an opened end of the accommodation groove 114. The flange 112 may be coupled to the shroud 56 and the grille panel 51 in a closely attached state. The flange 112 prevents the cold air from leaking through surface contact with the shroud 56 or the grille panel 51 and also allows the front surface of the thermoelectric module assembly 100 to be stably seated and supported on the grille panel assembly 50.

A housing coupling part 117 may be disposed on each of both sides of the flange 112. The housing coupling part 117 may be coupled to one side of the grille panel 51 or the shroud 56 by using the coupling member such as the screw. The module housing 110 may be fixedly mounted on the grille panel assembly 50. The housing coupling part 117 may extend outwardly from the left and right sides and have vertical heights different from each other at the left and right sides to prevent the thermoelectric module assembly 100 from being misassembled when the thermoelectric module assembly 100 is assembled and mounted. Thus, the module housing 110 may be closely attached to the grille panel assembly 50 to prevent the cold air of the thermoelectric module assembly 100 and the cryogenic freezing compartment 200 from leaking through the contact portion between the flange 112 and the grille panel assembly 50.

A spacer 111 extending backward, i.e., toward the inner case 12 may be disposed on the rear surface of the grille panel 51. The spacer 111 may support the module housing 110 to be maintained in a state spaced apart from the inner case 12. Also, the spacer 111 may be coupled to the inner case 12 so that the rear side of the thermoelectric module assembly 100 is stably fixed.

Two spacers 111 may be disposed on both sides of the upper grille panel 51, and one spacer may be disposed on a central lower portion. The spacer 111 disposed at the lower portion of the spacers 111 may be disposed between the edge holes 115 and also may not interfere with the leading wire 132, the refrigerant inflow tube 153, and the refrigerant outflow tube 154.

The spacer 111 may have upper and lower portions that have the same shape. The upper and lower portions of the spacer 111 may protrude at the same height so that the thermoelectric module assembly 100 is fixedly mounted in parallel to the wall of the inner case 12.

The spacer 111 may have a cylindrical shape, and both ends of the spacer 111 may be opened. That is, the spacer 111 may have a cylindrical shape of which a rear surface coming into contact with the inner case 12 and a front surface communicating with the inside of the accommodation groove 114 are straightly connected to each other. Thus, the inner case 12 and the module housing 110 may be fixedly mounted on each other by a coupling part 181 protruding from a rear wall of the inner case 12.

One end of the opened front surface of the module housing 110 may be stepped. The stepped portion may match a corresponding shape of the grille panel assembly 50 to seal the inside of the module housing 110.

The heat sink 150 may be accommodated inside the module housing 110, and then, the insulation material 140 may be stacked. The insulation material 140 may have a rectangular frame shape, and the thermoelectric module 130 may be disposed in the insulation material 140. Also, both surfaces of the thermoelectric module 130 may come into contact with the heat sink 150 and the cold sink 120. When power is applied, the heat sink 150 generates heat, and the cold sink 120 absorbs the heat.

After the insulation material 140 is stacked, the cold sink 120 may be mounted. The cold sink 120 may have a front surface having a size corresponding to the opened size of the accommodation groove 114 to cover the opened surface of the accommodation groove 114.

Also, a module contact part 124 inserted into a thermoelectric module accommodation hole 141 defined in a center of the insulation material 140 may be disposed at a center of the rear surface of the cold sink 120. The module contact part 124 has a size corresponding to the thermoelectric module accommodation hole 141 to seal the inside of the insulation material 140 and come into contact with the heat absorption surface 130*a* of the thermoelectric module 130 and then is cooled.

The fixing member 114*b* may be coupled to the coupling holes 123 defined in both sides of the cold sink 120, and thus, the cold sink 120 is coupled to the module housing 110 so that the module contact part 124 of the cold sink 120 is maintained to be closely attached to the heat absorption surface 130*a* of the thermoelectric module 130.

A temperature sensor 125 for detecting a temperature of the cold sink 120 may be disposed on one side of the front surface of the cold sink 120. The temperature sensor 125 may be fixedly mounted on one side of the heat exchange fin 122 by a sensor bracket 126.

The temperature sensor 125 may detect a temperature of the cold sink 120 to control an operation of the thermoelectric module 130. For example, the temperature sensor prevents the temperature of the cold sink 120 from increasing above a set temperature and being overheated when a reverse voltage is applied to the thermoelectric module 130 when a defrosting operation of the cryogenic freezing compartment 200 is performed.

Figure 34:
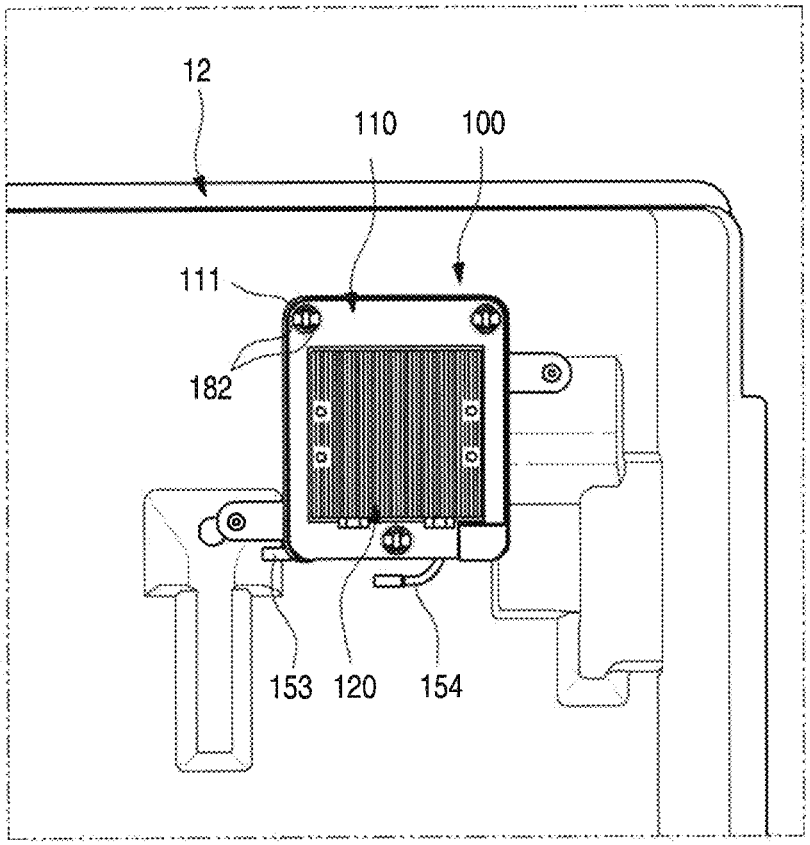
FIG. 34 is a partial front view illustrating a state in which the thermoelectric module assembly is mounted on the inner case.
Figure 35:
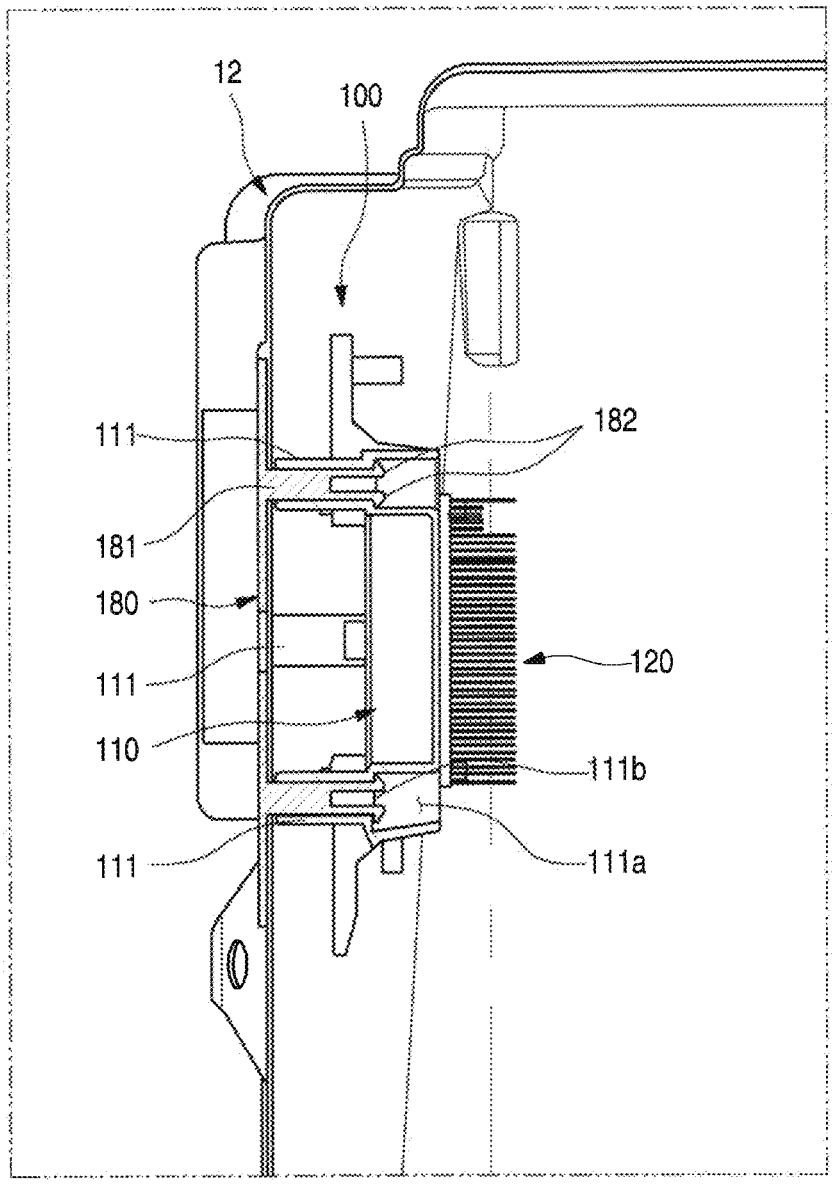
FIG. 35 is a partial cross-sectional view illustrating a coupling structure of the thermoelectric module assembly and the inner case.

FIG. 34 is a partial front view illustrating a state in which the thermoelectric module assembly is mounted on the inner case. FIG. 35 is a partial cross-sectional view illustrating a coupling structure of the thermoelectric module assembly and the inner case.

As illustrated in the drawings, in the thermoelectric module assembly 100, the housing coupling part 117 may be fixedly coupled to the grille panel assembly 50, and the spacer 111 may be coupled to the coupling part and then fixedly coupled to the inner case 12.

The opened front surface of the module housing 110 may be closely attached to the grille panel assembly 50 through the coupling structure to prevent the cold air from leaking. The rear surface of the module housing 110 may be spaced apart from the inner case 12 to secure the workability in connection between the tubes through the refrigerant flows and more improve the heat dissipation performance of the heat sink 150.

In the coupling structure of the spacer 111 and the inner case 12, the spacer 111 may extend to pass through the module housing 110 and the flange 112. Also, the stepped part 111*b* may be disposed inside the hollow 111*a* of the spacer 111.

The stepped part 111*b* may allow the coupling part 181 to be fixedly coupled in the state of being inserted into the hollow 111*a* of the spacer 111 and be hooked with a hook 182 disposed on an end of the coupling part 181.

The coupling part 181 may have a length less than the extension length of the spacer 111, and an end of the coupling part 181 may be cut to be elastically deformed. A hook 182 may be disposed on each of both sides of the cut end. Thus, when the coupling part 181 is inserted into the hollow of the spacer 111 without a separate coupling member and manipulation, the hook 182 may be hooked with the stepped part 111*b* so that the thermoelectric module assembly 100 is fixedly restricted.

The coupling part 181 may be made of a separate material and coupled and mounted on the inner case 12. The coupling part 181 may be disposed on a module fixing member 180 mounted on the rear side of the inner case 12. Here, the inner case 12 is provided with an opening corresponding to the coupling part 181. When the grille panel assembly 50 is assembled to the inner case 12, and then the module fixing member 180 is mounted on the rear side of the inner case 12 in a state where the thermoelectric module assembly 100 is mounted on the grille panel assembly 50, the inner case 12 and the module housing 110 may be coupled to each other while the coupling part 181 is inserted into the spacer 111.

Also, the coupling part 181 has a structure that protrudes forward from the rear surface of the inner case 12 and is made of the same material as the inner case 12 and also is molded together with the inner case 12 when the inner case 12 is molded. Thus, the module housing 110 may be mounted to be coupled to the spacer 111 at a position corresponding to the coupling part 181 on the inner case 12.

Since the spacer 111 and the coupling part 181 are coupled to each other, the module housing 110 and the inner case 12 may be spaced an extending length of the spacer 111 from each other so that the connection operation of the tube through which the refrigerant flows is more easily performed.

Figure 36:
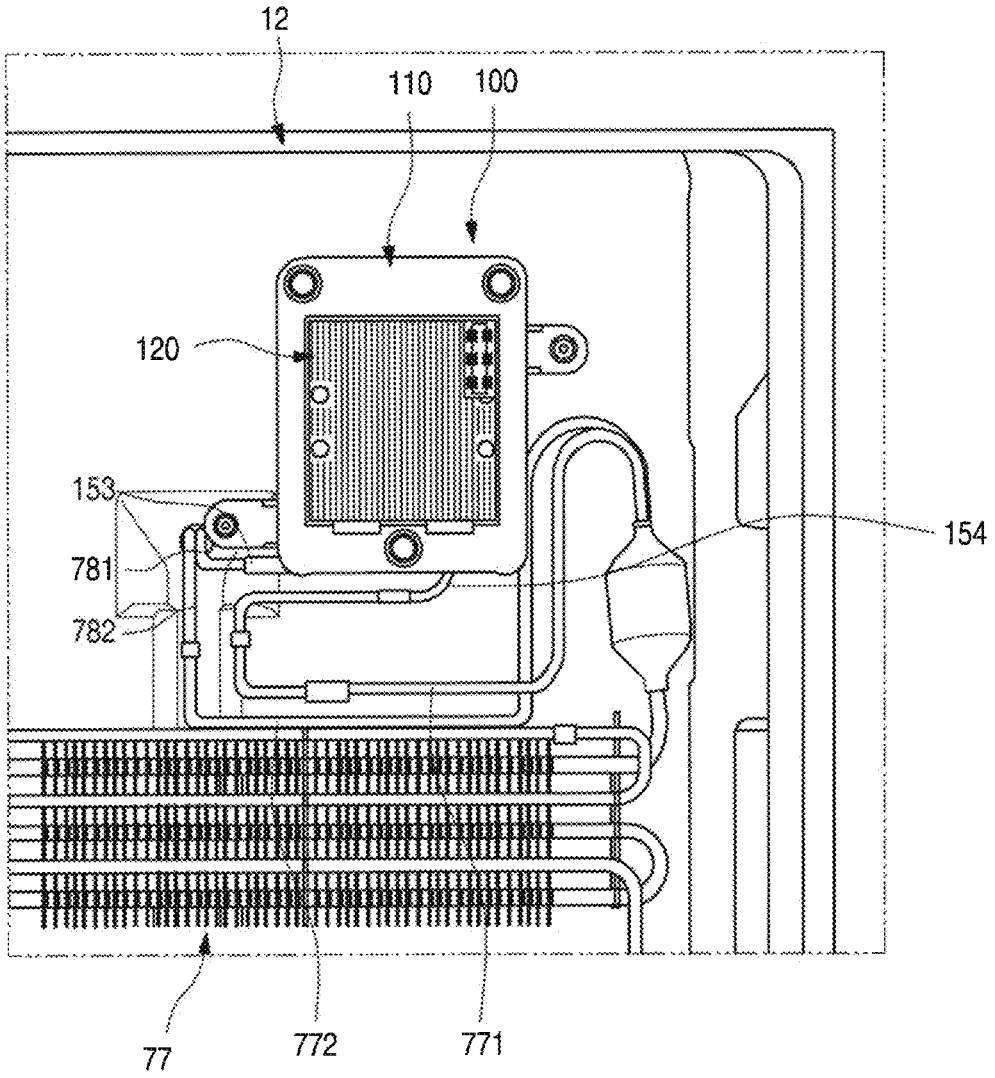
FIG. 36 is a view illustrating a connection state of the thermoelectric module assembly, the evaporator, and the refrigerant tube.
Figure 37:
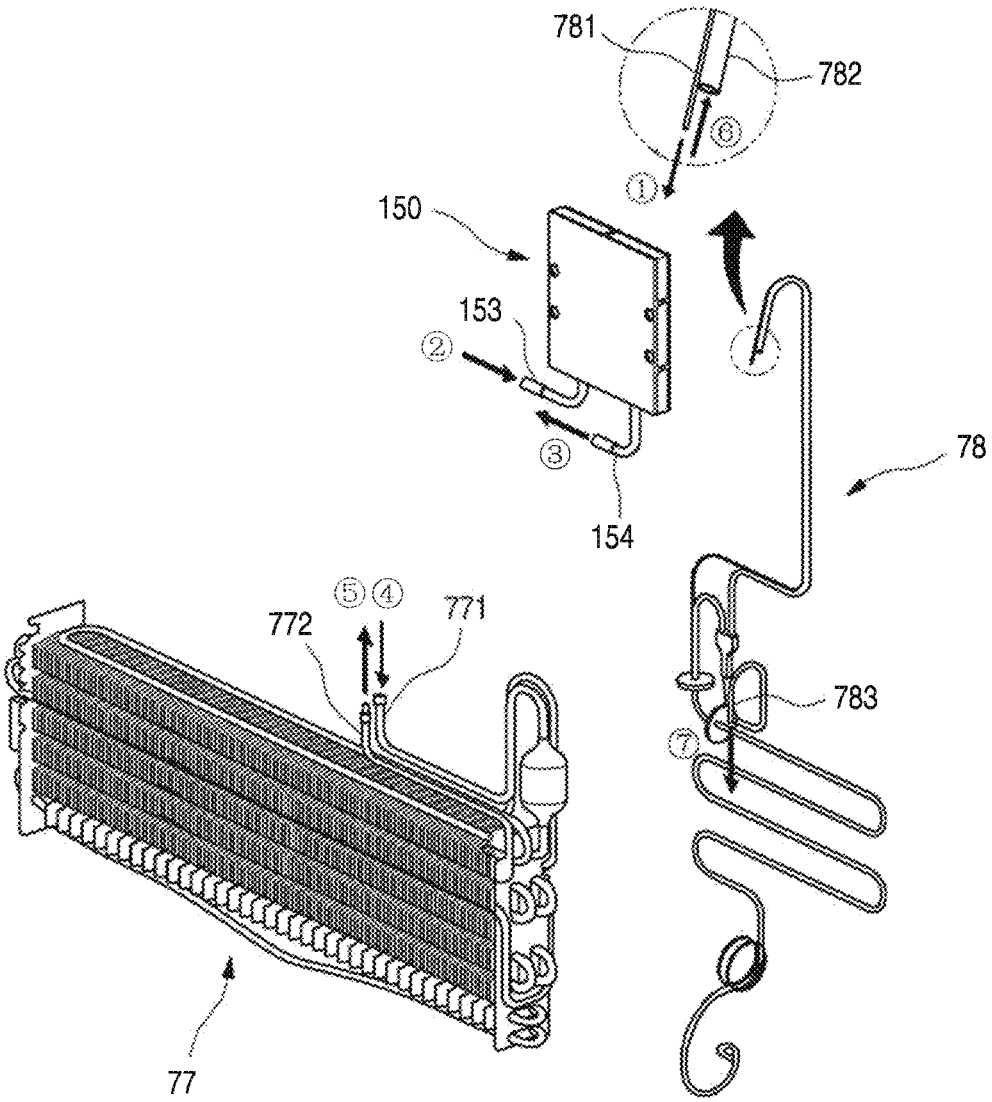
FIG. 37 is a schematic view illustrating a flow path between the thermoelectric module assembly and the evaporator.

FIG. 36 is a view illustrating a connection state of the thermoelectric module assembly, the evaporator, and the refrigerant tube. FIG. 37 is a schematic view illustrating a flow path between the thermoelectric module assembly and the evaporator.

As illustrated in the drawings, the heat sink 150 of the thermoelectric module assembly 100 may be cooled by using the low-temperature refrigerant introduced into the evaporator 88. That is, to cool the heat generation surface 130*b* of the thermoelectric module 130, a portion of the refrigerant tube introduced into the evaporator 77 may be bypassed to be introduced into the heat sink 150.

In detail, the evaporator 77 may be mounted between the inner case 12 and the grille panel assembly 50. Also, the thermoelectric module assembly 100 may be fixedly mounted on the grille panel assembly 50 and the inner case 12 and be disposed above the evaporator 77.

Here, the thermoelectric module assembly 100 may be disposed on one side that is adjacent to the distal tube of the evaporator 77 of both left and right sides of the evaporator 77 so that the evaporator 77 and the tube assembly 78 are easily connected to each other. That is, the evaporator input tube 771 through which the refrigerant is introduced into the evaporator 77 may be disposed adjacent to an end of an evaporator output tube 772.

As described above, the thermoelectric module 130, the evaporator 77, and the tube assemblies 78 may be more easily connected to each other through the disposition structure of the thermoelectric module assembly 100 and the coupling structure of the module housing 110.

Also, the refrigerant inflow tube 153 and the refrigerant outflow tube 154 may be bent to the evaporator input tube 771 and the evaporator output tube 772 so that the evaporator input tube 771 and the evaporator output tube 772 of the evaporator 77 are easily connected to each other.

The tube assembly 78 may be disposed outside the inner case 12, i.e., on a rear wall of the refrigerant main body 10. The tube assembly 78 includes a compressor connection part 783 connected to the compressor 71, a capillary tube 781 connected to the evaporator input tube 771, and an output connection part 782 connected to the evaporator output tube 772. The tube assembly of FIG. 38 has a tube structure in which the evaporators independently provided in the freezing compartment and the refrigerating compartment are connected to each other. Here, the number of evaporators and the connection structure of the evaporators may be changed. Also, a portion of the connection structure of the compressor and the condenser 73 may be omitted on one side of the tube assembly 78.

As illustrated in FIG. 36, in the state in which the thermoelectric module assembly 100 and the evaporator 77 are mounted on the inner case 12, a process of welding the tubes through which the refrigerant flows is performed. The welding process may be performed in the space between the thermoelectric module assembly 100 and the evaporator 77. Here, the space for easily performing the welding process may be secured by the spaced arrangement of the module housing 110 and the arrangement of the thermoelectric module assembly 100 and the evaporator 77.

In the state in which the evaporator 77 and the thermoelectric module assembly 100 are fixedly mounted, the refrigerant inflow tube 153 of the thermoelectric module assembly 100 may be connected to the capillary tube 781 through the welding, and the refrigerant outflow tube 154 may be connected to the evaporator input tube 771 through the welding. Also, the evaporator output tube 772 may be connected to the output connection part 782 of the tube assembly 78 through the welding.

In the flow path of the refrigerant according to the connection structure of the tubes, the low-temperature refrigerant introduced through the capillary tube 781 may pass through the heat sink 150 to cool the heat generation surface 130*b* of the thermoelectric module 130 coming into contact with the heat sink 150. Also, the refrigerant heat-exchanged by passing through the evaporator 77 through the evaporator input tube 771 may be introduced into the tube assembly 78 through the evaporator output tube 772 and the output connection part 782 and then be supplied to the compressor 71 along the compressor connection part 783 of the tube assembly 78. That is, the flow path of the refrigerant may flow in order of ① to ⑦ of FIG. 37.

As described above, the heat sink 150 may be effectively cooled by bypassing the low-temperature refrigerant introduced into the evaporator 77. The heat absorption surface 130*a* of the thermoelectric module 130 may be in the extremely low-temperature state through the cooling of the heat sink 150. Here, a temperature difference between the heat absorption surface 130*a* and the heat generation surface 130*b* may be about 30° C. or more so that the inside of the cryogenic freezing compartment 200 is cooled to an extremely low temperature of about −40° C. to about −50° C.

Hereinafter, a state and an operation state of the thermoelectric module assembly 100 capable of realizing such an extremely low temperature will be described with reference to the drawings.

Figure 38:
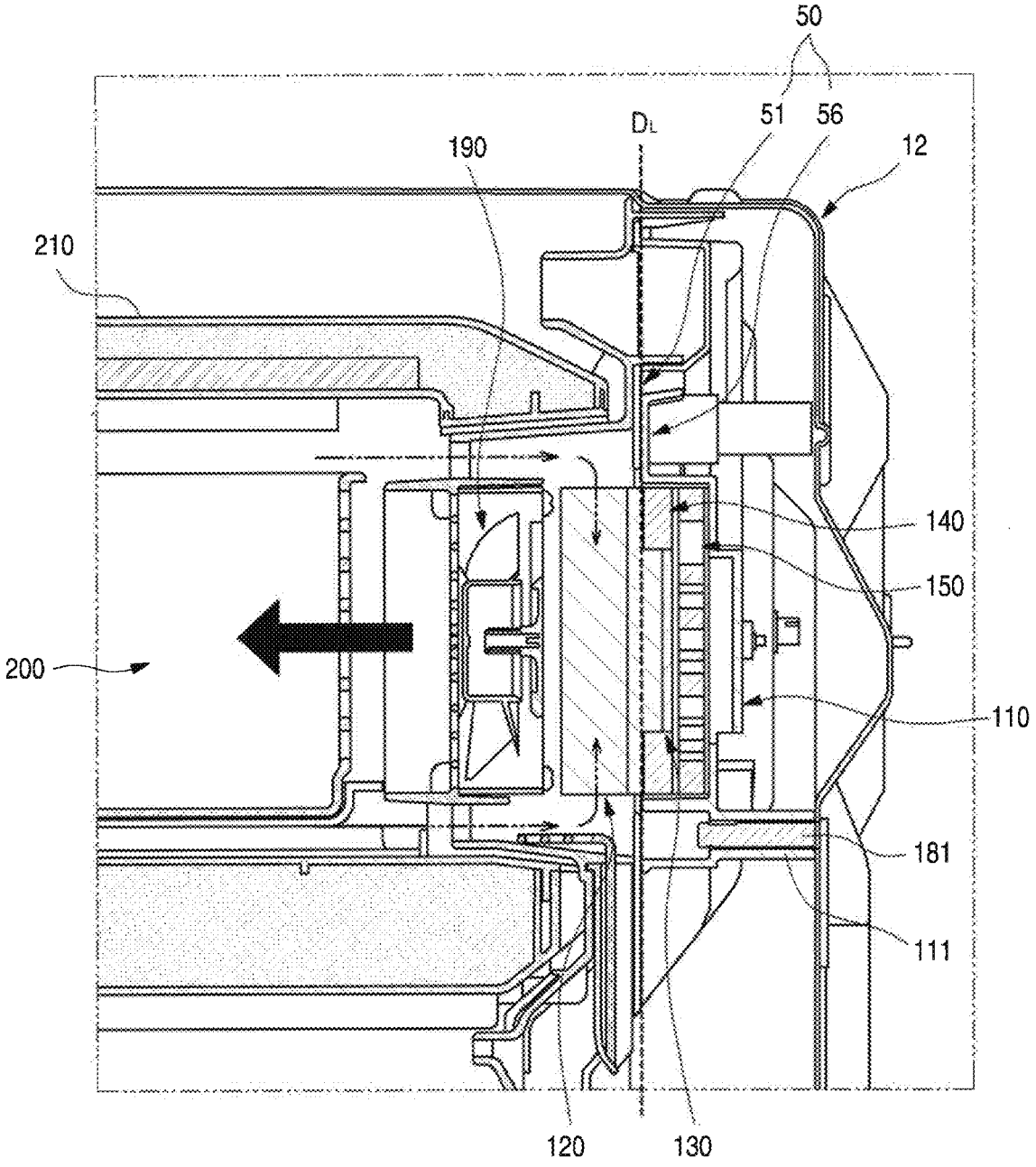
FIG. 38 is a cross-sectional view illustrating a mounting structure of the thermoelectric module assembly in a state in which cold air is supplied while the thermoelectric module assembly operates.

FIG. 38 is a view illustrating a state in which cold air is supplied while the thermoelectric module assembly operates.

As illustrated in the drawing, a cryogenic case 210 providing the cryogenic freezing compartment 200 is mounted inside the refrigerating compartment 30. The opened rear surface of the cryogenic case 210 is closely attached to the grille panel 51. Also, the thermoelectric module accommodation part 53 on which the thermoelectric module assembly 100 and the cooling fan 190 are mounted may be inserted through the opened rear surface of the cryogenic case 210 to supply cold air into the cryogenic freezing compartment 200.

The thermoelectric module assembly 100 may be disposed at the rear side of the cooling fan 190 and fixedly mounted on the grille panel assembly 50 and the inner case 12 in the state of being accommodated into and assembled with the inside of the module housing 110.

Here, a portion, at which the cold air is generated, of the thermoelectric module assembly 100 may be disposed inside the cryogenic freezing compartment 200, and a portion, at which heat is generated, of the thermoelectric module assembly 100 may be disposed inside the space in which the evaporator 77 is accommodated.

In FIG. 38, the arrangement of the thermoelectric module assembly will be described in more detail with reference to an extension line DL of the front surface of the shroud 56 that is the boundary between the cryogenic freezing compartment 200 and the accommodation space of the evaporator 77.

The heat absorption side of the thermoelectric module assembly 100 may be disposed at the front, and the heat dissipation side may be disposed at the rear with respect to the extension line DL. Here, the extension line DL may be the boundary between the refrigerating compartment and the space in which the evaporator 77 is accommodated and be defined as the rear surface of the grille panel 51, but not the front surface of the shroud 56.

That is, in the thermoelectric module assembly 100 is mounted, the cold sink 120 may be disposed at a front side of the extension line DL, and the rear surface of the cold sink 120 may be disposed on the extension line DL.

Thus, as illustrated in FIG. 38, the whole cold sink 120 from which the cold air is generated may be disposed inside the cryogenic freezing compartment 200, i.e., inside the thermoelectric module accommodation part 53. Thus, the cold sink 120 may be disposed in an independent space with respect to the heat sink 150 to completely supply the cold air generated from the cold sink 120 into the cryogenic freezing compartment 200. Here, when the cold sink 120 is disposed further backward, a portion of the cold sink 120 may be output of the area of the cryogenic freezing compartment 200 to deteriorate the cooling performance. Also, when the cold sink 120 is disposed further forward, the cryogenic freezing compartment 200 may be reduced in volume.

All the heat sink 150, the insulation material 140, and the thermoelectric module 130 may be disposed at the rear side with respect to the extension line DL, and the front surface of the insulation material 140 coming into contact with the rear surface of the cold sink 120 may be disposed on the extension line DL. The insulation material 140 may substantially cover an opening in the extension line DL to completely block the heat transfer between the cold sink 120 and the heat sink 150.

Also, the heat sink 150 is disposed on a region in which the evaporator 77 is accommodated, i.e., a region between the grille panel assembly 50 and the inner case 12, and the refrigerant supplied to the evaporator 77 cools the heat sink 150. The cooling performance of the thermoelectric module 130 may be maximized through the cooling of the heat sink 150 using the low-temperature refrigerant. The heat sink 150 may be additionally cooled using the cold air of the evaporator 77 by the module housing 110 spaced apart from the inner case 12.

As described above, the thermoelectric module assembly 100 may dissipate heat in the region in which the evaporator 77 is disposed and absorb heat in the cryogenic freezing compartment 200 to cool the cryogenic freezing compartment 200 to the extremely low-temperature state.

According to the embodiment, the thermoelectric module assembly for cooling the cryogenic freezing compartment may be provided in the grille panel assembly. Also, the entire heat absorption of the thermoelectric module assembly may be disposed inside the cryogenic freezing compartment, and the heat generation part may be disposed at the rear side of the grille panel assembly, i.e., in the space in which the evaporator is disposed. Thus, the cooling performance of the cryogenic freezing compartment may be maximized, and the loss of the storage space within the cryogenic freezing compartment may be minimized.

Also, the low-temperature refrigerant supplied to the evaporator may pass through the heat sink of the thermoelectric module assembly to increase in temperature difference between the heat absorption surface and the heat generation surface of the thermoelectric module, and thus, the cryogenic freezing compartment may realize the extremely low temperature of about −40° C. to about −50° C.

Also, the thermoelectric module, the heat sink, the cold sink, and the insulation material constituting the thermoelectric module assembly may be fixedly mounted on the grille panel assembly in the state of being mounted on the module housing to improve assembility and mounting property.

Particularly, the module housing may be fixedly mounted on the grille panel and also fixedly mounted on in the state of being spaced apart from the inner case to secure the space for the heat dissipation of the heat sink. Also, the space for performing the welding operation for connecting the heat sink to the refrigerant tube may be secured without the space loss in the storage space of the refrigerator and the cryogenic freezing compartment to more improve the workability and productivity.

Also, the cold sink, the insulation material, and the heat sink, which are provided in the module housing, may be provided by coupling the fixing boss and the fixing member, which extend from the module housing. Thus, the cold sink and the heat sink may be insulated from each other to prevent the thermoelectric module assembly from being deteriorated in cooling performance.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body comprising an inner case that defines a storage space;

an evaporator located inside of the storage space and configured to supply cold air to the storage space;

a grille panel assembly that comprises a grille panel and that partitions the storage space to separate an evaporator space from the storage space, the evaporator space being configured to accommodate the evaporator;

a cryogenic freezing compartment that defines an insulation space within the storage space and that is configured to maintain a temperature of the insulation space less than a temperature of the storage space, the cryogenic freezing compartment defining a rear opening at a rear surface that faces the grille panel; and a thermoelectric module assembly located at the grille panel and configured to supply cold air to the cryogenic freezing compartment, wherein the thermoelectric module assembly comprises:

a thermoelectric module comprising a heat absorption surface and a heat generation surface, a cold sink configured to contact the heat absorption surface and located in the cryogenic freezing compartment, a heat sink configured to contact the heat generation surface and located in the evaporator space, an insulation frame that is configured to receive the thermoelectric module and that is configured to thermally insulate the cold sink and the heat sink from each other; and a module housing that defines an accommodation groove configured to accommodate the heat sink, the insulation frame, and the thermoelectric module, the module housing comprising a spacer that extends from the module housing to the inner case and that is configured to maintain a space between the module housing and the inner case.

2. The refrigerator according to claim 1, wherein the insulation frame is further configured to cover at least a portion of the accommodation groove of the module housing, and wherein the insulation frame has a front surface that is configured to, based on the insulation frame covering at least the portion of the accommodation groove, be coplanar with an opening of the accommodation groove.

3. The refrigerator according to claim 2, wherein the module housing comprises a flange that is located around the opening of the accommodation groove, that is bent outward from the accommodation groove, and that is configured to couple to a rear surface of the grille panel assembly.

4. The refrigerator according to claim 1, wherein the module housing comprises a fixing boss that is located inside of the accommodation groove, that is configured to pass through the heat sink and the insulation frame, and that extends to the cold sink, and wherein the fixing boss is configured to couple the cold sink and the heat sink to each other in a state in which the insulation frame is disposed between the heat sink and the cold sink.

5. The refrigerator according to claim 1, wherein the evaporator space is configured to receive the module housing.

6. The refrigerator according to claim 1, wherein the spacer defines a hollow space inside of the spacer, and wherein the inner case comprises a protrusion that is configured to insert into the hollow space of the spacer and to couple to the spacer.

7. The refrigerator according to claim 1, wherein the thermoelectric module assembly further comprises a protrusion that extends from a rear side of the inner case toward the module housing and that is configured to pass through the inner case and couple to the spacer of the module housing.

8. The refrigerator according to claim 1, further comprising:

a capillary tube configured to supply low-temperature refrigerant to the evaporator through the heat sink;

a refrigerant inflow tube connected to the capillary tube; and a refrigerant outflow tube connected to the evaporator, wherein the heat sink is configured to receive the refrigerant inflow tube and the refrigerant outflow tube.

9. The refrigerator according to claim 8, wherein the thermoelectric module assembly further comprises a module housing that is configured to accommodate the heat sink, the module housing having a surface that defines a hole configured to receive the refrigerant inflow tube or the refrigerant outflow tube.

10. The refrigerator according to claim 1, wherein the grille panel assembly defines an extension line that extends along a surface of the cold sink that contacts the insulation frame.

11. The refrigerator according to claim 1, further comprising an accommodation part that is located at a side of the grille panel facing toward the cryogenic freezing compartment, that is configured to insert to the rear opening of the cryogenic freezing compartment, and that is configured to seal a space between the rear surface of the cryogenic freezing compartment and the grille panel.

12. The refrigerator according to claim 11, wherein the accommodation part protrudes to the rear opening of the cryogenic freezing compartment, and wherein the accommodation part is further configured to accommodate the thermoelectric module assembly.

13. The refrigerator according to claim 12, wherein the thermoelectric module assembly further comprises a cooling fan located in the accommodation part and configured to cause circulation of cold air between the cryogenic freezing compartment and the cold sink.

14. The refrigerator according to claim 1, wherein the spacer is a part of the module housing and protrudes from a rear surface of the module housing to a front surface of the inner case.

15. A refrigerator comprising:

a main body comprising an inner case that defines a storage space configured receive food;

an evaporator located in the main body;

a grille panel assembly that comprises a grille panel and that partitions the storage space to separate a heat-exchange space from the storage space, the heat-exchange space facing an inner surface of the inner case and being configured to accommodate the evaporator;

a cryogenic freezing compartment that defines an insulation space within the storage space, the insulation space being thermally insulated from the storage space; and a thermoelectric module assembly located at the grille panel and configured to cool the cryogenic freezing compartment, wherein the thermoelectric module assembly comprises:

a cold sink located in the storage space at a first side with respect to an interface between the storage space and the heat-exchange space, a heat sink located in the heat-exchange space at a second side that is opposite to the first side with respect to the interface between the storage space and the heat-exchange space, and a module housing that is coupled to the grille panel, that is located inside of the heat-exchange space, and that is configured to accommodate the heat sink and the cold sink, the module housing comprising a spacer that is configured to contact the inner surface of the inner case and that is configured to maintain a space between the module housing and the inner surface of the inner case.

16. The refrigerator according to claim 15, further comprising a thermoelectric module accommodation part that is located at the grille panel, that is configured to insert into the cryogenic freezing compartment, and that is configured to receive the thermoelectric module assembly.

17. The refrigerator according to claim 15, further comprising:

a refrigerant passage that circulates refrigerant through a refrigeration cycle configured to cool the storage space, that is configured to supply refrigerant to the evaporator, and that is connected to the evaporator through the heat sink.

18. The refrigerator according to claim 17, further comprising:

a capillary tube that is disposed in the refrigeration cycle and that is configured to supply low-temperature refrigerant to the evaporator through the heat sink, wherein the refrigerant passage comprises a refrigerant inflow tube that is connected to the capillary tube and a refrigerant outflow tube that is connected to the evaporator, and wherein the heat sink is configured to receive the refrigerant inflow tube and the refrigerant outflow tube.

* * * * *